US011175052B2

(12) United States Patent
Ha et al.

(10) Patent No.: US 11,175,052 B2
(45) Date of Patent: Nov. 16, 2021

(54) AIR CONDITIONER AND CONTROL METHOD THEREOF

(71) Applicant: Samsung Electronics Co., Ltd., Suwon-si (KR)

(72) Inventors: Jong Kweon Ha, Suwon-si (KR); Hee-Chan Kang, Suwon-si (KR); Jong Woon Kim, Suwon-si (KR); Tae Woo Kim, Suwon-si (KR); Seung Jun Park, Suwon-si (KR); Byoung-Ok Ahn, Suwon-si (KR); Hong Seok Jun, Suwon-si (KR); Jun Hwang, Suwon-si (KR); Kwon Jin Kim, Suwon-si (KR); Na Yeong Byeon, Suwon-si (KR); Hyeong Joon Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/992,511

(22) Filed: May 30, 2018

(65) Prior Publication Data

US 2018/0320909 A1 Nov. 8, 2018

Related U.S. Application Data

(63) Continuation of application No. 15/214,766, filed on Jul. 20, 2016.

(30) Foreign Application Priority Data

Jul. 21, 2015 (KR) ..... 10-2015-0103147
Jul. 23, 2015 (KR) ..... 10-2015-0104087
Sep. 30, 2015 (KR) ..... 10-2015-0138016

(51) Int. Cl.
*F24F 1/00* (2019.01)
*F24F 1/0014* (2019.01)
(Continued)

(52) U.S. Cl.
CPC ..... *F24F 1/0014* (2013.01); *F24F 1/0003* (2013.01); *F24F 1/005* (2019.02);
(Continued)

(58) Field of Classification Search
CPC ..... F24F 1/0014; F24F 1/005; F24F 1/0003; F24F 13/20; F24F 2110/20; F24F 11/30;
(Continued)

(56) References Cited

U.S. PATENT DOCUMENTS 5,473,123 A 12/1995 Yazici
5,778,147 A 7/1998 Kim
(Continued)

FOREIGN PATENT DOCUMENTS

CA 2914437 12/2014
CN 1517606 8/2004
(Continued)

OTHER PUBLICATIONS

International Search Report dated Oct. 26, 2016 in International Patent Application No. PCT/KR2016/007907.
(Continued)

*Primary Examiner* — Kenneth J Hansen
*Assistant Examiner* — Ryan L Faulkner
(74) *Attorney, Agent, or Firm* — Staas & Halsey, LLP

(57) ABSTRACT

An air conditioner and a control method thereof perform cooling through an outlet if room temperature or room humidity is high to reduce the room temperature or the room humidity, and closing the outlet to perform cooling at low velocity through an outlet hole if room temperature or room humidity reaches a predetermined value so that a user can little feel the wind velocity of cooling of the air conditioner, while maintaining indoor space at pleasant temperature or humidity. By performing cooling at low velocity through the outlet hole formed in the lower portion of the air conditioner,
(Continued)

it is possible to cool the lower area of indoor space at pleasant temperature when a user is asleep.

6 Claims, 33 Drawing Sheets

(51) Int. Cl.

| | |
|---|---|
| ***F24F 1/005*** | (2019.01) |
| ***F24F 1/0003*** | (2019.01) |
| ***F24F 13/20*** | (2006.01) |
| *F24F 11/30* | (2018.01) |
| *F24F 110/10* | (2018.01) |
| *F24F 110/20* | (2018.01) |
| *F24F 1/0033* | (2019.01) |
| *F24F 13/10* | (2006.01) |

(52) U.S. Cl.
CPC ..... *F24F 13/20* (2013.01); *F24F 1/0033* (2013.01); *F24F 11/30* (2018.01); *F24F 13/10* (2013.01); *F24F 2110/10* (2018.01); *F24F 2110/20* (2018.01); *F24F 2221/26* (2013.01)

(58) Field of Classification Search
CPC ..... F24F 2110/10; F24F 1/0033; F24F 13/10; F24F 2221/26
USPC ..... 454/229
See application file for complete search history.

(56) References Cited

U.S. PATENT DOCUMENTS

| | | | |
|---|---|---|---|
| 5,971,067 | A | 10/1999 | Rayburn |
| 6,021,954 | A | 2/2000 | Kalwa |
| 6,668,917 | B1 | 12/2003 | Zeng |
| 6,879,881 | B1 | 4/2005 | Attridge, Jr. |
| 7,340,907 | B2 | 3/2008 | Vogh, III |
| 7,946,505 | B2 | 5/2011 | Lynam |
| 2008/0119125 | A1 | 5/2008 | Guerreiro |
| 2009/0032235 | A1 | 2/2009 | Sullivan et al. |
| 2009/0057430 | A1 | 3/2009 | Cherewatti |
| 2009/0247045 | A1 | 10/2009 | Pettey |
| 2011/0159795 | A1 | 6/2011 | Sprague |
| 2011/0168379 | A1 | 7/2011 | Morgan |
| 2012/0190293 | A1 | 7/2012 | Badenhorst |
| 2013/0199772 | A1 | 8/2013 | Fischer |
| 2014/0000852 | A1 | 1/2014 | Kim et al. |
| 2014/0360212 | A1 | 12/2014 | Bae et al. |
| 2015/0136376 | A1 | 5/2015 | Niemann |
| 2015/0377540 | A1 | 12/2015 | Jo |
| 2016/0258636 | A1 | 9/2016 | Kim |
| 2017/0016633 | A1 | 1/2017 | Jeon |
| 2017/0016634 | A1 | 1/2017 | Lee |
| 2017/0023264 | A1 | 1/2017 | Ha |
| 2017/0089593 | A1 | 3/2017 | Kim |
| 2017/0097162 | A1 | 4/2017 | Shin |
| 2017/0198938 | A1 | 7/2017 | Kim |
| 2018/0320909 | A1 | 11/2018 | Ha |
| 2020/0132319 | A1 | 4/2020 | Kim |

FOREIGN PATENT DOCUMENTS

| | | | |
|---|---|---|---|
| CN | 1657837 | | 8/2005 |
| CN | 1258059 | | 5/2006 |
| CN | 203036819 | | 7/2013 |
| CN | 103528131 | | 1/2014 |
| CN | 104676759 | | 6/2015 |
| CN | 105180267 | | 12/2015 |
| EP | 1319900 | A1 | 6/2003 |
| EP | 1775519 | | 4/2007 |
| EP | 2431676 | | 3/2012 |
| JP | 63213729 | A | 9/1988 |
| JP | 04146694 | A | 5/1992 |
| JP | 5-196258 | | 8/1993 |
| JP | 07324801 | A | 12/1995 |
| JP | 2001-41542 | | 2/2001 |
| JP | 2004-176995 | | 6/2004 |
| JP | 2005241639 | A | 9/2005 |
| JP | 2007-218541 | | 8/2007 |
| JP | 2010-243005 | | 10/2010 |
| JP | 2012-93043 | | 5/2012 |
| JP | 2012-172854 | | 9/2012 |
| JP | 2013-29260 | | 2/2013 |
| JP | 2013-228153 | | 11/2013 |
| JP | 2015-21656 | | 2/2015 |
| JP | 2015-48948 | | 3/2015 |
| KR | 10-2004-0063265 | | 7/2004 |
| KR | 10-1271056 | | 6/2013 |
| KR | 10-2014-0002547 | | 1/2014 |
| KR | 10-2014-0011716 | | 1/2014 |
| KR | 10-2014-0090323 | | 7/2014 |
| KR | 10-2015-0032106 | | 3/2015 |
| KR | 10-2015-0051269 | | 5/2015 |
| SU | 1002742 | A | 3/1983 |
| WO | 2008/102999 | | 8/2008 |

OTHER PUBLICATIONS

Korean Office Action dated Aug. 16, 2016 in Korean Patent Application No. 10-2015-0138016.
Korean Notice of Allowance dated Aug. 16, 2017 in Korean Patent Application No. 10-2015-0138016, Partial.
European Office Communication dated Jul. 13, 2017 in European Patent Application No. 16828063.4.
Korean Office Action dated Dec. 19, 2016 in Korean Patent Application No. 10-2015-0138016, Partial.
Korean Office Action dated Nov. 7, 2017 in Korean Patent Application No. 10-2017-0133941, Partial.
Extended European Search Report dated Nov. 21, 2017 in European Patent Application No. 16828063.4.
U.S. Appl. No. 15/214,766, filed Jul. 20, 2016, Jong Kweon HA, et al., Samsung Electronics Co., Ltd.
U.S. Appl. No. 15/937,168, filed Mar. 27, 2018, Jong Kweon HA, et al., Samsung Electronics Co., Ltd.
Australian Office Action dated Jun. 29, 2018 in Australian Patent Application No. 2016297238.
Korean Office Action dated Jul. 17, 2018 in Korean Patent Application No. 10-2018-0057471.
Korean Office Action dated May 15, 2018 in Korean Patent Application No. 10-2017-0133941.
Korean Office Action dated Jul. 20, 2018 in Korean Patent Application No. 10-2017-0133941.
U.S. Office Action dated Aug. 9, 2018 in U.S. Appl. No. 15/937,168.
Extended European Search Report dated Oct. 29, 2018 in European Patent Application No. 18164980.7.
Australian Notice of Acceptance dated Oct. 29, 2018 in Australian Patent Application No. 2016297238.
Korean Notice of Allowance dated Oct. 22, 2018 in Korean Patent Application No. 10-2018-0057471.
Russian Office Action dated Oct. 11, 2018 in Russian Patent Application No. 2018102098.
U.S. Office Action dated Mar. 8, 2019 in U.S. Appl. No. 15/937,168.
U.S. Office Action dated Apr. 5, 2019 in U.S. Appl. No. 15/214,766.
European Communication dated Apr. 23, 2019 in European Patent Application No. 16828063.4.
Russian Decision to Grant dated Apr. 15, 2019 in Russian Patent Application No. 201802098/12.
U.S. Office Action dated Jun. 28, 2019 in U.S. Appl. No. 15/937,168.
U.S. Office Action dated Oct. 16, 2019 in U.S. Appl. No. 15/214,766.
European Communication dated Oct. 1, 2019 in European Patent Application No. 18164980.7.
Chinese Office Action dated Sep. 27, 2019 in Chinese Patent Application No. 201680003776.6.
Chinese Office Action dated Feb. 3, 2020 in Chinese Patent Application No. 201810300107.6.
Chinese Office Action dated Dec. 20, 2019 in Chinese Patent Application No. 201810296265.9.

(56) References Cited

OTHER PUBLICATIONS

European Office Action dated Jan. 24, 2020 in European Patent Application No. 16828063.4.
Chinese Office Action dated Feb. 27, 2020 in Chinese Patent Application No. 201810635765.0.
U.S. Office Action dated Mar. 5, 2020 in U.S. Appl. No. 15/214,766.
U.S. Office Action dated Jan. 7, 2020 in U.S. Appl. No. 15/937,168.
U.S. Notice of Allowance dated Aug. 10, 2020 in U.S. Appl. No. 15/937,168.
U.S. Office Action dated Sep. 2, 2020 in U.S. Appl. No. 15/214,766.
Indian Office Action dated Jun. 23, 2020 in Indian Patent Application No. 201817001807.
Brazilian Office Action dated Jul. 8, 2020 in Brazilian Patent Application No. BR112018000385-9.
Chinese Office Action dated Mar. 22, 2021 in Chinese Patent Application No. 201810296265.9.
Chinese Office Action dated Apr. 2, 2021 in Chinese Patent Application No. 201810300107.6.
Chinese Office Action dated Apr. 25, 2021 in Chinese Patent Application No. 201810635765.0.
Chinese Office Action dated Sep. 21, 2020 in Chinese Patent Application No. 201810300107.6.
Chinese Office Action dated Oct. 27, 2020 in Chinese Patent Application No. 201810635765.0.
U.S. Notice of Allowance dated Aug. 6, 2021 in U.S. Appl. No. 15/214,766.

AIR CONDITIONER AND CONTROL METHOD THEREOF

CROSS-REFERENCE TO RELATED APPLICATIONS

This application is a continuation of U.S. patent application Ser. No. 15/214,766, filed on Jul. 20, 2016, which claims the priority benefit of Korean Patent Application No. 10-2015-0103147, filed on Jul. 21, 2015 in the Korean Intellectual Property Office, Korean Patent Application No. 10-2015-0104087, filed on Jul. 23, 2015 in the Korean Intellectual Property Office, and Korean Patent Application No. 10-2015-0138016, filed on Sep. 30, 2015 in the Korean Intellectual Property Office, the disclosures of which are incorporated herein by reference.

BACKGROUND

1. Field

The following description relates to an air conditioner and a control method thereof.

2. Description of the Related Art

An air conditioner is an electronic appliance that uses a cooling cycle to maintain room air pleasant to be suitable for human activities. The air conditioner cools indoor space by drawing in warm air of the indoor space, heat-exchanging the warm air with low-temperature refrigerants, and then discharging the heat-exchanged air to the indoor space. Also, the air conditioner can heat indoor space through the inverse operation.

The air conditioner can cool or heat indoor space by circulating air in a forward or reverse direction through a cooling cycle performed by a compressor, a condenser, an expansion valve, and an evaporator. The compressor provides refrigerant gas in a high-temperature, high-pressure state, and the condenser provides liquid-state refrigerants at room-temperature, high-pressure. The expansion valve decompresses the liquid-state refrigerants at room-temperature, high-pressure, and the evaporator evaporates the decompressed refrigerants to a gas state at low temperature.

The air conditioner can be classified into a split type air conditioner in which an outdoor unit is separated from an indoor unit, and a window type air conditioner in which an outdoor unit and an indoor unit are integrated into one body.

In the case of the split type air conditioner in which the outdoor unit is separated from the indoor unit, generally, a compressor and a condenser (outdoor heat exchanger) are included in the outdoor unit, and an evaporator (indoor heat exchanger) is included in the indoor unit. Refrigerants can be circulated and flow between the outdoor unit and the indoor unit through a pipe connecting the indoor unit to the outdoor unit. In the lower portion of the indoor unit of the split type air conditioner, a blower fan is disposed, and in the upper portion of the indoor unit, a heat exchanger and an outlet through which air is discharged are disposed. Air drawn and blown by the blower fan moves to the upper portion of the indoor unit, and the air moved to the upper portion is discharged to indoor space through the heat exchanger and the outlet.

Meanwhile, the air conditioner can provide a dehumidification function in addition to a cooling function. A dehumidification function provided by a typical air conditioner accompanies a cooling effect. However, to meet users' demands requiring only dehumidification, a dehumidification function without accompanying the cooling effect needs to be implemented.

Recently, studies into an air conditioner capable of lowering the wind velocity of air discharged through an outlet as much as possible so that a user can little feel the wind velocity of air, while maintaining indoor space at pleasant temperature are actively conducted. Also, technology for preventing condensation of the air conditioner is being developed.

SUMMARY

Therefore, it is an aspect of the present disclosure to provide an air conditioner capable of performing cooling through an outlet if room temperature or room humidity is high to reduce the room temperature or the room humidity, and closing the outlet to perform cooling at low velocity through an outlet hole if room temperature or room humidity reaches a predetermined value so that a user can little feel the wind velocity of cooling of the air conditioner, while maintaining indoor space at pleasant temperature or humidity, and a control method of the air conditioner. Furthermore, by performing cooling at low velocity through the outlet hole formed in the lower portion of the air conditioner, it is possible to cool the lower area of indoor space at pleasant temperature when a user is asleep.

Also, it is an aspect of the present disclosure to provide an air conditioner capable of preventing condensation by operating a blower fan based on time and temperature when the blower fan stops, and a control method of the air conditioner.

Also, it is an aspect of the present disclosure to provide an air conditioner capable of providing a dehumidification function with a low cooling effect.

Additional aspects of the disclosure will be set forth in part in the description which follows and, in part, will be obvious from the description, or may be learned by practice of the disclosure.

In accordance with an aspect of the present disclosure, an air conditioner includes: a housing; a heat exchanger configured to heat-exchange air drawn into the inside of the housing; a blower fan configured to move the heat-exchanged air to discharge the heat-exchanged air to the outside of the housing; an outlet configured to discharge the heat-exchanged air to the outside of the housing; an outlet hole formed in the housing, and configured to discharge the heat-exchanged air; and a controller configured to close the outlet if room temperature reaches a predetermined value, and to discharge the heat-exchanged air through the outlet hole, thereby maintaining room temperature at the predetermined value.

A plurality of outlets are provided, and the controller may close a part of the plurality of outlets to discharge the heat-exchanged air through the outlet hole, if the room temperature is equal to or smaller than the predetermined value.

If the room temperature is equal to or smaller than the predetermined value, the controller may reduce Revolutions Per Minute (RPM) of the blower fan to reduce velocity of air discharged through the outlet hole.

If the room temperature is greater than the predetermined value, the controller may open the outlet.

If the room temperature is greater than the predetermined value, the controller may increase Revolutions Per Minute (RPM) of the blower fan to increase velocity of air discharged through at least one of the opened outlet and the outlet hole.

The air conditioner may further include: an input unit configured to receive a control command for closing the outlet from a user so that the heat-exchanged air is discharged through the outlet hole.

In accordance with an aspect of the present disclosure, an air conditioner includes: a housing; an heat exchanger configured to heat-exchange air drawn into the inside of the housing; a blower fan configured to move the heat-exchanged air to discharge the heat-exchanged air to the outside of the housing; an outlet configured to discharge the heat-exchanged air to the outside of the housing; an outlet hole formed in the housing, and configured to discharge the heat-exchanged air; and a controller configured to close the outlet if room humidity reaches a predetermined value, and to discharge the heat-exchanged air through the outlet hole, thereby maintaining room humidity at the predetermined value.

A plurality of outlets are provided, and the controller may close a part of the plurality of outlets to discharge the heat-exchanged air through the outlet hole, if the room humidity is equal to or smaller than the predetermined value.

If the room humidity is equal to or smaller than the predetermined value, the controller may reduce Revolutions Per Minute (RPM) of the blower fan to reduce velocity of air discharged through the outlet hole.

If the room humidity is greater than the predetermined value, the controller may open the outlet.

If the room humidity is greater than the predetermined value, the controller may increase Revolutions Per Minute (RPM) of the blower fan to increase velocity of air discharged through at least one of the opened outlet and the outlet hole.

The air conditioner may further include: an input unit configured to receive information about room humidity of space where the air conditioner is located.

The air conditioner may further include: a storage unit configured to store information about room temperature of space where the air conditioner is located.

In accordance with an aspect of the present disclosure, an air conditioner includes: a housing; a heat exchanger configured to heat-exchange air drawn into the inside of the housing; a blower fan configured to move the heat-exchanged air to discharge the heat-exchanged air to the outside of the housing; an outlet configured to discharge the heat-exchanged air to the outside of the housing; an outlet hole formed in the housing, and configured to discharge the heat-exchanged air; and a controller configured to rotate the blower fan to discharge the heat-exchanged air through the outlet hole, if it is determined that condensation occurs after the outlet closes and the blower fan stops rotating.

A plurality of outlets are provided, a plurality of blower fans are provided to correspond to the plurality of outlets, and the controller may rotate the blower fan to discharge the heat-exchanged air through the outlet hole, if it is determined that condensation occurs after a part of the plurality of outlets closes and a part of the plurality of blower fans corresponding to the closed outlet stops rotating.

The controller may rotate the blower fan at predetermined time intervals.

The controller rotates the blower fan for a predetermined period.

Whether condensation occurs is determined based on at least one of a time and temperature of a front panel disposed in the housing.

The controller may determine that condensation occurs, if a predetermined time period elapses after the blower fan stops rotating.

The controller may determine that condensation occurs, if the temperature of the front panel is equal to or lower than dew point temperature.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
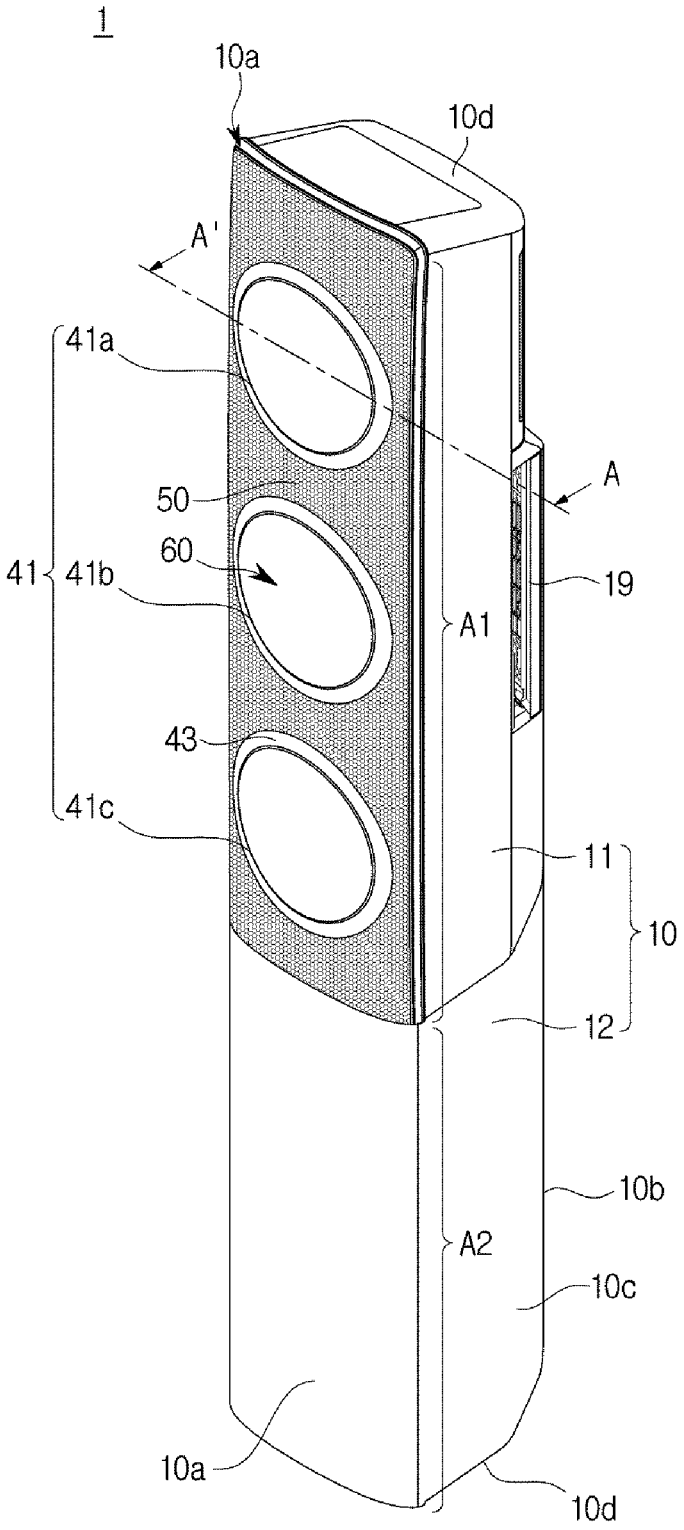
FIG. 1 is a perspective view showing an outer appearance of an air conditioner according to an embodiment of the present disclosure.

Reference will now be made in detail to the embodiments, examples of which are illustrated in the accompanying drawings, wherein like reference numerals refer to like elements throughout. The embodiments are described below to explain the present disclosure by referring to the figures.

Advantages and features of the present disclosure and a method of achieving the advantages and features will be apparent by referring to embodiments described below in connection with the accompanying drawings.

Configurations illustrated in the embodiments and the drawings described in the present specification are only embodiments of the present disclosure, and thus it is to be understood that various modified examples, which may replace the embodiments and the drawings described in the present specification, are possible.

The terms used in the present specification are used to describe the embodiments of the present disclosure. Accordingly, it should be apparent to those skilled in the art that the following description of exemplary embodiments of the present disclosure is provided for illustration purpose only and not for the purpose of limiting the disclosure as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Hereinafter, an air conditioner and a control method thereof will be described in detail according to embodiments with reference to the accompanying drawings. In the drawings, like reference numerals refer to like elements throughout, and overlapping descriptions thereof will be omitted.

In a typical air conditioner, an indoor unit is designed to minimize a heat exchanger, and to raise Revolutions Per Minute (RPM) of a blower fan to maximize wind velocity and wind volume. Accordingly, the temperature of discharged air is lowered, and the air forms a narrow and long path to be discharged to indoor space.

Accordingly, when a user directly contacts the discharged air, he/she may feel cold and displeasure, and when he/she does not contact the discharged air, he/she may feel hot and displeasure.

Also, increasing the RPM of the blower fan in order to obtain high wind velocity results in an increase of noise. Meanwhile, a radiant air conditioner of conditioning air without using any blower fan requires a large panel in order to obtain the same performance as an air conditioner using a blower fan. Also, the radiant air conditioner has very low cooling velocity, and requires high construction costs.

An air conditioner may include a heat exchanger to heat-exchange air drawn into the inside of a housing forming its outer appearance, and a blower fan to intake room air into the inside of the housing and then to again blow the air to an indoor space.

However, when air flows by the blower fan, air-conditioned air may be discharged directly towards a target through an outlet of the housing. In this case, the target may directly contact the air-conditioned air to feel displeasure due to local cooling or heating.

In the following description, the embodiments of the present disclosure will be described in regard of cooling operation of the air conditioner. However, the embodiments of the present disclosure can be applied to heating operation of the air conditioner.

A cooling cycle constituting the air conditioner may be performed by a compressor, a condenser, an expansion valve, and an evaporator. The cooling cycle may perform a series of processes of compression-condensation-expansion-evaporation to heat-exchange high-temperature air with low-temperature refrigerants and then supply low-temperature air to indoor space.

The compressor may compress refrigerant gas to a high-temperature, high-pressure state, and discharge the compressed refrigerant gas to the condenser. The condenser may condense the compressed refrigerant gas to a liquid state, and emit heat to the surroundings during the condensing process. The expansion valve may expand the liquid-state refrigerants in the high-temperature, high-pressure state condensed by the condenser to liquid-state refrigerants in a low-pressure state. The evaporator may evaporate the refrigerants expanded by the expansion valve. The evaporator may achieve a cooling effect through heat-exchange with an object to be cooled using evaporative latent heat of refrigerants, and return the refrigerant gas in the low-temperature, low-pressure state to the compressor. Through the cycle, the air temperature of the indoor space can be adjusted.

An outdoor unit of the air conditioner may be a part of the cooling cycle, configured with a compressor and an outdoor heat exchanger. The expansion valve may be installed in any one of the indoor unit and the outdoor unit, and an indoor heat exchanger may be installed in the indoor unit of the air conditioner.

The present disclosure relates to an air conditioner for cooling indoor space, wherein an outdoor heat exchanger functions as a condenser, and an indoor heat exchanger functions as an evaporator. Hereinafter, for convenience of description, an indoor unit including an indoor heat exchanger will be referred to as an air conditioner, and the indoor heat exchanger will be referred to as a heat exchanger.

Figure 2:
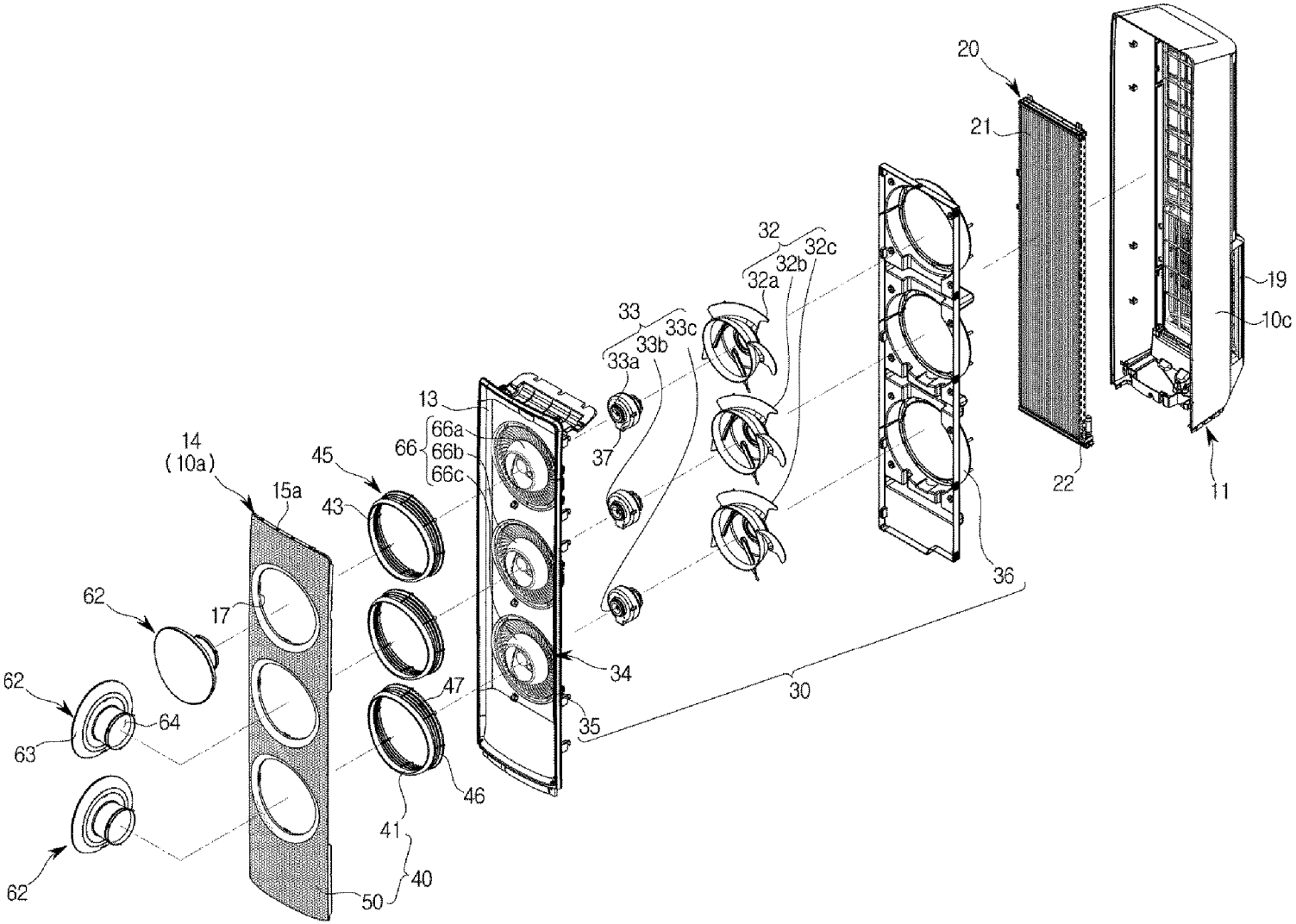
FIG. 2 is an exploded perspective view of an air conditioner according to an embodiment of the present disclosure.
Figure 3:
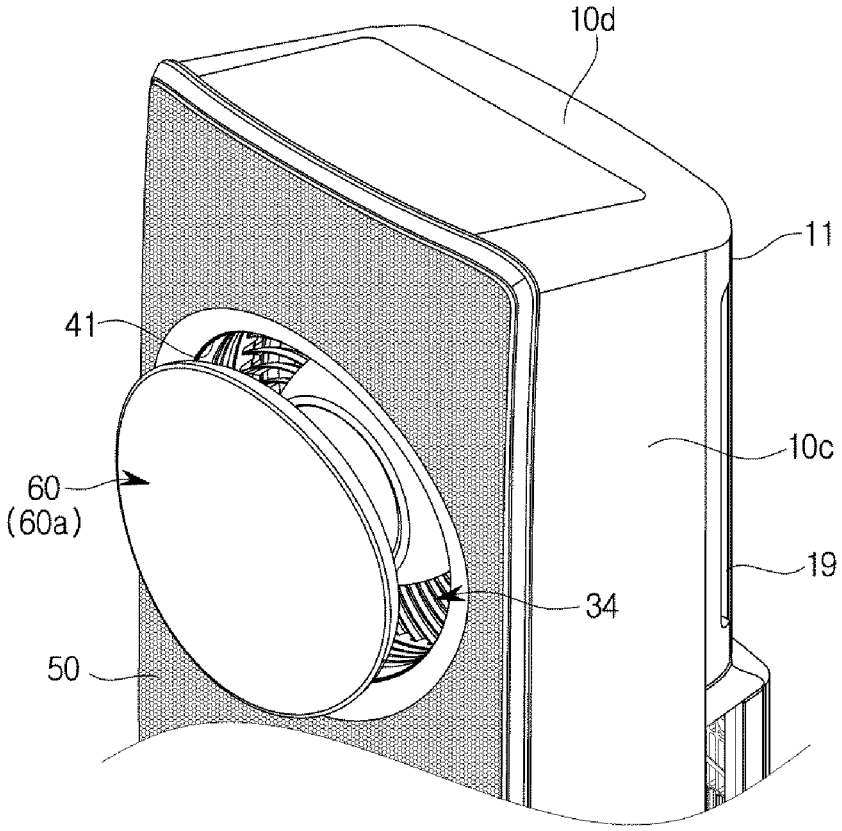
FIG. 3 is a perspective view of an air conditioner when an outlet opens, according to an embodiment of the present disclosure.
Figure 4:
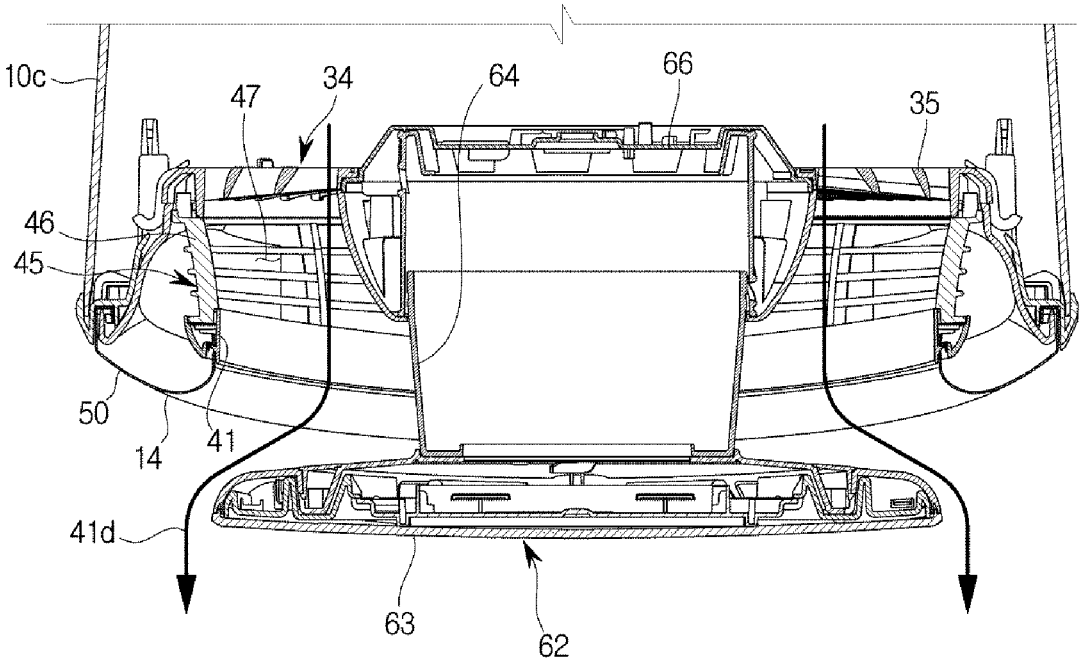
FIG. 4 is a cross-sectional view of the air conditioner of FIG. 1 cut along a line A-A' for describing the flow of air in first mode cooling operation that is performed when the outlet opens, according to an embodiment of the present disclosure.
Figure 5:
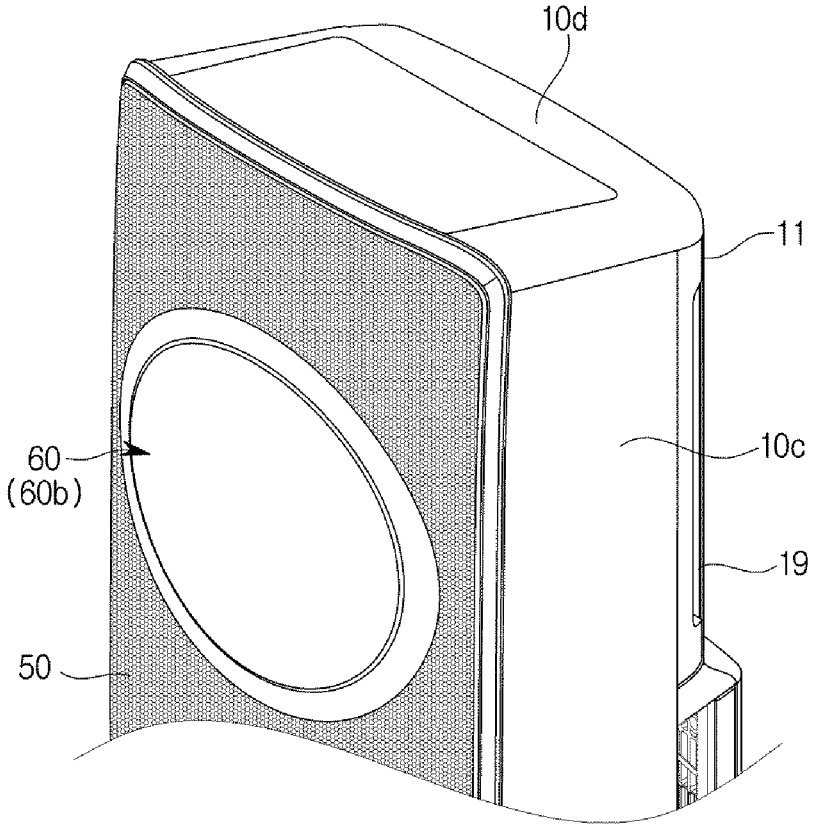
FIG. 5 is a perspective view of the air conditioner according to an embodiment of the present disclosure when the outlet closes.
Figure 6:
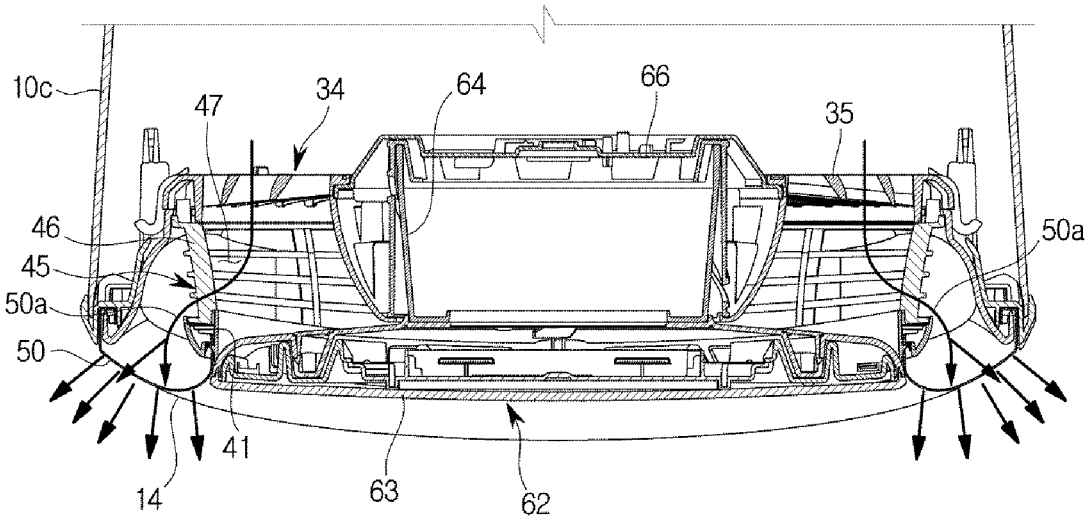
FIG. 6 is a cross-sectional view of the air conditioner of FIG. 1 cut along the line A-A' for describing the flow of air in second mode cooling operation that is performed through at least one outlet hole when the outlet closes, according to an embodiment of the present disclosure.

FIG. 1 is a perspective view showing an outer appearance of an air conditioner according to an embodiment of the present disclosure, FIG. 2 is an exploded perspective view of an air conditioner according to an embodiment of the present disclosure, FIG. 3 is a perspective view of an air conditioner when an outlet opens, according to an embodiment of the present disclosure, FIG. 4 is a cross-sectional view of the air conditioner of FIG. 1 cut along a line A-A' for describing the flow of air in first mode cooling operation that is performed when the outlet opens, according to an embodiment of the present disclosure, FIG. 5 is a perspective view of the air conditioner according to an embodiment of the present disclosure when the outlet closes, and FIG. 6 is a cross-sectional view of the air conditioner of FIG. 1 cut along the line A-A' for describing the flow of air in second mode cooling operation that is performed through at least one outlet hole when the outlet closes, according to an embodiment of the present disclosure.

Referring to FIGS. 1 and 2, an indoor unit (hereinafter, referred to as an air conditioner 1) of an air conditioner 1 may include: a housing 10 having at least one opening 17 and forming an outer appearance of the air conditioner 1; a heat exchanger 20 configured to heat-exchange air drawn into the inside of the housing 10; a blower unit 30 configured to circulate air to the inside or outside of the housing 10; and an outlet 41 configured to discharge air blown by the blower unit 30 to the outside of the housing 10. The outlet 41 may include a first outlet 41*a*, a second outlet 41*b*, and a third outlet 41*c*.

The housing 10 may include a front panel 10*a* in which the at least one opening 17 is formed, a rear panel 10*b* disposed behind the front panel 10*a*, side panels 10*c* provided between the front panel 10*a* and the rear panel 10*b*, and upper and lower panels 10*d* disposed above and below the side panels 10*c*. The at least one opening 17 may be in the shape of a circle. For example, at least two or more openings 17 may be formed at regular intervals in an up-down direction in the front panel 10*a*. In the rear panel 10*b*, an inlet 19 may be formed to intake outside air into the inside of the housing 10.

The inlet 19 may be provided in the rear panel 10*b* disposed behind the heat exchanger 20 to guide outside air to enter the inside of the housing 10. Air entering the inside of the housing 10 through the inlet 19 may pass through the heat exchanger 20 to absorb or lose heat. The air heat-exchanged through the heat exchanger 20 may be discharged to the outside of the housing 10 by the blower unit 30 through the outlet 41.

The blower unit 30 may include a blower fan 32 and a blower grill 34.

The blower grill 34 may be located in a direction in which the blower fan 32 discharges air. According to an embodiment, the blower fan 32 may be a mixed flow fan although not limited to this, and may have any structure capable of discharging air drawn from the outside of the housing 10 to the outside of the housing 10. For example, the blower fan 32 may be a cross fan, a turbo fan, or a sirocco fan. The number of the blower fan 32 is not limited, and according to an embodiment, at least one blower fan 32 may be provided to correspond to the at least one opening 17.

The blower unit 30 may include a fan driver 37 disposed in the center of the blower fan 32 and configured to drive the blower fan 32. The fan driver 37 may include a driving motor 33.

The blower grill 34 may be disposed in front of the blower fan 32 to guide flow of air. Also, the blower grill 34 may be disposed between the blower fan 32 and the outlet 41 to minimize outside influences on the blower fan 32.

The blower grill 34 may include a plurality of blades 35. The number, shape, and angle of the plurality of blades 35 may be changed to adjust the wind direction or wind volume of air that is blown from the blower fan 32 to the outlet 41.

A door operating element 66 which will be described later may pass through the center of the blower grill 34. The door operating element 66 and the fan driver 37 may be aligned on the same line in a front-back direction. Through the above-described configuration, the plurality of blades 35 of the blower grill 34 may be disposed in front of a plurality of fan blades of the blower fan 32.

The blower unit 30 may include a duct 36. The duct 36 may be in the shape of a circle surrounding the blower fan 32, and guide the flow of air flowing to the blower fan 32.

The heat exchanger 20 may be disposed between the blower fan 32 and the inlet 19, and may absorb heat from or transfer heat to air drawn through the inlet 19. The heat exchanger 20 may include a tube 21, and a header 22 coupled with the upper and lower portions of the tube 21. However, the kind of the heat exchanger 20 is not limited.

In the inside of the housing 10, at least one heat exchanger 20 may be installed to correspond to the at least one opening 17.

The air conditioner 1 may operate in a plurality of operation modes. The plurality of operation modes may include a first mode in which heat-exchanged air is discharged through the at least one outlet 41, and a second mode in which heat-exchanged air is discharged through an outlet hole 50 provided in an outlet plate 14.

More specifically, in the first mode, the air conditioner 1 may perform cooling through the at least one outlet 41 in such a way to discharge heat-exchanged air to the outside of the air conditioner 1 through the first to third outlets 41*a* to 41*c* that open. At this time, the air conditioner 1 may sense room temperature, and selectively open any one(s) of the first to third outlets 41*a* to 41*c* according to the sensed room temperature, thereby performing first mode cooling operation.

In the second mode, the air conditioner 1 may perform cooling through the outlet hole 50 in such a way to close the first to third outlets 41*a* to 41*c* and discharge heat-exchanged air through the outlet hole 50, when room temperature reaches a desired temperature set in advance by a user, thereby maintaining indoor space at a pleasant temperature at low velocity.

That is, air heat-exchanged by the heat exchanger 20 may be discharged by the blower fan 32 to the outside of the air conditioner 1, through the at least one outlet 41 and the at least one outlet hole 50.

In the first mode, heat-exchanged air may be discharged through the outlet 41. However, a part of the heat-exchanged air may be discharged through the outlet hole 50. That is, in the first mode, a major portion of heat-exchanged air may be discharged through the outlet 41. Also, in the second mode, a major portion of heat-exchanged air may be discharged through the outlet hole 50.

Air passed through the blower unit 30 may be discharged to the outside of the housing 10 through the outlet 41.

When the air conditioner 1 is in the first mode, heat-exchanged air may be discharged to the outside of the housing 10 through the outlet 41. The outlet 41 may directly discharge the heat-exchanged air to the outside. The outlet 41 may be exposed to the outside of the housing 10. The outlet 41 may be positioned on a direction in which the blower fan 32 blows air, to directly discharge heat-exchanged air to the outside. Air blown by the blower fan 32 may flow through a first discharge path 41*d* (see FIG. 4) formed between the blower fan 32 and the outlet 41. The first discharge path 41*d* may be formed by a discharge guide element 45.

The outlet 41 may be formed by an opening guide 43. The opening guide 43 may be exposed to the outside through the opening 17 of the housing 10. A door unit 60 which will be described later may move to be rested on the opening guide 43. The opening guide 43 may be positioned around the opening 17 of the housing 10 to form the outlet 41 along the inner circumference.

The outlet 41 may include the first outlet 41*a*, the second outlet 41*b*, and the third outlet 41*c* each including the door operating element 66. That is, the first outlet 41*a* may include a first door operating element 66*a*, the second outlet 41*b* may include a second door operating element 66*b*, and the third outlet 41*c* may include a third door operating element 66*c*.

The outlet 41 may be opened or closed by the door unit 60.

The door unit 60 may open or close the outlet 41 so that heat-exchanged air can be discharged to the outside of the housing 10 selectively through the outlet 41.

The door unit 60 may move between a door opening position 60*a* at which the outlet 41 opens and a door closing position 60*b* at which the outlet 41 closes. The door unit 60 may move in the front-back direction between the door opening position 60*a* and the door closing position 60*b*.

More specifically, the door unit 60 may include a door blade 62, and the door operating element 66 for operating the door blade 62.

The door blade 62 may be in the shape of a circle to correspond to the shape of the outlet 41. When the door unit 60 is at the door opening position 60*a*, the door blade 62 may be spaced from the opening guide 43, and when the door unit 60 is at the door closing position 60*b*, the door blade 62 may contact the opening guide 43 to close the outlet 41.

The door blade 62 may include a blade body 63 being in the shape of a circle to correspond to the outlet 41, and a blade coupling element 64 extending from the blade body 63 and coupled with the door operating element 66.

The blade body 63 may be in the shape of a nearly circular plate. Also, one surface of the blade body 63 may face the outside of the housing 10, and the other surface of the blade body 63 may face the blower unit 30.

On one surface of the blade body 63, a display may be provided to display the operating state of the air conditioner 1 or to allow a user to manipulate the air conditioner 1.

The door operating element 66 may move the door blade 62. The door operating element 66 may include a motor (not shown). The door operating element 66 may be coupled with the blade coupling element 64 of the door blade 62 to move the door blade 62.

The blower grill 34 may be disposed around the door operating element 66. Air blown from the blower fan 32 disposed behind the blower grill 34 may pass through the blower grill 34 to be discharged in a front direction.

When the air conditioner 1 is in the second mode, heat-exchanged air may be discharged to the outside of the housing 10 through the outlet hole 50. Through this configuration, the heat-exchanged air may be discharged at low wind velocity to the outside. In the discharge plate 14, a plurality of discharge holes 50 may be formed.

When heat-exchanged air is discharged to the outside through the outlet hole 50, air blown by the blower fan 32 may flow through a second discharge path 50*a* formed between the blower fan 32 and the outlet hole 50. The second discharge path 50*a* may be formed by the discharge guide element 45 and a discharge panel which will be described later.

The discharge panel may include a path forming frame 13 and the discharge plate 14.

The discharge panel may be provided to form the second discharge path 50*a*. Heat-exchanged air may be discharged to the outside of the air conditioner 1, at low velocity, through the second discharge path 50*a* formed by the discharge panel, and the discharge plate 14 which will be described later.

The flow forming frame 13 may partition the second discharge path 50*a* in the inside of the housing 10. The flow forming frame 13 may prevent heat-exchanged air from again entering the inside of the housing 10. According to an embodiment, the flow forming frame 13 may extend from the blower grill 34, and connect to an external panel (not shown).

In the discharge plate 14, the outlet hole 50 may be formed. The shape of the outlet hole 50 is not limited, however, in the current embodiment of the present disclosure, a plurality of outlet holes 50 may be provided. The outlet hole 50 may penetrate the discharge plate 14.

The outlet hole 50 may include a discharge area. In the discharge area, a plurality of outlet holes 50 may be distributed uniformly or non-uniformly. According to an embodiment, in the discharge area, the plurality of outlet holes 50 may be distributed uniformly.

The discharge area may be formed in at least one part of the discharge plate 14. However, the discharge area may be formed in the entire of the discharge plate 14.

The outlet 41 may include the first discharge path 41*d* and the second discharge path 50*a*.

Air blown by the blower fan 32 may flow through at least one of the first discharge path 41*d* and the second discharge path 50*a*.

In the first mode, air blown by the blower fan 32 may flow through the first discharge path 41*d* formed between the blower fan 32 and the outlet 41. Also, in the second mode, air blown by the blower fan 32 may flow through the second discharge path 50*a* formed between the blower fan 32 and the outlet hole 50.

The outlet 41 may include the discharge guide element 45. Air blown by the blower fan 32 may be controlled by the discharge guide element 45. The discharge guide element 45 may be disposed in front of the blower unit 30 so that air blown from the blower unit 30 can flow through at least one of the first discharge path 41*d* and the second discharge path 50*a*.

The discharge guide element 45 may include a guide body 46 and a guide groove 47.

The guide body 46 may form the first discharge path 41*d* thereinside. The guide body 46 may be in the shape of a cylinder having a hollow interior. More specifically, the guide body 46 may be in the shape of a pipe whose one end faces the blower unit 30 and whose other end faces the outlet 41.

The guide groove 47 may pass the second discharge path 50*a* therethrough. The guide groove 47 may be formed in the guide body 46. The shape of the guide groove 47 may be not limited, and the guide groove 47 may have any structure that can be formed in the guide body 46 and enable air to flow in the outside direction of the guide body 46. In the current embodiment, the guide groove 47 may be a plurality of holes formed along the circumference of the guide body 46.

In the first mode, the door unit 60 may open the outlet 41. In this case, air blown from the blower unit 30 may pass through the first discharge path 41*d* formed in the inside of the guide body 46 and then be discharged to the outlet 41.

In the second mode, the door unit 60 may close the outlet 41. In this case, one end of the guide body 46 may be blocked by the door unit 60 so that air blown from the blower unit 30 may pass through the guide groove 47 formed in the guide body 46 and then be discharged to the outlet hole 50.

Hereinafter, operations of the air conditioner 1 according to an embodiment of the present disclosure will be described.

Air drawn into the housing 10 from the outside may be heat-exchanged by the heat exchanger 20. The air conditioned by the heat exchanger 20 may be discharged to the outside of the housing 10 by the blower unit 30.

The air conditioner 1 may discharge air passed through the heat exchanger 20 to the outside through at least one of the outlet 41 and the outlet hole 50. That is, in the first mode, the air conditioner 1 may discharge the air through the outlet 41 to perform concentrated air-conditioning, and in the second mode, the air conditioner 1 may discharge the air through the outlet hole 50 to perform air-conditioning slowly throughout the indoor space.

The outlet 41 may operate the door unit 60 to open or close the door unit 60. If the outlet 41 opens, heat-exchanged air may be discharged through the outlet 41, and if the outlet 41 closes, heat-exchanged air may be discharged through the outlet hole 50.

The first mode will be described in detail, as follows. In the first mode, heat-exchanged air may be discharged through the outlet 41. In the first mode, the door unit 60 may be at the door opening position 60*a*, and the door blade 62 may be spaced from the opening guide 43 to open the outlet 41.

In this case, air blown from the blower unit 30 may flow to the outlet 41 through the first discharge path 41*d* formed by the guide body 46.

When the air is discharged to the outside of the housing 10 through the outlet 41, the air may be discharged at wind velocity applied by the blower unit 30.

Then, the second mode will be described. In the second mode, air heat-exchanged by the outlet hole 50 may be discharged. In the second mode, the door unit 60 may be at the door closing position 60*b*, and the door blade 62 may contact the opening guide 43 so that the outlet 41 may be closed.

In this case, air flowing from the blower unit 30 may pass through the guide groove 47 formed in the guide body 46 because the outlet 41 is blocked by the door blade 62. Thereby, air blown from the blower unit 30 may pass through the second discharge path 50*a* to flow to the outlet hole 50.

When air is discharged to the outside of the housing 10 through the outlet hole 50, the wind velocity of the air may be reduced while the air passes through the plurality of outlet holes 50 of the outlet plate 14 so that the air is discharged to the outside at low velocity.

Through the configuration, the air conditioner 1 can cool or heat indoor space at wind velocity at which the user can feel pleasant.

Figure 7:
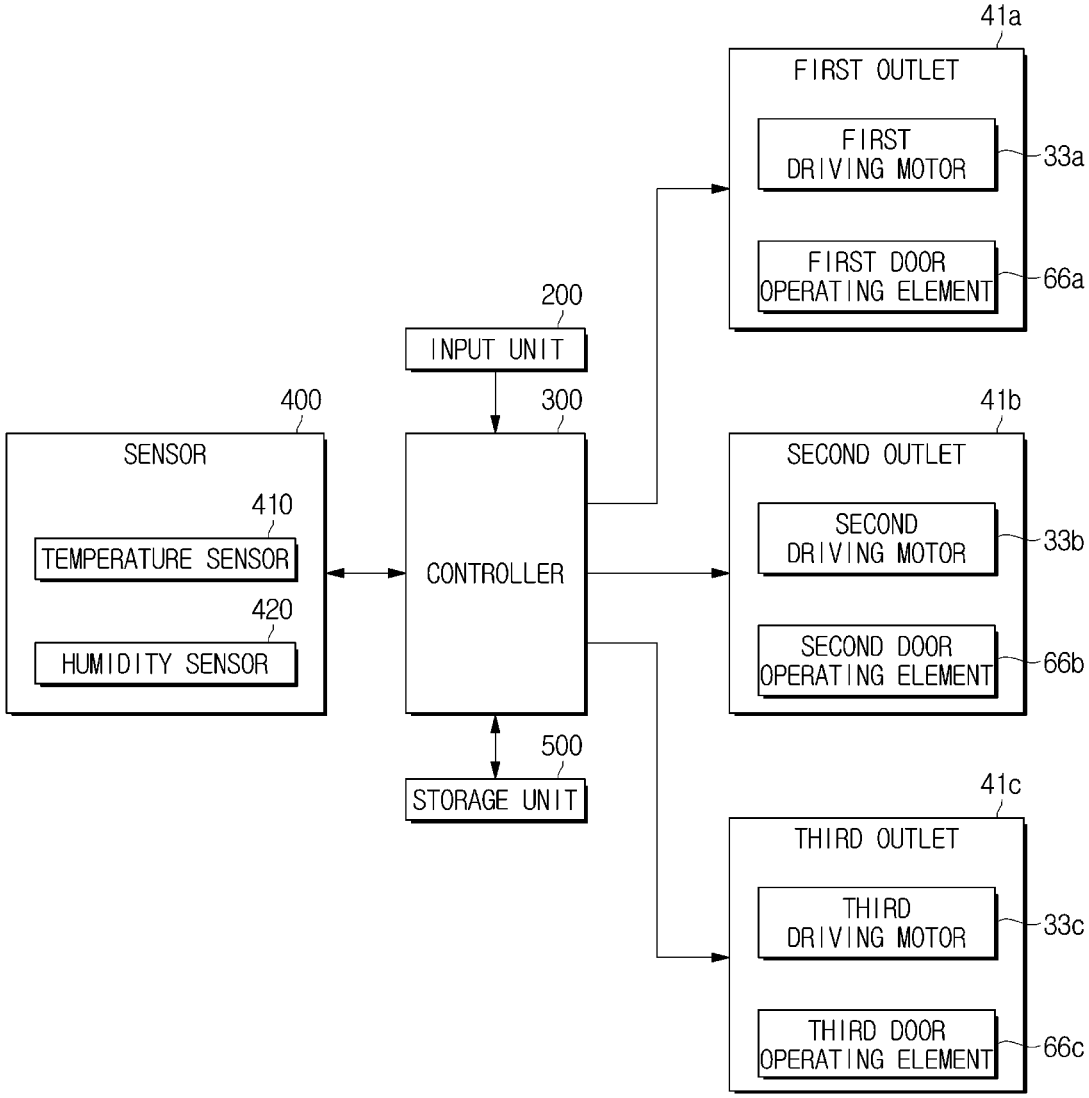
FIG. 7 is a control block diagram of an air conditioner according to an embodiment of the present disclosure.

FIG. 7 is a control block diagram of an air conditioner according to an embodiment of the present disclosure.

As shown in FIG. 7, the air conditioner 1 according to an embodiment of the present disclosure may include: an input unit 200 configured to receive a control command related to driving of the air conditioner 1 or data required for driving of the air conditioner 1 from a user; a controller 300 configured to control driving of the air conditioner 1; a sensor 400 configured to detect the temperature or humidity of indoor space where the air conditioner 1 is located; a storage unit 500 configured to store programs and data related to driving of the air conditioner 1; and the first to third outlets 41*a* to 41*c* configured to discharge heat-exchanged air to the outside of the air conditioner 1.

The input unit 200 may include a button type switch, a membrane switch, or a touch panel for receiving operation commands for the air conditioner 1. If a remote controller (not shown) for receiving operations and driving commands for the air conditioner 1, and displaying operation information of the air conditioner 1 is provided, the input unit 200 of the air conditioner 1 may include only a power button (not shown) for supplying power to the air conditioner 1.

The input unit 200 may be a component to enable a user to set an operation mode (for example, a wind-velocity/wind-volume mode, such as "Strong", "Normal", "Weak", and "Turbo", an automatic/manual mode, and a function mode, such as a cooling mode, a dehumidification mode, a blowing mode, a heating mode, a comfort mode, etc.), to start or stop driving, or to set desired temperature, the direction of wind, etc. The input unit 200 may include a plurality of keys of the front panel 10*a* or a remote controller, included in the air conditioner 1, to enable the user to input data. Also, the input unit 200 may receive information related to at least one of room temperature and humidity of space where the air conditioner 1 is located, from the user. That is, the user may set desired temperature for room temperature of space where the air conditioner 1 is located, and may set desired humidity for room humidity of the space, through the input unit 200. If room temperature or room humidity sensed by the air conditioner 1 changes, the user may set a new desired temperature or a new desired humidity through the input unit 200. Also, the input unit 200 may receive data (for example, an operation period, an operation type, an operation time, etc.) related to cooling operation through the first to third outlets 41*a* to 41*c* and cooling operation through the outlet hole 50.

The controller 300 may be electrically connected to the input unit 200, the sensor 400, and the storage unit 500 to transmit and receive commands and data related to overall operations of the air conditioner 1. The output terminal of the controller 300 may be electrically connected to the first outlet 41*a*, the second outlet 41*b*, and the third outlet 41*c* to discharge heat-exchanged air to the outside of the air conditioner 1. That is, the controller 300 may control a first driving motor 33*a*, a second driving motor 33*b*, and a third driving motor 33*c* respectively included in the first outlet 41*a*, the second outlet 41*b*, and the third outlet 41*c* to thus control on/off operations and rotation velocities of a first blower fan 32*a*, a second blower fan 32*b*, and a third blower fan 32*c*. The controller 300 may transfer control commands to the first driving motor 33*a*, the second driving motor 33*b*, and the third driving motor 33*c* to control on/off operations and rotation velocities of the first blower fan 32*a*, the second blower fan 32*b*, and the third blower fan 32*c* in correspondence to an operation mode selected by a user.

Also, the controller 300 may control the first door operating element 66*a*, the second door operating element 66*b*, and the third door operating element 66*c* respectively included in the first outlet 41*a*, the second outlet 41*b*, and the third outlet 41*c* to control a first door blade, a second door blade, and a third door blade configured to open or close the first outlet 41*a*, the second outlet 41*b*, and the third outlet 41*c*, respectively.

The controller 300 may compare room temperature sensed by a temperature sensor 410 of the sensor 400 to a desired temperature input by a user and stored, and compare room humidity sensed by a humidity sensor 420 to a desired humidity input by the user and stored, thus determining whether to open or close the individual first to third outlets 41*a* to 41*c*.

Also, the controller 300 may control RPM of the blower fan 32 based on current room temperature or humidity sensed by the sensor 400. At this time, the controller 300 may control RPM of the blower fan 32 by reflecting information about a wind-velocity mode or a wind-volume mode input by the user, in addition to the current room temperature or humidity.

If the controller 300 determines that currently sensed room temperature or humidity is equal to or lower than a desired temperature or desired humidity input by the user, the controller 300 may reduce RPM of the blower fan 32 to control the blower fan 32 at low velocity. As described above, when the controller 300 controls RPM of the blower fan 32, the controller 300 can further reflect a current wind-velocity mode or a current wind-volume mode in addition to currently sensed room temperature or humidity. In this case, criterion for RPM of the blower fan 32 may be criterion of RPM of the blower fan 32 matching with a current wind-velocity mode and current room temperature and stored. The controller 300 may extract RPM of the blower fan 32 matching with currently sensed room temperature and a current wind-velocity mode, and transfer a control signal to the driving motor 33. For example, if the current wind-velocity mode is a breeze mode corresponding to lowest RPM, the controller 300 may transfer a control signal for reducing the RPM of the blower fan 32 to velocity that is lower than current RPM to control the blower fan 32 at low velocity, to the driving motor 33. Herein, the breeze mode means a wind-velocity mode corresponding to the lowest RPM of the blower fan 32 among wind-velocity modes that the user can set. If room temperature or room humidity sensed by the sensor 400 is equal to or lower than desired temperature or desired humidity, the controller 300 may change the RPM of the blower fan 32 to velocity that is lower than the lowest RPM. The controller 300 may include a single general-purpose processor to perform all calculations related to operations of the air conditioner 1, or a processor to perform specific calculations, such as a communication processor to perform only calculations related to communication and a control processor to perform only calculations related to control operations.

The sensor 400 may include the temperature sensor 410 to sense room temperature of space where the air conditioner 1 is located, and the humidity sensor 420 to sense room humidity of the space.

The temperature sensor 410 may sense temperature of indoor space where the air conditioner 1 is located, and output an electrical signal corresponding to the sensed temperature. Also, the temperature sensor 410 may further include an intake temperature sensor to sense the temperature of room air drawn into the inside of the air conditioner 1, or a discharge temperature sensor to sense the temperature of air discharged from the air conditioner 1, although not limited to these. That is, the temperature sensor 410 may be added at any location where room temperature can be sensed. The temperature sensor 410 may include a thermistor whose electrical resistance changes according to temperature.

The humidity sensor 420 may sense humidity of indoor space where the air conditioner 1 is located, and output an electrical signal corresponding to the sensed humidity. The humidity sensor 420 may be added at any location of the air conditioner 1 where room humidity can be sensed.

The storage unit 500, which is a component to store various kinds of data related to operations and control of the air conditioner 1, may store various kinds of setting data about an operation mode (for example, a wind-velocity/wind-volume mode, such as "Strong", "Normal", "Weak", and "Turbo", an automatic/manual mode, and a function mode, such as a cooling mode, a dehumidification mode, a blowing mode, a heating mode, and a comfort mode) requested by a user, starting or stopping operation, desired temperature, the direction of wind, etc. Also, the storage unit 500 may store information about at least one of desired temperature and desired humidity of indoor space where the air conditioner 1 is located, input by the user. The storage unit 500 may include a non-volatile memory (for example, a magnetic disk and a semiconductor disk) for permanently storing programs and data related to operations of the air conditioner 1, and a volatile memory (for example, Dynamic Random Access Memory (DRAM) and Static Random Access Memory (SRAM)) (not shown) for temporarily storing temporary data created when the air conditioner 1 operates.

Figure 8:
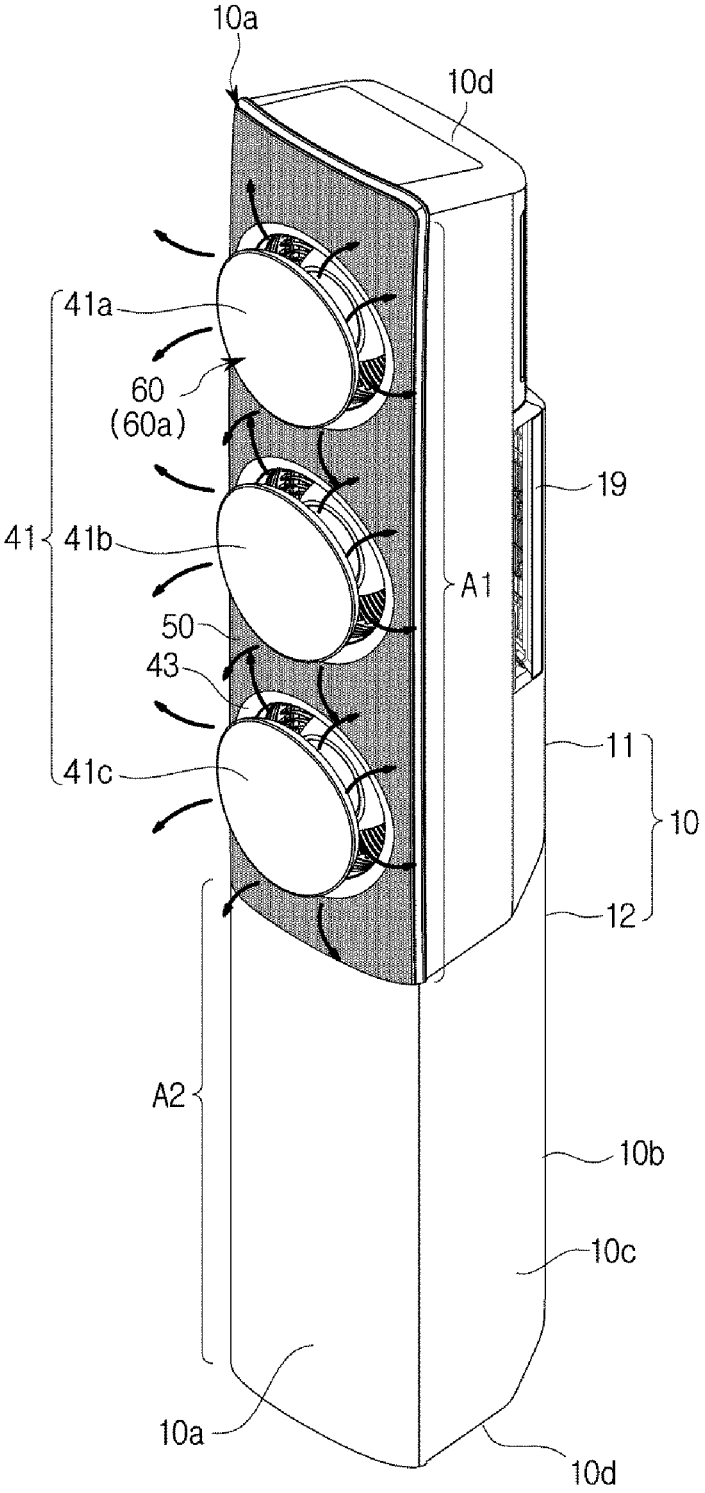
FIG. 8 is a conceptual view for describing a cooling process in which heat-exchanged air is discharged though an outlet, according to an embodiment of the present disclosure.
Figure 9A:
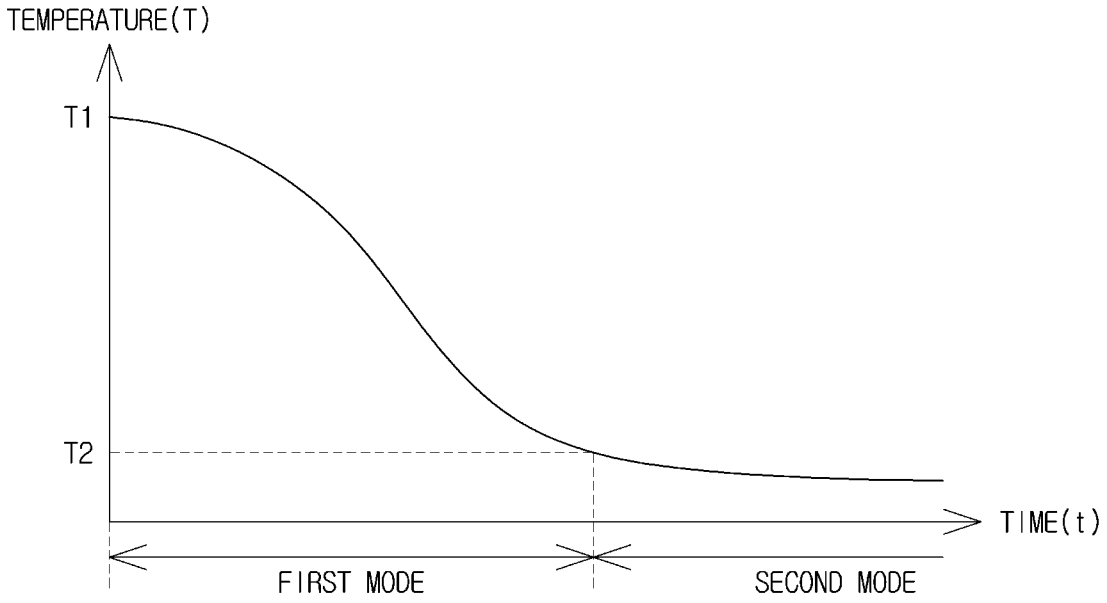
FIG. 9A is a graph showing changes in room temperature according to a control method of an air conditioner according to an embodiment of the present disclosure.
Figure 9B:
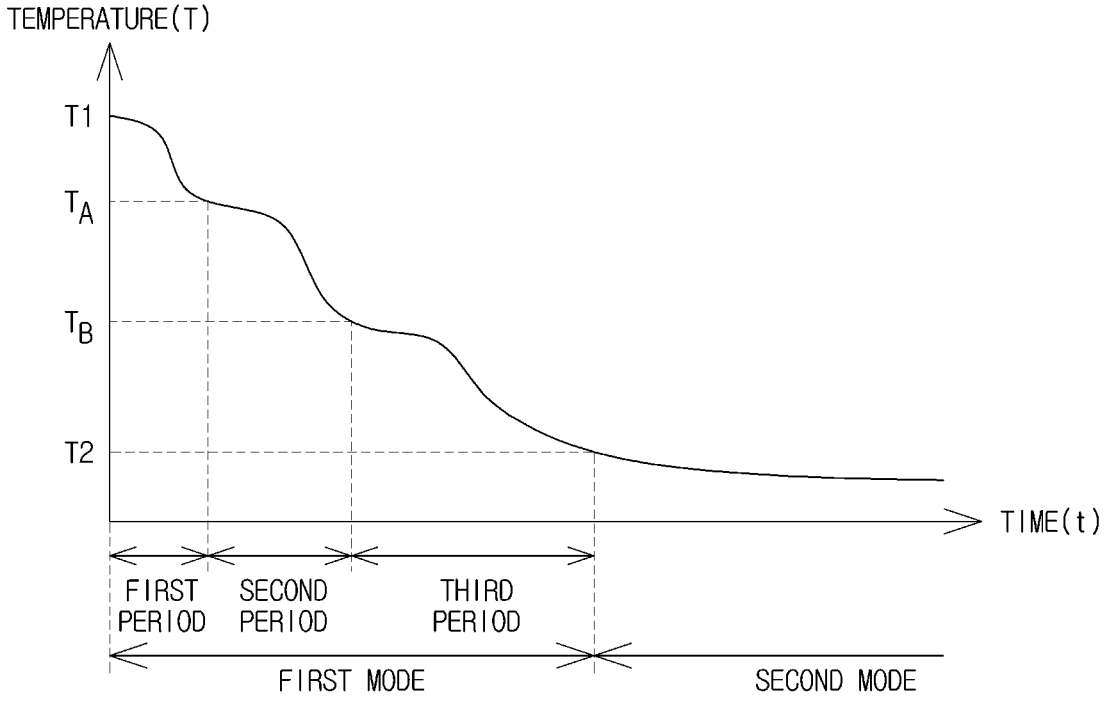
FIG. 9B is a graph showing changes in room temperature for each period according to a control method of an air conditioner according to an embodiment of the present disclosure.
Figure 10:
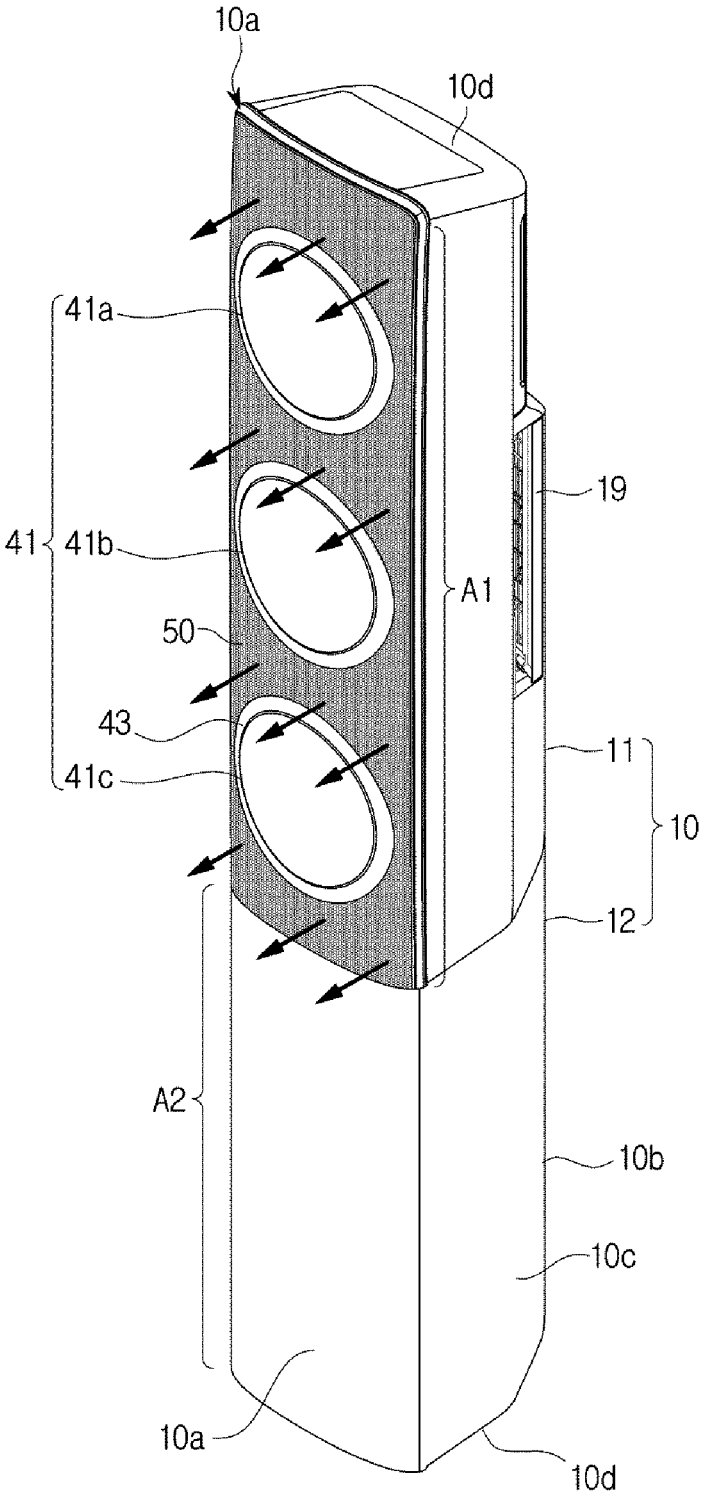
FIG. 10 is a conceptual view for describing a cooling process in which heat-exchanged air is discharged through an outlet hole when an outlet closes, according to an embodiment of the present disclosure.

FIG. 8 is a conceptual view for describing a cooling process in which heat-exchanged air is discharged though an outlet, according to an embodiment of the present disclosure. FIG. 9A is a graph showing changes in room temperature according to a control method of an air conditioner according to an embodiment of the present disclosure, and FIG. 9B is a graph showing changes in room temperature for each period according to a control method of an air conditioner according to an embodiment of the present disclosure. FIG. 10 is a conceptual view for describing a cooling process in which heat-exchanged air is discharged through an outlet hole when an outlet closes, according to an embodiment of the present disclosure.

Hereinafter, in the air conditioner 1 and the control method thereof according to embodiments of the present disclosure, operation modes of the air conditioner 1 will be defined as a first mode and a second mode. Also, for convenience of description, the embodiments of the present disclosure will be described in regard of room temperature. However, the cooling operation of the present disclosure can be performed based on room humidity. Furthermore, the embodiments which will be described below can be performed automatically, under the control of the controller 300, based on setting values that a user can set and manipulate manually through the input unit 200 and that the user has set in advance in regard of the operation environment of the air conditioner 1, and data stored in the storage unit 500.

In the first mode, the air conditioner 1 may perform cooling through the at least one outlet 41 so that heat-exchanged air can be discharged to the outside of the air conditioner 1 through the first to third outlets 41*a* to 41*c* that open. At this time, the controller 300 may selectively open the first to third outlets 41*a* to 41*c* according to room temperature sensed by the sensor 400 to perform first mode cooling operation.

In the second mode, the air conditioner 1 may perform cooling through the outlet hole 50. If room temperature reaches desired temperature set in advance by a user, the first to third outlets 41*a* to 41*c* may be closed to discharge heat-exchanged air through the outlet hole 50, thereby maintaining indoor space at pleasant temperature through low-velocity operation.

Referring to FIG. 9A, room temperature can change as shown in the graph. If desired room temperature or pleasant temperature set by a user is $T_2$ and current room temperature sensed by the temperature sensor 410 is $T_1$, the air conditioner 1 may perform first mode operation of performing cooling so that the sensed current room temperature approximates the desired room temperature. That is, by opening the outlet 41 to discharge heat-exchanged air to the outside in order to lower the room temperature that is higher than the desired temperature, first mode cooling operation can be performed.

When the first mode operation as shown in FIG. 9A is performed, the controller 300 may control the first to third door operating elements 66*a* to 66*c* respectively included in the first to third outlets 41*a* to 41*c* to open the first to third outlets 41*a* to 41*c*, or the controller 300 may control the first to third driving motors 33*a* to 33*c* to control RPM of the blower fan 32.

In the first mode operation, cooling operation may be performed through the first to third outlets 41*a* to 41*c*, as shown in FIG. 8, and at this time, a part of heat-exchanged air may be discharged through the outlet hole 50.

If room temperature sensed by the temperature sensor 410 reaches the desired temperature $T_2$ set by the user by the first mode cooling operation, the air conditioner 1 may perform second mode cooling operation. If the first mode cooling operation continues to be performed even when the room temperature reaches the desired temperature $T_2$ set by the user, the user may feel cold. In this case, although the velocity of air that is discharged through the first to third outlets 41*a* to 41*c* is reduced, the reduction in velocity may be limited so that wind cooled in the first mode may continue to arrive at the user.

Accordingly, the controller 300 may close, as shown in FIG. 10, the outlet 41 of the air conditioner 1 through the door operating element 66 in order to perform the second mode cooling operation, and discharge heat-exchanged air through the outlet hole 50, thereby maintaining room temperature at or near the desired temperature $T_2$. The controller 300 may control the driving motor 33 to control velocity of the blower fan 32, and adjust the wind velocity of air that is discharged through the discharge hole 50 to approximately 0.15 m/s so that the user can little feel the wind velocity.

When air is discharged through the outlet 41, not through the outlet hole 50, it is difficult to implement low wind velocity which a human cannot feel, no matter how greatly the wind velocity of the blower fan 32 is reduced. However, because the outlet hole 50 is configured with a plurality of small holes to widen an area through which air is discharged, the velocity of air discharged through the outlet hole 50 is significantly lower than the velocity of air discharged through the outlet 41 so that a user can little feel wind velocity.

If room temperature sensed by the temperature sensor 410 exceeds the desired temperature $T_2$ when the second mode cooling operation maintained at or near the desired temperature $T_2$ is performed, the controller 300 may control the driving motor 33 to increase velocity of the blower fan 32 and to increase the volume of wind. Also, the controller 300 may open the first to third outlets 41*a* to 41*c* to perform the first mode cooling operation so that current room temperature again can arrive at the desired temperature $T_2$.

The first mode cooling operation or the second mode cooling operation as described above may be performed by the user's manual manipulation, and wind velocity or wind volume may be set in advance for each of the first mode cooling operation and the second mode cooling operation. Also, the controller 300 may make a setting to prevent the first mode cooling operation from being performed although room temperature exceeds the desired temperature $T_2$ while the user sleeps.

Referring to FIG. 9B, when the first mode cooling operation is performed in order to lower the initially sensed room temperature $T_1$ to the desired temperature $T_2$, the controller 300 may close the first to third outlets 41*a* to 41*c* sequentially to perform cooling operation.

As shown in FIG. 9B, in order to lower the initially sensed room temperature $T_1$ to temperature $T_A$ for a first period, the controller 300 may open all of the first to third outlets 41*a* to 41*c* to perform the first mode cooling operation. That is, when room temperature $T_X$ sensed in real time by the temperature sensor 410 is within a range of $T_A \leq T_X \leq T_1$, it is necessary to quickly lower the room temperature $T_X$, and accordingly, the controller 300 may open all of the first to third outlets 41*a* to 41*c* to perform the first mode cooling operation.

In order to lower room temperature $T_X$ sensed by the temperature sensor 410 from the temperature $T_A$ to temperature $T_B$ for a second period, the controller 300 may close one of the first to third outlets 41*a* to 41*c* to perform the first mode cooling operation through the remaining two open outlets 41. The closed outlet 41 may be any one of the first to third outlets 41*a* to 41*c*. That is, if room temperature $T_X$ sensed in real time by the temperature sensor 410 is within a range of $T_B \leq T_X \leq T_A$, lower cooling performance than in the first period may be required so that the controller 300 may close one of the three outlets 41 to perform the first mode cooling operation using the remaining two outlets 41.

In order to lower room temperature $T_X$ sensed by the temperature sensor 410 from the temperature $T_B$ to temperature $T_2$ for a third period, the controller 300 may close two of the first to third outlets 41*a* to 41*c* to perform the first mode cooling operation through the remaining one open outlet 41. That is, if room temperature $T_X$ sensed in real time by the temperature sensor 410 is within a range of $T_2 \leq T_X \leq T_B$, lower cooling performance than in the first period and the second period may be required so that the controller 300 may close two of the three outlets 41 to perform the first mode cooling operation using the remaining one outlet 41.

Also, if room temperature $T_X$ sensed by the temperature sensor 410 reaches the desired temperature $T_2$, the controller 300 may close all of the first to third outlets 41*a* to 41*c* to perform the second mode cooling operation at low velocity through the outlet hole 50, as described above with reference to FIG. 9A.

The above description with reference to FIGS. 8 to 10 relates to a method of controlling the air conditioner 1 based on room temperature, however, the method of controlling the air conditioner 1, as described above with reference to FIGS. 8 to 10, can be applied to an embodiment of a method of controlling the air conditioner 1 based on room humidity. That is, the controller 300 may control the first to third outlets 41*a* to 41*c* such that current room humidity sensed by the humidity sensor 420 shown in FIG. 7 reaches desired humidity input by a user. If current room humidity sensed by the humidity sensor 420 is higher than desired humidity, the air conditioner 1 may open the outlet 41 to perform the first mode cooling operation, and if the current room humidity is equal to or lower than the desired humidity, the air conditioner 1 may close the outlet 41 to perform the second mode cooling operation at low velocity through the outlet hole 50, thereby maintaining pleasant room humidity desired by the user.

Figure 11:
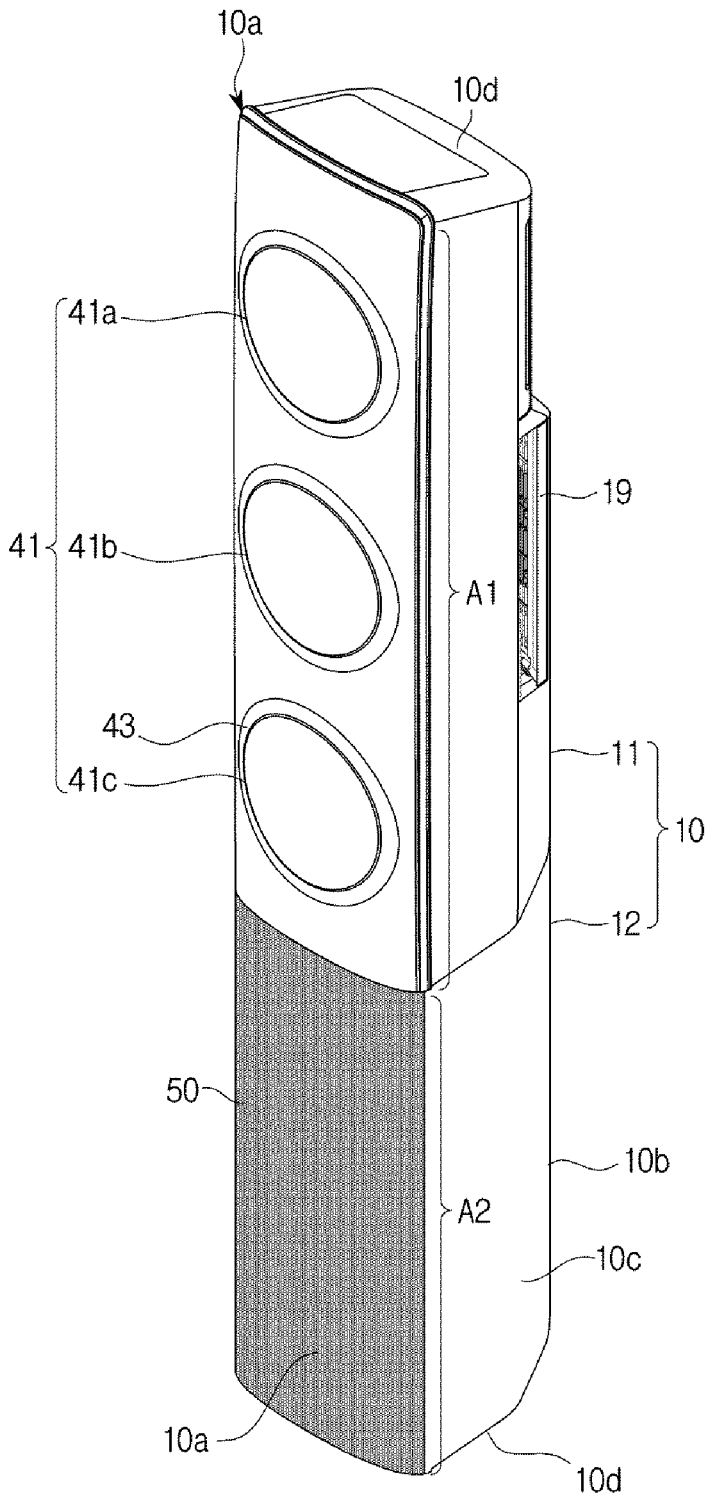
FIG. 11 shows an outlet hole formed in a second area of a front panel, according to an embodiment of the present disclosure.

FIG. 11 shows an outlet hole formed in a second area of a front panel, according to an embodiment of the present disclosure.

The outlet hole 50 shown in FIG. 1 is formed in a first area A1 of the front panel 10*a* in which the opening 17 of the air conditioner 1 is located, however, the outlet hole 50 shown in FIG. 11 is formed in a second area A2 of the front panel 10*a* except for the first area A1.

The first area A1 may correspond to an area of the front panel 10*a* where the outlet 41 is disposed. If the outlet 41 is formed in the first area A1, air discharged from the blower fan 32 may be discharged through the outlet hole 50 when the outlet 41 closes. However, because the second area A2 is located below the area where the outlet 41 is disposed, air discharged from the blower fan 32 may move to the second area A2 corresponding to the lower portion of the front panel 10*a* and then be discharged through the outlet hole 50 formed in the second area A2 when the outlet 41 closes. Accordingly, a separate flow path may be provided to move air discharged from the blower fan 32 to the second area A2 corresponding to the lower portion of the front panel 10*a*.

If the outlet hole 50 is formed in the first area A1, both the outlet 41 and the outlet hole 50 may be disposed in the first area A1 so that air discharged from the blower fan 32 can be discharged through both the outlet 41 and the outlet hole 50, when the air conditioner 1 performs the first mode cooling operation.

However, if the outlet hole 50 is formed in the second area A2, the major portion of air discharged from the blower fan 32 does not move to the outlet hole 50 formed in the second area A2 when the air conditioner 1 performs the first mode cooling operation, because the first to third outlets 41*a* to 41*c* open. That is, when the air conditioner 1 performs the first mode cooling operation, the major portion of air discharged from the blower fan 32 may be discharged through the outlet 41 that opens, and when the air conditioner 1 performs the second mode cooling operation, air discharged from the blower fan 32 may be discharged through the outlet hole 50 formed in the second area A2 because the first to third outlets 41*a* to 41*c* close. As such, if the outlet hole 50 is formed in the second area A2, air discharged from the blower fan 32 may pass through different components according to the first mode cooling operation and the second mode cooling operation.

Also, although not shown in the drawings, the outlet hole 50 according to an embodiment of the present disclosure may be formed in the lateral sides of the housing 10 not in the front panel 10*a*. Also, the outlet hole 50 may be formed at an arbitrary location at which heat-exchanged air can be discharged when the outlet 41 closes.

Figure 12:
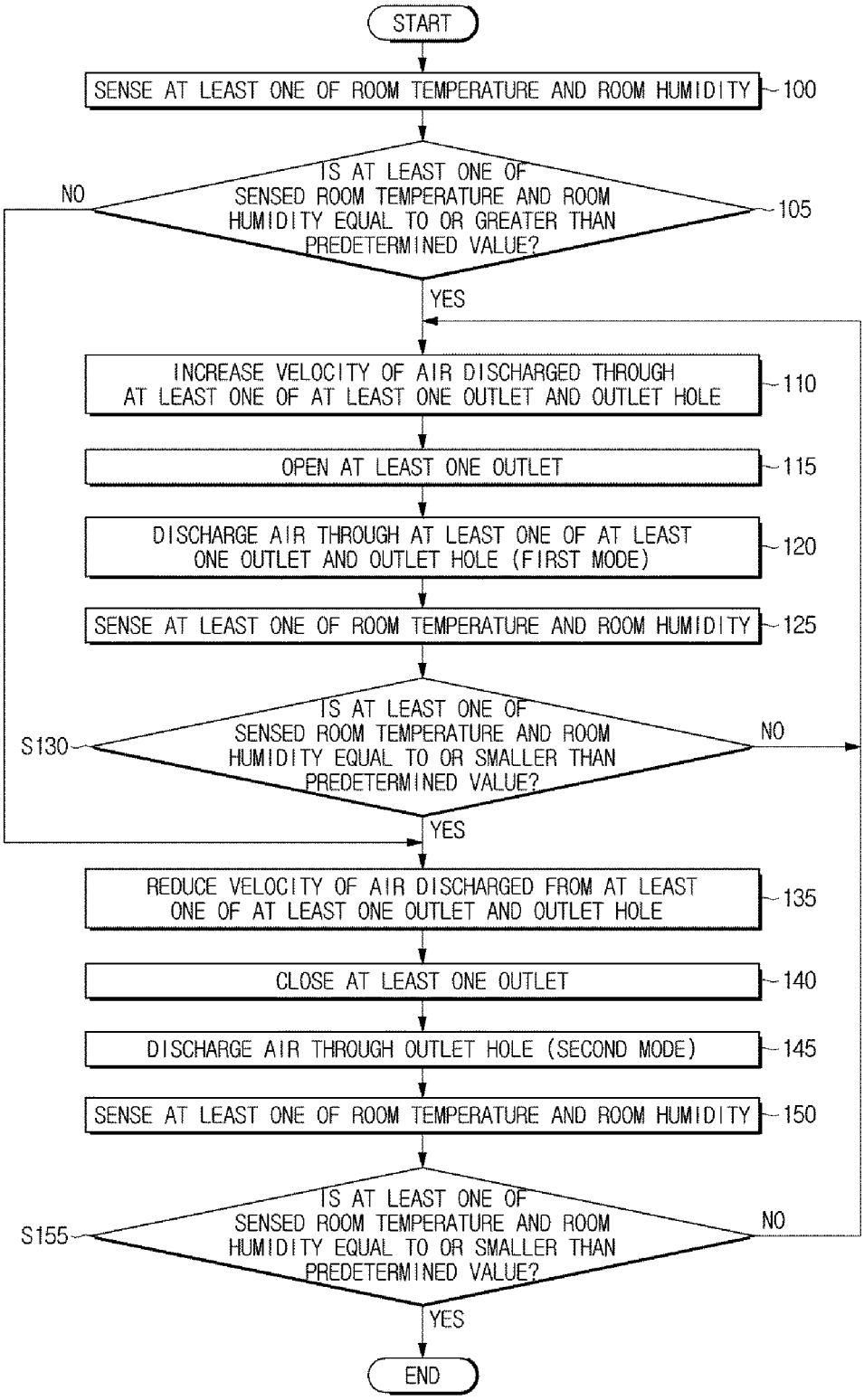
FIG. 12 is a flowchart illustrating a method of controlling an air conditioner, according to an embodiment of the present disclosure.

FIG. 12 is a flowchart illustrating a method of controlling an air conditioner, according to an embodiment of the present disclosure.

Referring to FIGS. 7 and 12, the sensor 400 may sense at least one of room temperature and room humidity, in operation 100. More specifically, the temperature sensor 410 may sense room temperature of indoor space where the air conditioner 1 is located, and the humidity sensor 420 may sense room humidity of the indoor space where the air conditioner 1 is located. A user may make a setting to cause the air conditioner 1 to sense only room temperature, to compare the room temperature to desired temperature, and then to perform the first mode cooling operation and the second mode cooling operation, or the user may make a setting to cause the air conditioner 1 to sense only room humidity, to compare the room humidity to desired humidity, and then to perform the first mode cooling operation and the second mode cooling operation. Also, the user may make a setting to cause the air conditioner 1 to sense both room temperature and room humidity and to perform the first mode cooling operation and the second mode cooling operation according to the room temperature and the room humidity.

The controller 300 may determine whether at least one of the room temperature and the room humidity sensed by the sensor 400 is equal to or greater than a predetermined value, in operation 105. Herein, the predetermined value is desired room temperature or desired room humidity set by the user. The controller 300 may compare the room temperature or the room humidity sensed by the sensor 400 to desired temperature or desired humidity stored in the storage unit 500. If the controller 300 determines that the room temperature or the room humidity is higher than the desired temperature or the desired humidity, the controller 300 may perform the first mode cooling operation of discharging heat-exchanged air through the outlet 41.

In contrast, if the controller 300 determines that the room temperature or the room humidity is lower than the desired temperature or the desired humidity, this means that the current room temperature or the current room humidity reaches the desired temperature or the desired humidity set by the user, and accordingly, the controller 300 may control the individual components of the air conditioner 1 to reduce RPM of the blower fan 32, to close the outlet 41, and to discharge heat-exchanged air through the outlet hole 50, thereby performing the second mode cooling operation.

If the controller 300 determines that the room temperature or the room humidity is higher than the desired temperature or the desired humidity, the controller 300 may control the driving motor 33 to increase RPM of the blower fan 32 in order to perform the first mode cooling operation, and accordingly, the velocity of air discharged through at least one of the first to third outlets 41*a* to 41*c* and the outlet hole 50 may increase, in operation 110.

The controller 130 may control the door operating element 66 to open the first to third outlets 41*a* to 41*c*, in operation 115, and discharge heat-exchanged air through the first to third outlets 41*a* to 41*c*, thereby performing the first mode cooling operation, in operation 120. At this time, air may also be discharged through the outlet hole 50, as well as the first to third outlets 41*a* to 41*c*.

If the first mode cooling operation is performed, as described above with reference to FIG. 9A, room temperature may be lowered, and the sensor 400 may sense at least one of room temperature and room humidity, in operation 125.

The controller 300 may compare the sensed room temperature or the sensed room humidity to desired temperature or desired humidity set in advance by a user and stored in the storage unit 500, and determine whether the sensed room temperature or the sensed room humidity is lower than the desired temperature or the desired humidity, in operation 130.

If the controller 300 determines that the sensed room temperature or the sensed room humidity is higher than the desired temperature or the desired humidity, this means that the room temperature or the room humidity does not yet reach the desired temperature or the desired humidity, and accordingly, the controller 300 may continue to perform the first mode cooling operation. As described above with reference to FIG. 9B, if at least one of the first to third outlets 41*a* to 41*c* closes during the first mode cooling operation, the controller 300 may again open the closed outlet 41, and increase RPM of the blower fan 32 to thus perform the first mode cooling operation.

If the controller 300 determines that the sensed room temperature or the sensed room humidity is equal to or lower than the desired temperature or the desired humidity, this means that the room temperature or the room humidity reaches the desired temperature or the desired humidity set by the user. Accordingly, the controller 300 may control the individual components of the air conditioner 1 to reduce the RPM of the blower fan 32, to close the outlet 41, and to discharge heat-exchanged air through the outlet hole 50, thereby performing the second mode cooling operation.

That is, the controller 300 may control the driving motor 33 to reduce the RPM of the blower fan 32, and accordingly, the velocity of air discharged through at least one of the first to third outlets 41*a* to 41*c* and the outlet hole 50 may be reduced, in operation 135.

The controller 300 may control the door operating element 66 to close the first to third outlets 41*a* to 41*c*, in operation 140, and discharge heat-exchanged air at low velocity through the outlet hole 50, thereby performing the second mode cooling operation, in operation 145. Accordingly, in the second mode cooling operation, because air is discharged at low velocity through the plurality of outlet holes 50 due to the low RPM of the blower fan 32, the user cannot feel wind discharged from the air conditioner 1 in indoor space maintained at pleasant temperature or pleasant humidity.

If room temperature or room humidity increases when the second mode cooling operation is performed, the sensor 400 may sense at least one of the room temperature and the room humidity, in operation 150.

Then, the controller 300 may compare the room temperature or the room humidity sensed by the sensor 400 to the desired temperature or the desired humidity set in advance by the user and stored in the storage unit 500, and determine whether the room temperature or the room humidity sensed is equal to or lower than the desired temperature or the desired humidity, in operation 155.

If the controller 300 determines that the sensed room temperature or the sensed room humidity is higher than the desired temperature or the desired humidity, operations 115 to 155 are repeated. In contrast, if the controller 300 determines that the sensed room temperature or the sensed room humidity is equal to or lower than the desired temperature or the desired humidity, the controller 300 may continue to perform the second mode cooling operation.

The air conditioner 1 and the control method thereof according to the embodiments of the present disclosure as described above can maintain desired temperature or desired humidity set in advance by a user, based on room temperature or room humidity sensed in real time by the sensor 400.

That is, when room temperature or room humidity needs to be lowered, the controller 300 may open the outlet 41 to perform the first mode cooling operation. At this time, the controller 300 may control the RPM of the blower fan 32 to increase the velocity of air to be discharged.

In contrast, if room temperature or room humidity reaches the desired temperature or the desired humidity, the controller 300 may close the outlet 41 to perform the second mode cooling operation through the outlet hole 50. At this time, the controller 300 may reduce the RPM of the blower fan 32 to discharge air at low velocity through the outlet hole 50, thereby preventing air discharged from the air conditioner 1 from directly arriving at the user, while maintaining indoor space at pleasant temperature or pleasant humidity.

The operations and control method of the air conditioner 1 are not limited to the above-described embodiments, and more various embodiments are possible by slightly modifying the design of the air conditioner 1. Also, the operations and control method of the air conditioner 1 may be performed automatically under the control of the controller 300, or manually according to a user's setting and control.

Figure 13:
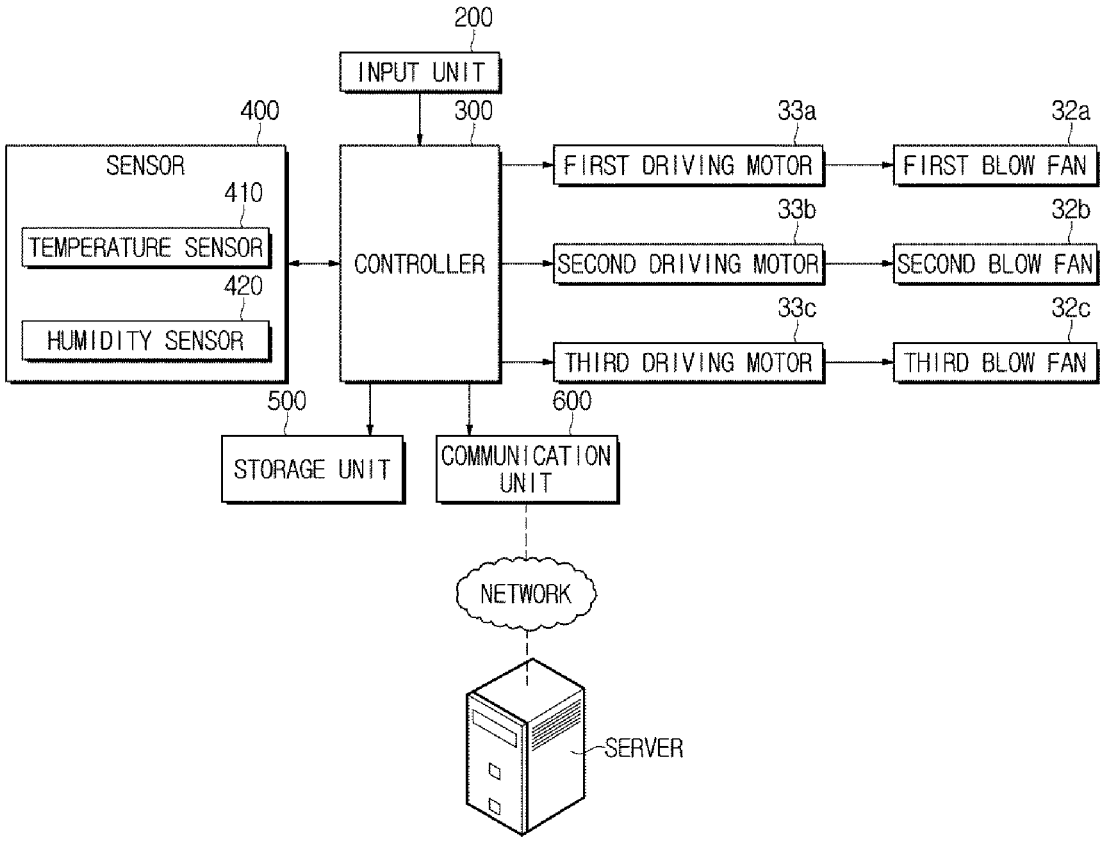
FIG. 13 is a control block diagram of a configuration for condensation prevention control, included in an air conditioner according to an embodiment of the present disclosure.

FIG. 13 is a control block diagram of a configuration for condensation prevention control, included in an air conditioner according to an embodiment of the present disclosure.

As shown in FIG. 13, the air conditioner 1 according to an embodiment of the present disclosure may include: the input unit 200 configured to receive a control command for condensation prevention of the air conditioner 1 from a user; the controller 300 configured to control the individual components of the air conditioner 1 for condensation prevention control of the air conditioner 1; the temperature sensor 410 configured to sense at least one of room temperature of indoor space where the air conditioner 1 is located and temperature of the front panel 10*a* of the air conditioner 1; the storage unit 500 configured to store a program and data for condensation prevention of the air conditioner 1; a communication unit 600 configured to transmit/receive data related to operations of the air conditioner 1 to/from an external server; the first to third driving motors 33*a* to 33*c* configured to transfer power for rotating the first to third blower fans 32*a* to 32*c* and to control RPMs of the first to third blower fans 32*a* to 32*c*; and the first to third blower fans 32*a* to 32*c* configured to discharge heat-exchanged air through the outlet hole 50 in order to prevent condensation in the front panel 10*a* of the air conditioner 1.

The input unit 200 may include a button type switch, a membrane switch, or a touch panel for receiving operation commands for condensation prevention control of the air conditioner 1. If a remote controller (not shown) for receiving operations and driving commands for the air conditioner 1, and displaying operation information of the air conditioner 1 is provided, the input unit 200 of the air conditioner 1 may include only a power button (not shown) for supplying power to the air conditioner 1.

When the outlet 41 of the air conditioner 1 closes and at least one blower fan 32 stops, the input unit 200 may receive a control command for operating the blower fan 32 from a user, in order to prevent condensation in the front panel 10*a* of the air conditioner 1.

That is, the user may set a time period to be taken after the at least one blower fan 32 stops until it rotates again, in advance, through the input unit 200, and also set a rotation period for which the blower fan 32 rotates before again stopping, in advance, through the input unit 200.

Also, the user may input information about dew point temperature and temperature of the front panel 10*a* at which the blower fan 32 starts operating, and the user may himself/herself input a control command for rotating the blower fan 32 in order to prevent condensation of the air conditioner 1. The dew point temperature will be described later with reference to FIG. 14.

The configuration and functions of the input unit 200 have been described above with reference to FIG. 7, and accordingly, further descriptions thereof will be omitted.

The temperature sensor 410 may sense at least one of room temperature of indoor space where the air conditioner 1 is located and temperature of the front panel 10*a* of the air conditioner 1, and output an electrical signal corresponding to the sensed temperature.

The temperature sensor 410 may further include an intake temperature sensor to sense the temperature of room air drawn into the inside of the air conditioner 1, or a discharge temperature sensor to sense the temperature of air discharged from the air conditioner 1. Also, the temperature sensor 410 may sense the temperature of air around the front panel 10*a* of the air conditioner 1, and also sense the temperature of the front panel 10*a*. The temperature sensor 410 may be added at any location where room temperature and the temperature of the front panel 10*a* can be sensed. The temperature sensor 410 may include a thermistor whose electrical resistance changes according to temperature.

The temperature sensor 410 may sense room temperature of indoor space where the air conditioner 1 is located, and the temperature of the front panel 10*a* of the air conditioner 1, and transfer an electrical signal to the controller 300.

The storage unit 500, which is a component to store various kinds of data related to operations and control of the air conditioner 1, may store various kinds of setting data about an operation mode requested by a user, starting or stopping operation, desired temperature, the direction of wind, etc.

Also, the storage unit 500 may store various kinds of data received from the user for condensation prevention of the air conditioner 1. The data may include information about a time period to be taken after the at least one blower fan 32 stops until it rotates again, and information about room temperature and temperature of the front panel 10*a* sensed by the temperature sensor 410. The storage unit 500 may store RPM at which the blower fan 32 needs to rotate in order to prevent condensation of the air conditioner 1.

The storage unit 500 may include a magnetic disk to permanently store a program and data related to control operations of the air conditioner 1, a non-volatile memory such as a semiconductor disk, and a volatile memory (for example, D-RAM and S-RAM) (not shown) to temporarily store temporary data that can be created when the air conditioner 1 operates.

The communication unit 600 may transmit/receive various kinds of data related to operations and control of the air conditioner 1 to/from an external server through a network. That is, although the user himself/herself does not input operation commands and control commands for the air conditioner 1 through the input unit 200, the communication unit 600 may receive information about operation commands and control commands for the air conditioner 1 from an external server.

Also, the communication unit 600 may receive data that can be input by a user in order to prevent condensation of the air conditioner 1, from the external server, and may receive periodically updated data from the external server so that the periodically updated data can be applied to the control of the air conditioner 1.

Also, various kinds of data that can be stored in the storage unit 500 may be stored in the external server through the communication unit 600.

The controller 300 may be electrically connected to the input unit 200, the temperature sensor 410, the storage unit 500, and the communication unit 600 to transmit/receive commands and data related to overall control operations for preventing condensation of the air conditioner 1.

More specifically, the controller 300 may rotate at least one blower fan 32 after the outlet 41 closes, in order to prevent condensation, so that heat-exchanged air can be discharged through the outlet hole 50 according to the rotation of the blower fan 32.

That is, as shown in FIG. 13, the controller 300 may control the first to third driving motors 33*a* to 33*c* to rotate the first to third blower fans 32*a* to 32*c*.

If a predetermined time period input by the user through the input unit 200 elapses after the outlet 41 closes and the blower fan 32 stops rotating, the controller 300 may rotate the blower fan 32 at predetermined RPM. Also, if the temperature of the front panel 10*a* is equal to or lower than the dew point temperature based on room temperature and the temperature of the front panel 10*a* sensed by the temperature sensor 410, the controller 300 may rotate the blower fan 32.

At this time, a time period to be taken after the outlet 41 closes and the blower fan 32 stops rotating until the blower fan 32 rotates again may be set in advance and then stored in the storage unit 500, and data about a rotation period for which the blower fan 32 rotates before again stopping and RPM of the blower fan 32 may also be set in advance and stored in the storage unit 500. Also, the controller 300 may determine a time at which the blower fan 32 starts operating, based on data about dew point temperature based on room temperature and temperature of the front panel 10*a*, stored in the storage unit 500, and the controller 300 may operate the blower fan 32 according to the result of determination on whether temperature of the front panel 10*a* sensed by the temperature sensor 410 is equal to or lower than the dew point temperature.

The first to third driving motors 33*a* to 33*c* may transfer power to rotate the first to third blower fans 32*a* to 32*c*, and adjust RPMs of the first to third blower fans 32*a* to 32*c*, under the control of the controller 300.

Figure 14:
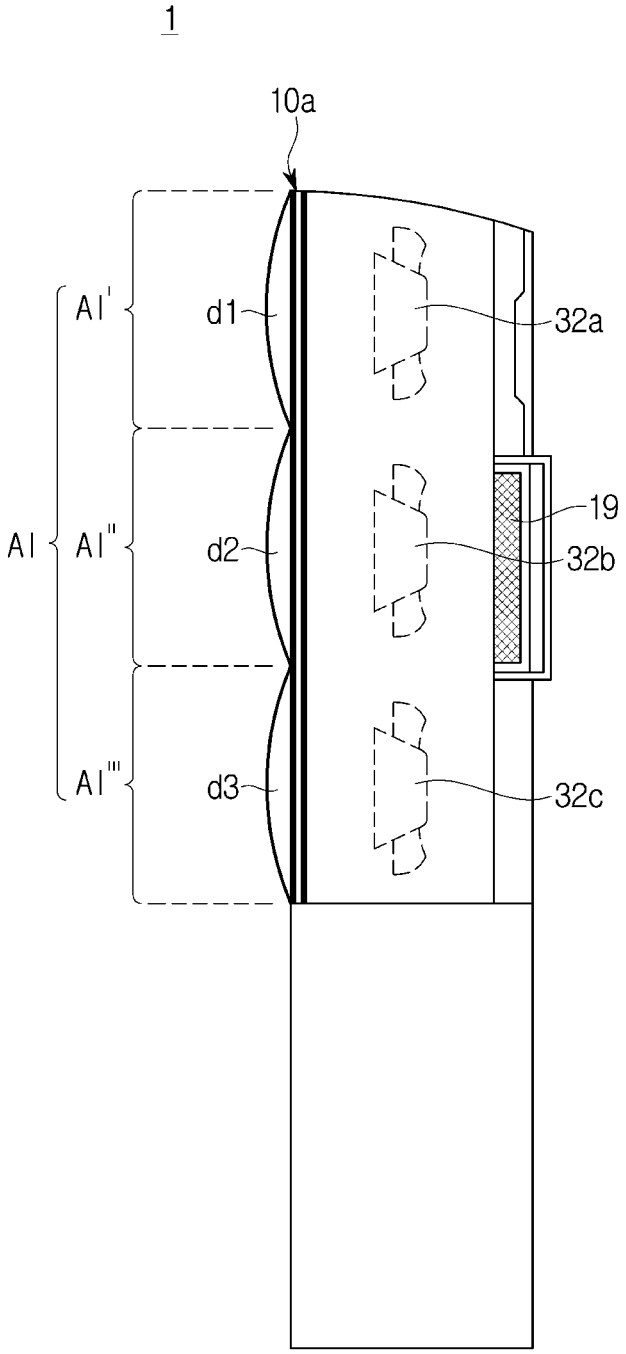
FIG. 14 is a side view of an air conditioner for describing condensation that occurs on a front panel of the air conditioner.

FIG. 14 is a side view of an air conditioner for describing condensation that occurs on a front panel of the air conditioner.

Referring to FIG. 14, in the housing 10 of the air conditioner 1, the front panel 10*a* may be provided, and an area in which the front panel 10*a* and the outlet 41 are disposed is defined as the first area A1, as described above.

As described above with reference to FIGS. 1 to 12, the cooling modes of the air conditioner 1 according to an embodiment of the present disclosure can be divided into the first mode and the second mode, wherein the first mode is to open the at least one outlet 41 and to discharge heat-exchanged air through the outlet 41, and the second mode is to close the at least one outlet 41 and to discharge heat-exchanged air through the outlet hole 50 formed in the discharge plate 14.

In the first mode, because the outlet 41 opens to perform cooling, no condensation may occur in the front panel 10*a* including the discharge plate 14, and also, in the second mode, no condensation may occur in the front panel 10*a* if the blower fan 32 rotates at low RPM to discharge air through the outlet hole 50.

Meanwhile, in the second mode in which the outlet 41 closes, if the blower fan 32 stops, condensation may occur in the front panel 10*a* because the amount of air discharged through the outlet hole 50 is small.

The condensation refers to a phenomenon in which when air containing water vapor is cooled below dew point temperature, the water vapor in the air is condensed into water to form dew. The condensation can be classified into surface condensation and internal condensation. That is, the condensation refers to a phenomenon in which when the internal temperature of a certain object falls below dew point temperature, water vapor in the air contacting the surface of the object is condensed into water to form dew. Herein, the dew point temperature refers to temperature at which water vapor in the air is condensed into water to form dew.

As shown in FIG. 14, the first area A1 of the front panel 10*a* may be divided into three areas A1', A1", and A1'", and criteria for dividing the first area A1 into the three areas A1', A1", and A1'" may be the locations of the first to third outlets 41*a* to 41*c*.

FIG. 14 relates to the second mode in which the outlet 41 closes, and shows an embodiment of a case in which the blower fan 32 stops in the second mode.

A case in which condensation occurs in the front panel 10*a* will be described as an example, as follow. When room temperature of indoor space where the air conditioner 1 is located is within a range of 27° C. to 30° C., the temperature of air around the front panel 10*a* of the air conditioner 1 may also be within the range of 27° C. to 30° C.

When the blower fan 32 stops after the air conditioner 1 performs the first mode cooling operation or the second mode cooling operation, heat-exchanged cool air may exist in the inside of a housing 11 (also, referred to as a upper housing), that is, in the inside of the front panel 10*a*, so that the front panel 10*a* can be maintained at temperature which is lower than the temperature of the indoor space, in correspondence to the temperature of the heat-exchanged cool air. Accordingly, if the temperature of the heat-exchanged cool air is 15° C., the temperature of the front panel 10*a* may also be maintained at 15° C.

If the temperature of the front panel 10*a* is 15° C., and the temperature of air around the front panel 10*a* is within the range of 27° C. to 30° C., dew point temperature at which condensation occurs on the surface of the front panel 10*a* may be decided as approximately 23° C.

If the room air within the range of 27° C. to 30° C. contacts the front panel 10*a* maintained at 15° C., condensation may occur on the surface of the front panel 10*a* because the temperature of the front panel 10*a* is lower than the dew point temperature of 23° C.

The condensation may form dew on the discharge plate 14 included in the front panel 10*a*, which may cause a fault in the structure of the air conditioner 1.

As shown in FIG. 14, in the respective areas A1', A1", and A1'" included in the first area A1 of the front panel 10*a*, the corresponding condensations d1, d2, and d3 may occur. That is, when the first outlet 41*a* closes and the first blower fan 32*a* stops, condensation d1 may occur in the area A1' of the front panel 10*a*, when the second outlet 41*b* closes and the second blower fan 32*b* stops, condensation d2 may occur in the area A1" of the front panel 10*a*, and when the third outlet 41*c* closes and the third blower fan 32*c* stops, condensation d3 may occur in the area A1'" of the front panel 10*a*.

In the first area A1 of the front panel 10*a*, condensation may occur on the area A1', A1", or A1'" depending on which one of the first to third blower fans 32*a* to 32*c* operates. That is, the condensations d1, d2, and d3 occurring in the front panel 10*a* may be due to heat-exchanged cool air remaining in the housing 10 without being discharged to the outside to cool the front panel 10*a* so that the front panel 10*a* cooled in correspondence to the temperature of the heat-exchanged cool air contacts room air.

Figure 15:
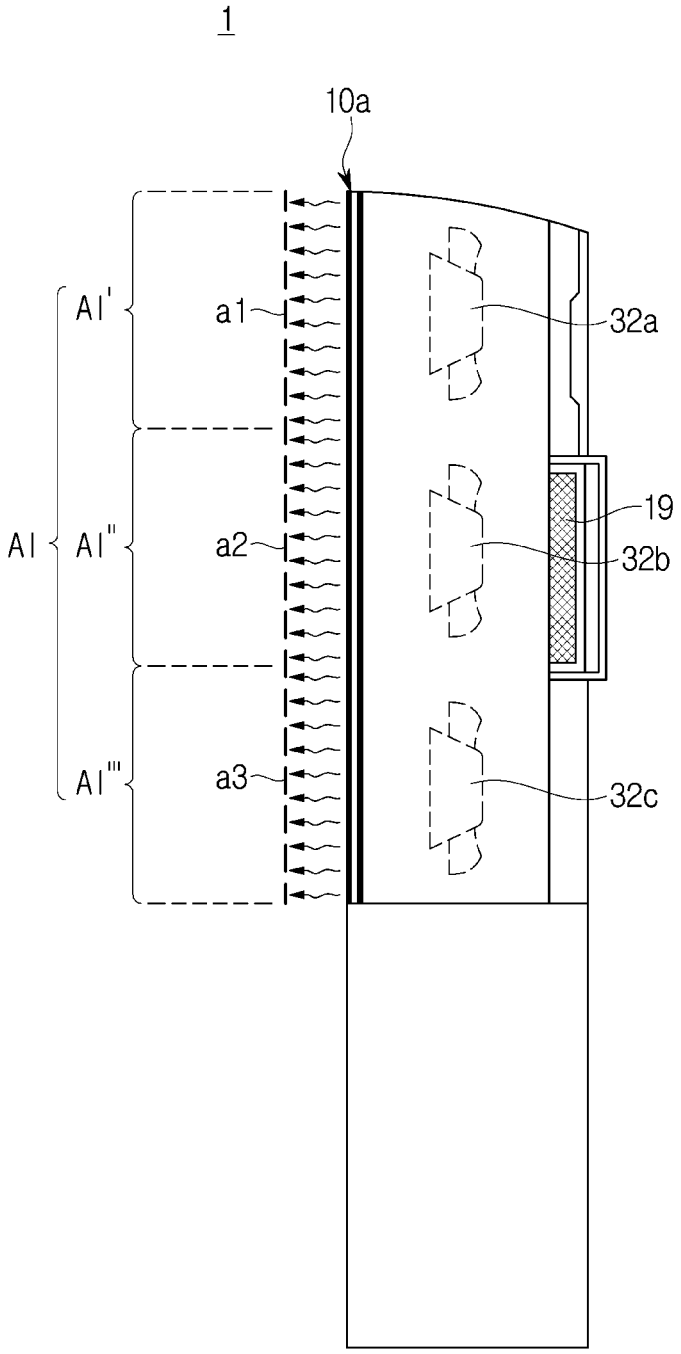
FIG. 15 is a conceptual view for describing operation of an air conditioner for preventing condensation of a front panel, according to an embodiment of the present disclosure.

FIG. 15 is a conceptual view for describing operation of an air conditioner for preventing condensation of a front panel, according to an embodiment of the present disclosure.

In order to prevent condensation as described above with reference to FIG. 14, dew point temperature at which condensation occurs in the front panel 10*a* of the air conditioner 1 may need to be lowered so that the temperature of the front panel 10*a* is equal to or higher than the dew point temperature.

In order to lower the dew point temperature, the controller 300 may rotate the blower fan 32, as shown in FIG. 15. If the blower fan 32 rotates, heat-exchanged air may be discharged to the outside of the air conditioner 1 through the outlet hole 50 formed in the front panel 10*a*. If the heat-exchanged air is discharged to the outside as shown in FIG. 15, room air of 27° C. to 30° C. around the front panel 10*a* may be replaced with air of 15° C. heat-exchanged and discharged.

Accordingly, unlike the embodiment of FIG. 14, the temperature of the room air around the front panel 10*a* may become approximately 15° C., and the temperature of the surface of the front panel 10*a* may be 15° C. like the embodiment of FIG. 14. Accordingly, dew point temperature at which condensation occurs may be decided as approximately 11° C. If the dew point temperature is lowered to approximately 11° C., no condensation may occur because the temperature of the front panel 10*a* is 15° C. that is higher than the dew point temperature.

That is, if the blower fan 32 rotates to discharge heat-exchanged air to the outside through the outlet hole 50, as shown in FIG. 15, borders a1, a2, and a3 may be formed between the discharged air and the existing room air, and dew point temperature may be lowered due to the formed borders a1, a2, and a3 so that no condensation occurs in the front panel 10*a*.

If the blower fan 32 rotates, heat-exchanged air may be discharged to the outside to prevent condensation. However, if the blower fan 32 again stops, outside air of 27° C. to 30° C. may again move to the front panel 10*a* so that dew point temperature can again rise, which may result in condensation on the front panel 10*a*.

Accordingly, the controller 300 may control the blower fan 32 to continue to discharge heat-exchanged air or to discharge heat-exchanged air periodically, thereby preventing condensation from occurring on the front panel 10*a*.

As described above with reference to FIG. 14, the first area A1 of the front panel 10*a* may be divided into the three areas A1', A1", and A1'" in correspondence to the locations of the first to third outlets 41*a* to 41*c*, and condensation may occur on the area A1', A1", or A1'" of the front panel 10*a* depending on which one of the first to third blower fans 32*a* to 32*c* included in the first to third outlets 41*a* to 41*c* rotates.

That is, when the first blower fan 32*a* stops and the second and third blower fans 32*b* and 32*c* rotate, condensation may occur on the area A1' of the front panel 10*a* because dew point temperature is not lowered in the area A1' of the front panel 10*a*.

Also, when the second blower fan 32*b* stops and the first and third blower fans 32*a* and 32*c* rotate, condensation may occur on the area A1" of the front panel 10*a* because dew point temperature is not lowered in the area A1" of the front panel 10*a*.

Likewise, when the third blower fan 32*c* stops and the first and second blower fans 32*a* and 32*b* rotate, condensation may occur on the area A1'" of the front panel 10*a* because dew point temperature is not lowered in the area A1'" of the front panel 10*a*.

As described above with reference to FIG. 13, because the controller 300 can control the first to third driving motors 33*a* to 33*c* to control the first to third blower fans 32*a* to 32*c*, the controller 300 may rotate all of the first to third blower fans 32*a* to 32*c* when all of the first to third blower fans 32*a* to 32*c* stop, thereby preventing condensation. If any one of the first to third blower fans 32*a* to 32*c* stops, the controller 300 may rotate the stopped blower fan to prevent condensation from occurring on the corresponding area.

If at least one of the first to third blower fans 32*a* to 32*c* stops, the controller 300 may rotate the at least one of the first to third blower fans 32*a* to 32*c* in order to prevent condensation. At this time, if a predetermined time period elapses after the blower fan 32 stops, based on time information set by a user and stored in the storage unit 500, the controller 300 may rotate the blower fan 32.

The controller 300 may rotate the blower fan 32 at predetermined RPM, may continue to rotate the blower fan 32 at constant RPM after rotating the blower fan 32, or may rotate the blower fan 32 periodically in such a way to stop the blower fan 32 after a predetermined time period elapses and then again rotate the blower fan 32.

At this time, a time period to be taken after the blower fan 32 stops until it rotates again, or a rotation period for which the blower fan 32 rotates may be set by a user. The time period and the rotation period may be based on time information or a time period calculated in consideration of a time taken until condensation occurs in the front panel 10*a* after the blower fan 32 stops.

Time information related to control operation for rotating the blower fan 32 to prevent condensation may be stored in the storage unit 500, or may be received from an external server through the communication unit 600 and then transmitted to the controller 300.

The controller 300 may calculate dew point temperature based on room temperature and temperature of the front panel 10*a* sensed by the temperature sensor 410, and determine whether the temperature of the front panel 10*a* is lower than the dew point temperature to thus control the rotation of the blower fan 32.

That is, the temperature sensor 410 may sense the temperature of the front panel 10*a* and room temperature around the front panel 10*a*, and transmit an electrical signal to the controller 300. The controller 300 may decide an area on which condensation is to occur because the temperature of the area is equal to or lower than dew point temperature, among the three areas A1', A1", and A1'" of the front panel 10*a*, based on the received signal. The controller 300 may rotate the blower fan 32 corresponding to the decided area to discharge heat-exchanged air through the outlet hole 50 and thus prevent condensation from occurring on the corresponding area.

The controller 300 may rotate all of the first to third blower fans 32*a* to 32*c*, or may rotate at least one of the first to third blower fans 32*a* to 32*c*.

Likewise, time information, rotation period information, and RPM information related to control operation for rotating the blower fan 32 to prevent condensation may be stored in the storage unit 500, or may be received from an external server through the communication unit 600 and then transmitted to the controller 300.

Figure 16A:
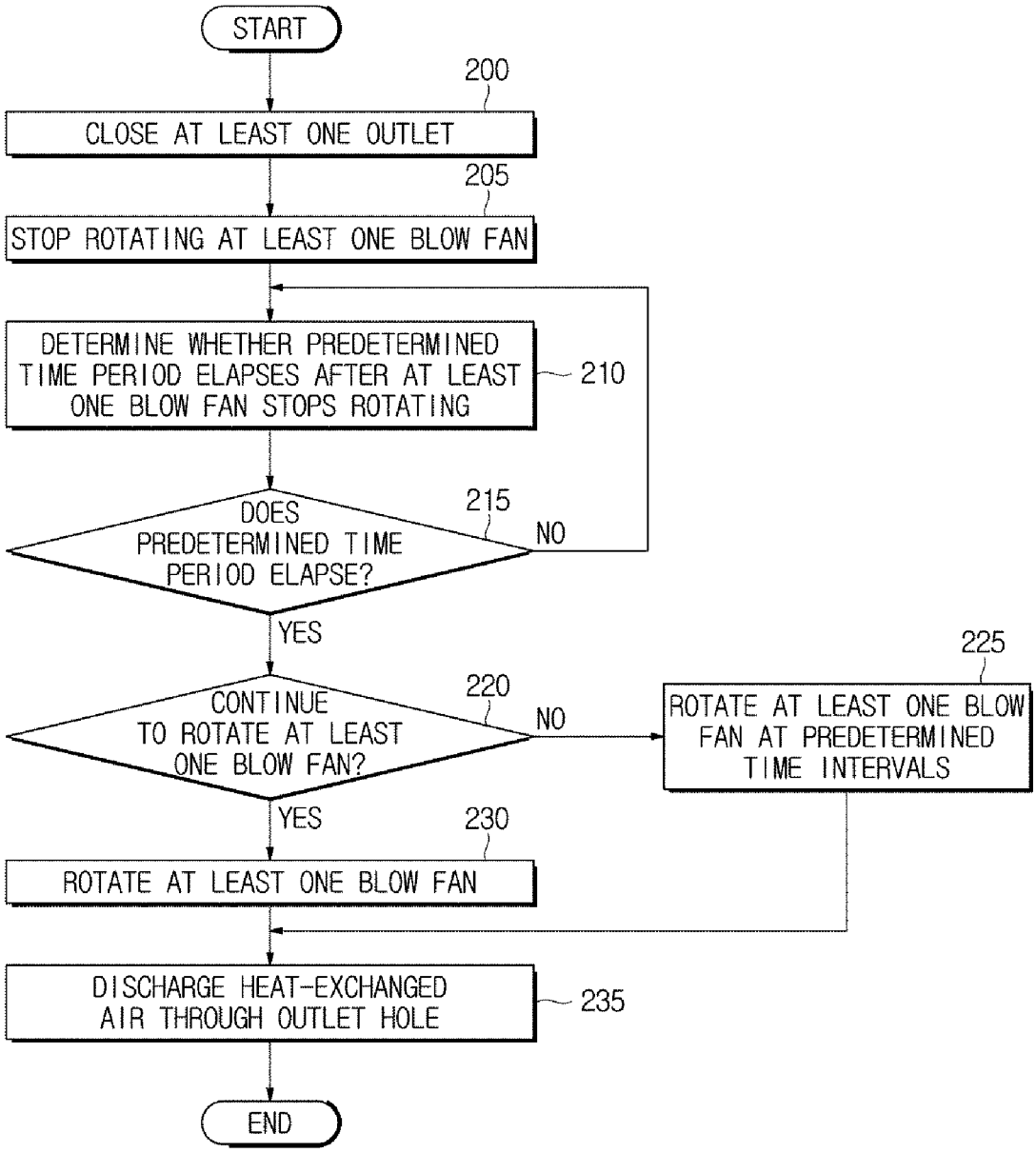
FIGS. 16A and 16B are flowcharts illustrating methods of controlling an air conditioner to prevent condensation, according to embodiments of the present disclosure.
Figure 16B:
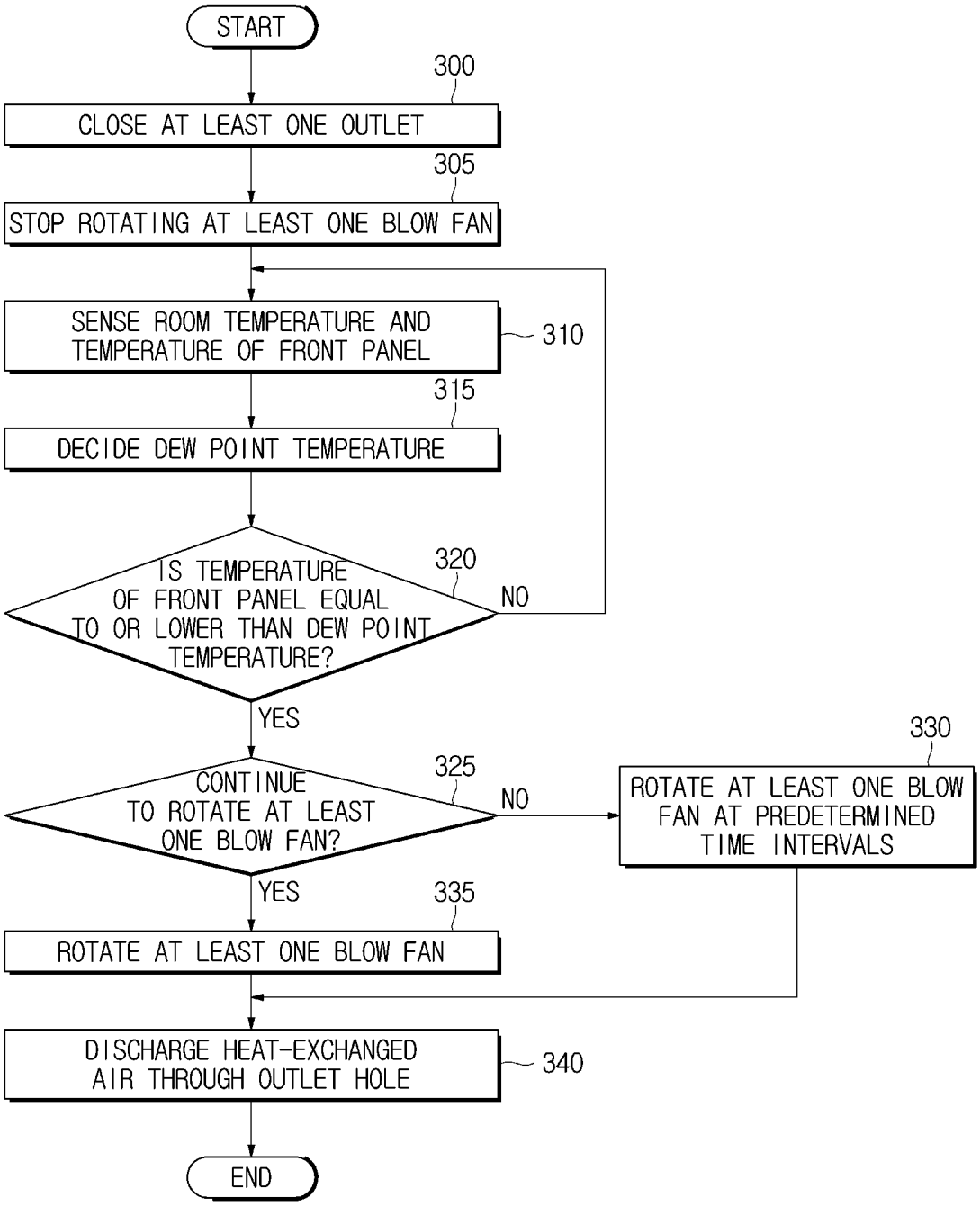

FIGS. 16A and 16B are flowcharts illustrating methods of controlling an air conditioner to prevent condensation, according to embodiments of the present disclosure.

Referring to FIGS. 7 and 16A, the air conditioner 1 may close at least one outlet 41 among the first to third outlets 41*a* to 41*c* according to whether the first mode cooling operation is finished, in operation 200.

If the at least one outlet 41 closes, the air conditioner 1 may perform the second mode cooling operation, and the controller 300 may stop rotating the at least one blower fan 32 according to whether the second mode cooling operation is finished, in operation 205.

The controller 300 may determine whether a predetermined time period elapses after the at least one blower fan 32 stops rotating, in operation 210. Herein, information about the predetermined time period may be set in advance by a user and stored in the storage unit 500.

If the controller 300 determines that the predetermined time period elapses in operation 215, the controller 300 may determine whether to continue to rotate the at least one blower fan 32 at low RPM, or whether to repeatedly rotate and stop the at least one blower fan 32 at predetermined time intervals, in operation 220. If the controller 300 determines continuing to rotate the at least one blower fan 32, the controller 300 may control the at least one blower fan 32 to rotate at low RPM, in operation 230. If the controller 300 determines repeatedly rotating and stopping the at least one blower fan 32 at predetermined time intervals, the controller 300 may control the at least one blower fan 32 to rotate at predetermined time intervals, in operation 225. Information about the predetermined time interval may be set in advance by the user and stored in the storage unit 500.

If the at least one blower fan 32 rotates, air may be discharged to the outside through the outlet hole 50, in operation 235. Then, dew point temperature may be lowered, as described above, to thus prevent condensation from occurring in the front panel 10*a*. The controller 300 may control the at least one blower fan 32 individually to prevent condensation from occurring in the front panel 10*a* corresponding to the location of the rotating blower fan 32 among the at least one blower fan 32.

Referring to FIGS. 7 and 16B, the air conditioner 1 may close at least one outlet 41 among the first to third outlets 41*a* to 41*c* according to whether the first mode cooling operation is finished, in operation 300.

If the at least one outlet 41 closes, the air conditioner 1 may perform the second mode cooling operation, and the controller 300 may stop rotating at least one blower fan 32 according to whether the second mode cooling operation is finished, in operation 305.

The temperature sensor 410 may sense room temperature of space where the air conditioner 1 is located and temperature of the front panel 10*a*, in operation 310, and transmit an electrical signal to the controller 300.

The controller 300 may decide dew point temperature at which condensation occurs, based on the room temperature sensed by the temperature sensor 410, in operation 315. Also, the controller 300 may determine whether the temperature of the front panel 10*a* is equal to or lower than the dew point temperature, in operation 320. Data about the dew point temperature that is decided according to the sensed room temperature may be stored in advance in the storage unit 500.

If the temperature of the front panel 10*a* is equal to or lower than the dew point temperature, condensation may occur in the front panel 10*a*, and accordingly, the controller 300 may rotate the at least one blower fan 32. The dew point temperature and the cause of condensation occurring on the front panel 10*a* have been described above with reference to FIG. 14, and accordingly, further descriptions thereof will be omitted.

The controller 300 may determine whether to continue to rotate the at least one blower fan 32 at low RPM or whether to repeatedly rotate and stop the at least one blower fan 32 at predetermined time intervals, in operation 325. If the controller 300 determines continuing to rotate the at least one blower fan 32 at low RPM, the controller 300 may control the at least one blower fan 32 to rotate at low RPM, in operation 335. If the controller 300 determines repeatedly rotating and stopping the at least one blower fan 32 at predetermined time intervals, the controller 300 may control the at least one blower fan 32 to rotate at predetermined time intervals, in operation 330. The predetermined time interval may be set in advance by the user and stored in the storage unit 500.

If the at least one blower fan 32 rotates, air may be discharged to the outside through the outlet hole 50, in operation 340. Then, dew point temperature may be lowered, as described above, to thus prevent condensation from occurring in the front panel 10*a*. The controller 300 may control the at least one blower fan 32 individually to prevent condensation from occurring in the front panel 10*a* corresponding to the location of the rotating blower fan 32 among the at least one blower fan 32.

Figure 17:
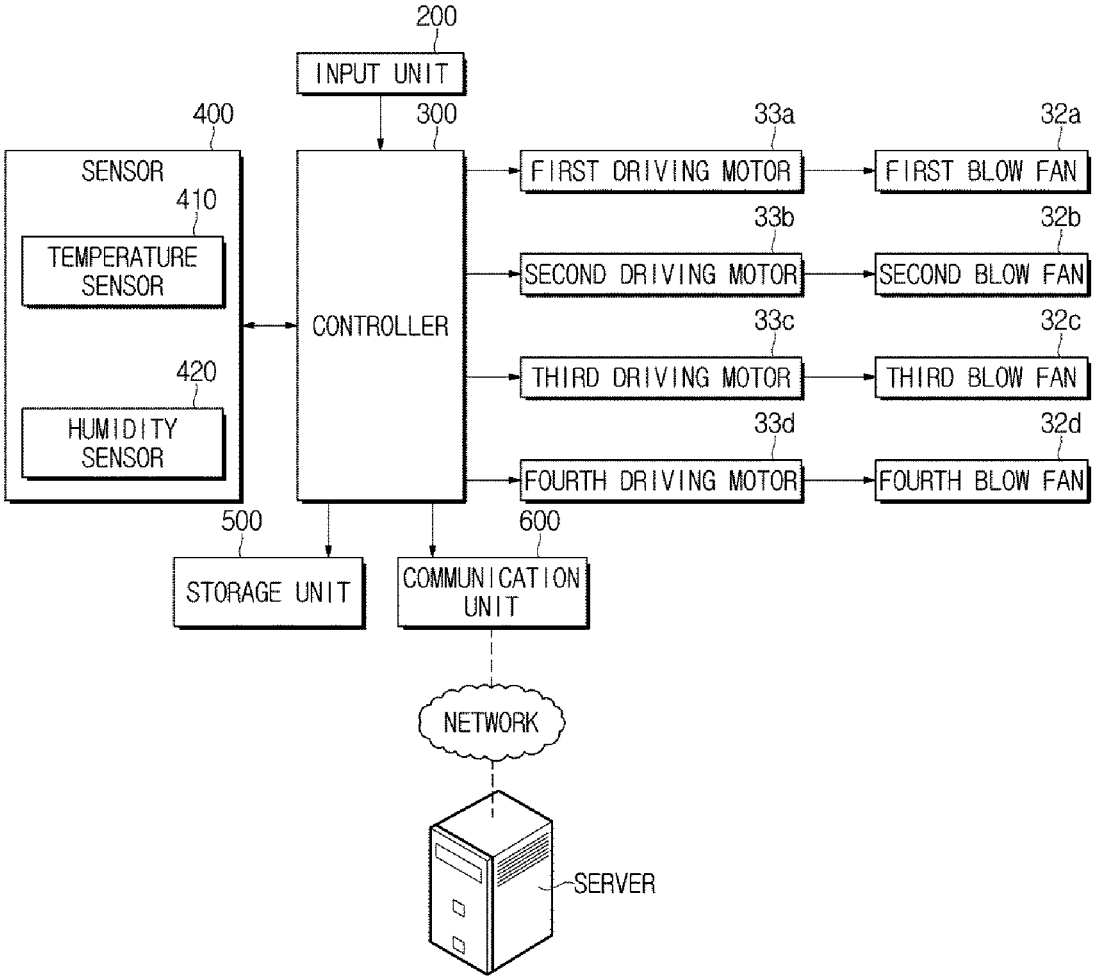
FIG. 17 is a control block diagram of a configuration of an air conditioner for discharging heat-exchanged air through a second outlet provided in a lower housing.

FIG. 17 is a control block diagram of a configuration of an air conditioner for discharging heat-exchanged air through a second outlet provided in a lower housing.

Referring to FIG. 17, the air conditioner 1 according to an embodiment of the present disclosure may include at least one lower blower fan 32*d* configured to move heat-exchanged air from the upper housing 11 to a lower housing 12, and a fourth driving motor 33*d* configured to transfer power for rotating the lower blower fan 32*d* and control RPM of the lower blower fan 32*d*.

The input unit 200 may include a button type switch, a membrane switch, or a touch panel for receiving operation commands for controlling the lower blower fan 32*d* of the air conditioner 1. If a remote controller (not shown) for receiving operations and driving commands for the air conditioner 1, and displaying operation information of the air conditioner 1 is provided, the input unit 200 of the air conditioner 1 may include only a power button (not shown) for supplying power to the air conditioner 1.

The input unit 200 may receive a control command for rotating the lower blower fan 32*d* to move heat-exchanged air from the upper housing 11 to the lower housing 12 and to discharge the heat-exchanged air to the outside through the second outlet hole 52 formed in the second area A2 of the front panel 10*a*.

A user may input data about a time at which the lower blower fan 32*d* rotates, a rotation period of the lower blower fan 32*d*, and RPM of the lower blower fan 32*d*, through the input unit 200. Also, the user may set room temperature or a time at which the lower blower fan 32*d* starts operating, through the input unit 200.

The configuration and functions of the input unit 200 have been described above with reference to FIGS. 7 to 13, and accordingly, further descriptions thereof will be omitted.

The temperature sensor 410 may sense room temperature of space where the air conditioner 1 is located, and transfer an electrical signal corresponding to the sensed room temperature to the controller 300. The controller 300 may adjust a rotation period and RPM of the lower blower fan 32*d* based on the received electrical signal. The configuration and functions of the temperature sensor 41 have been described above with reference to FIGS. 7 to 13, and accordingly, further descriptions thereof will be omitted.

The storage unit 500 may store data related to control operations of the air conditioner 1, input by the user through the input unit 200. That is, the storage unit 500 may store data about room temperature and a time at which the lower blower fan 32*d* starts operating, as well as data about a time at which the lower blower fan 32*d* rotates, a rotation period for which the lower blower fan 32*d* rotates, and RPM at which the lower blower fan 32*d* rotates.

The communication unit 600 may transmit/receive data related to operations and control of the air conditioner 1 to/from the external server through the network. Or, the communication unit 600 may receive data about room temperature sensed by a sensor installed outside the air conditioner 1 from a server, and transfer the data to the controller 300.

The controller 300 may be electrically connected to the input unit 200, the temperature sensor 410, the storage unit 500, and the communication unit 600, and receive/transmit commands and data related to the control of the air conditioner 1 according to an embodiment of the present disclosure.

More specifically, if a control command for the lower blower fan 32*d* is received, the controller 300 may rotate the lower blower fan 32*d* based on the input control command. At this time, the controller 300 may change a rotation period and RPM of the lower blower fan 32*d* based on room temperature sensed by the temperature sensor 410 or the control command input by the user.

That is, if room temperature of space where the air conditioner 1 is located is higher than desired temperature set in advance and stored in the storage unit 500, the controller 300 may increase the RPM of the lower blower fan 32*d*, and if the room temperature of the space where the air conditioner 1 is located is lower than the desired temperature, the controller 300 may decrease the RPM of the lower blower fan 32*d*.

The lower blower fan 32*d* may be electrically connected to the fourth driving motor 33*d*, and the fourth driving motor 33*d* may control the rotation of the lower blower fan 32*d* under the control of the controller 300. The lower blower fan 32*d* may rotate to move heat-exchanged air from the upper housing 11 to the lower housing 12, so that the moved air can be discharged to the outside through the second outlet hole 52.

Figure 18:
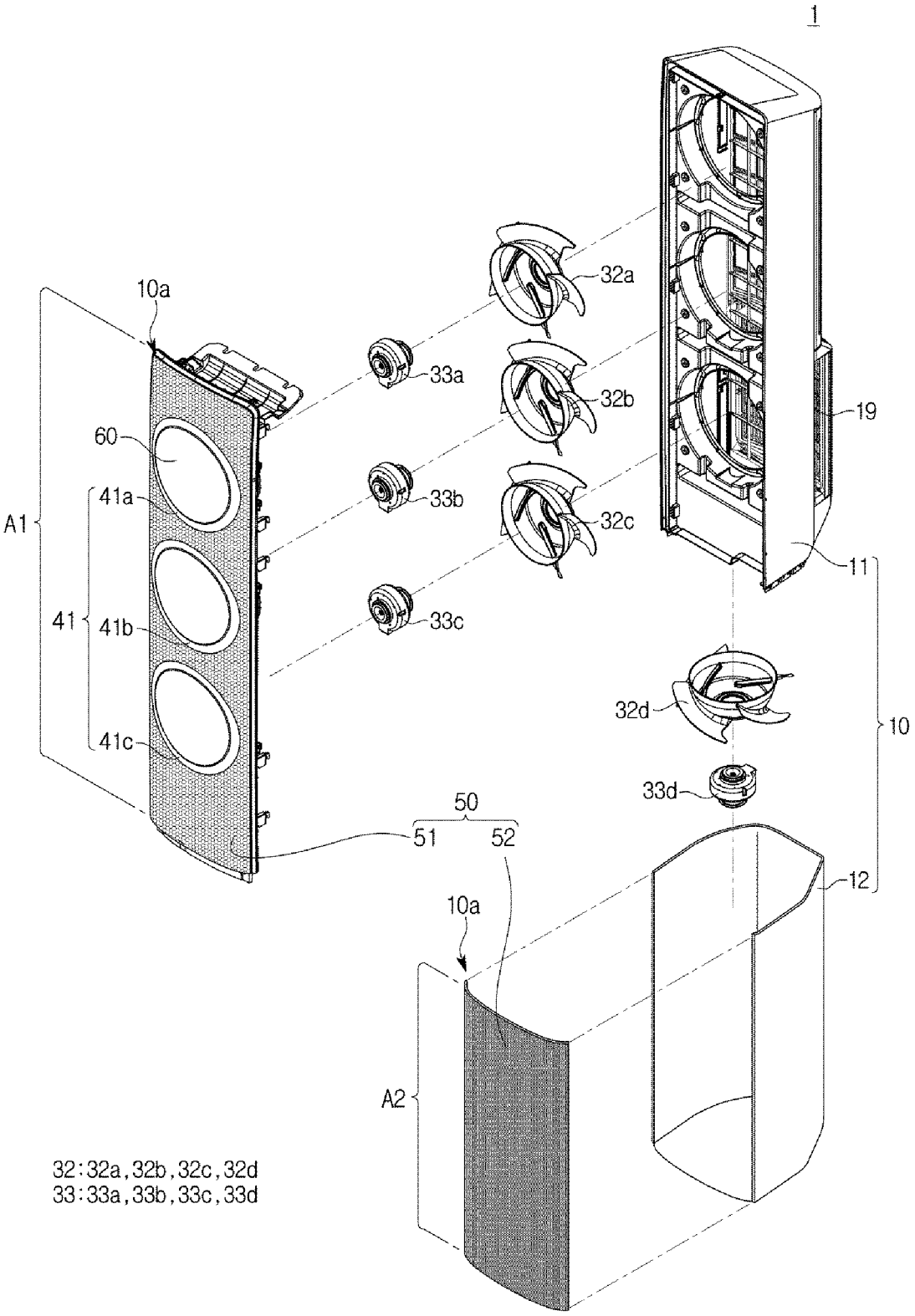
FIG. 18 is an exploded perspective view of an air conditioner including a lower blower fan, according to an embodiment of the present disclosure.
Figure 19:
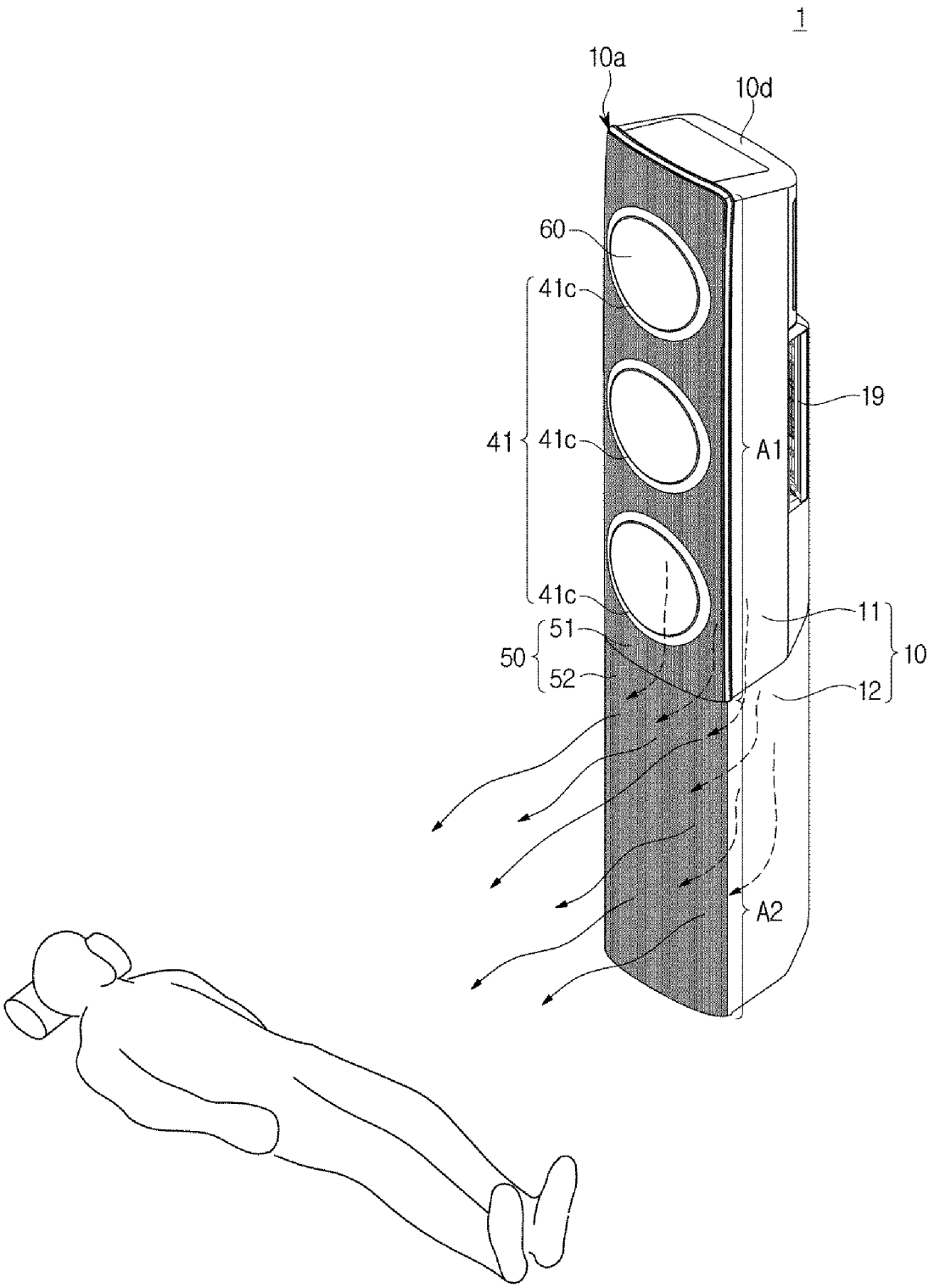
FIG. 19 is a conceptual view for describing operation in which heat-exchanged air moved to a lower housing is discharged to the outside through a second outlet hole, according to an embodiment of the present disclosure.

FIG. 18 is an exploded perspective view of an air conditioner including a lower blower fan, according to an embodiment of the present disclosure, and FIG. 19 is a conceptual view for describing operation in which heat-exchanged air moved to a lower housing is discharged to the outside through a second outlet hole, according to an embodiment of the present disclosure.

Referring to FIG. 18, the air conditioner 1 according to an embodiment of the present disclosure may include the upper housing 11 including the first area A1 of the front panel 10*a*, the lower housing 12 including the second area A2 of the front panel 10*a*, the first to fourth driving motors 33*a* to 33*d*, the first to third blower fans 32*a* to 32*c*, and the lower blower fan 32*d*.

In the first area A1 of the front panel 10*a*, a first outlet hole 51 through which heat-exchanged air is discharged to the outside when the outlet 41 closes may be provided, and in the second area A2 of the front panel 10*a*, a second outlet hole 52 through which heat-exchanged air moved to the lower housing 12 by the lower blower fan 32*d* is discharged to the outside may be provided.

Also, the lower blower fan 32*d* may be disposed between the upper housing 11 and the lower housing 12. In FIG. 18, for convenience of description, a single lower blower fan 32*d* is shown. However, the number of the lower blower fan 32*d* is not limited as long as at least one lower blower fan 32*d* is provided.

Also, a location at which the lower blower fan 32*d* is disposed is not limited, and the lower blower fan 32*d* may be disposed at any location at which heat-exchanged air can move from the upper housing 11 to the lower housing 12.

As described above in the embodiments of FIGS. 1 to 12, the cooling modes of the air conditioner 1 can be divided into the first mode and the second mode, wherein the first mode is to discharge heat-exchanged air through at least one outlet 41, and the second mode is to perform cooling through the outlet hole 50. More specifically, the second mode is to close the first to third outlets 41*a* to 41*c* when room temperature reaches desired temperature set in advance by a user, and to discharge heat-exchanged air through the outlet hole 50, thereby continuing to maintain indoor space at pleasant temperature.

The user may use the input unit 200 to input an operation mode (for example, a wind-velocity/wind-volume mode, such as "Strong", "Normal", "Weak", and "Turbo", an automatic/manual mode, or a function mode, such as a cooling mode, a dehumidification mode, a blowing mode, a heating mode, a comfort mode, a rapid cooling mode, and a sleeping mode) of the air conditioner 1, to start or stop operation, to set desired temperature, or to set a wind direction.

If the user sets the operation mode of the air conditioner 1 to the rapid cooling mode, the at least one outlet 41 may open so that the first mode cooling operation can be performed. If the first mode cooling operation is performed by the rapid cooling mode, room temperature may reach desired temperature set by the user in a short time.

The user may set the operation mode of the air conditioner 1 to the comfort mode or the sleeping mode, through the input unit 200, or the user may input a control command for operation of the lower blower fan 32*d*, through the input unit 200.

If a control command for the comfort mode or the sleeping mode is received, or if a command for operation of the lower blower fan 32*d* is received, the controller 300 may control the fourth driving motor 33*d* to rotate the lower blower fan 32*d*.

If the lower blower fan 32*d* rotates, heat-exchanged air may move from the upper housing 11 to the lower housing 12, and the moved air may be discharged to the outside through the second outlet hole 52, as shown in FIG. 19.

In the second mode cooling operation of the air conditioner 1 according to an embodiment of the present disclosure, as described above, the outlet 41 may close, and at least one of the first to third blower fans 32*a* to 32*c* may rotate at low velocity to discharge air through the outlet hole 50, thereby maintaining desired temperature set in advance by a user.

That is, when the user selects the sleeping mode, air may be discharged through the second outlet hole 52 so that pleasant room temperature can be maintained while the user is asleep.

In the second mode of the air conditioner 1, as described above, the controller 300 may close the outlet 41 and rotate the first to third blower fans 32*a* to 32*c* to perform cooling operation at low velocity, or the controller 300 may rotate the lower blower fan 32*d* to move air at low velocity towards the lower housing 12. The air moved towards the lower housing 12 may be discharged at low velocity through the second outlet hole 52 to maintain the lower area of indoor space where the user is asleep at pleasant temperature.

The controller 300 may change a rotation period and RPM of the lower blower fan 32*d*, based on room temperature sensed by the temperature sensor 410 or a control command input by the user. Also, the controller 300 may change a rotation period and RPM of the lower blower fan 32*d*, based on data about room temperature received from an external server through the communication unit 600, other than the room temperature sensed by the temperature sensor 410.

That is, if the room temperature of space where the air conditioner 1 is located is higher than temperature set in advance and stored in the storage unit 500, the controller 300 may increase the RPM of the lower blower fan 32*d*, and if the room temperature of the space where the air conditioner 1 is located is lower than temperature set in advance and stored in the storage unit 500, the controller 300 may decrease the RPM of the lower blower fan 32*d*.

The controller 300 may control the lower blower fan 32*d*, independently from the control of the first to third blower fans 32*a* to 32*c*.

Also, the controller 300 may change a frequency for a compressor (not shown) to change the amount of refrigerants of the air conditioner 1, in addition to changing the rotation period or RPM of the lower blower fan 32*d* based on room temperature.

Figure 20A:
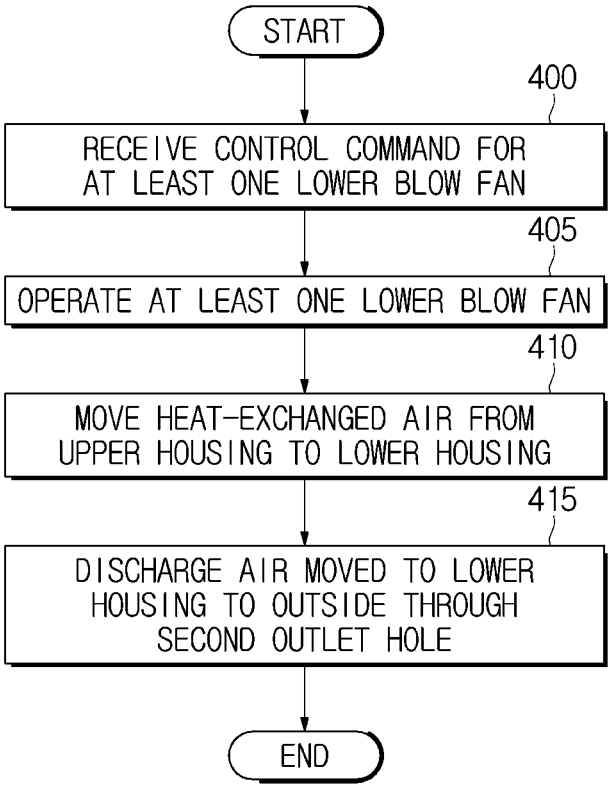
FIGS. 20A and 20B are flowcharts illustrating methods of controlling an air conditioner to discharge heat-exchanged air through a second outlet provided in a lower housing of the air conditioner according to an embodiment of the present disclosure.
Figure 20B:
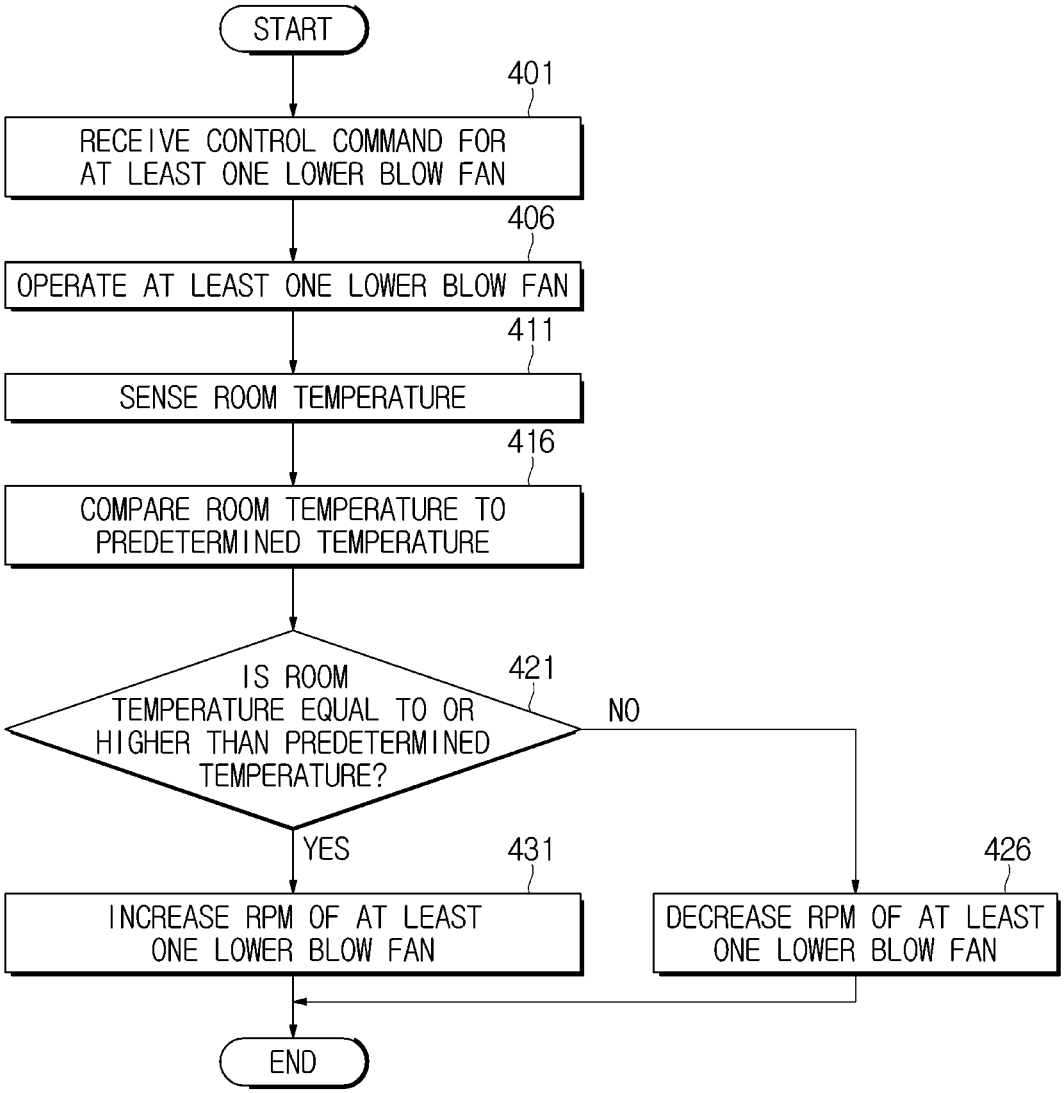

FIGS. 20A and 20B are flowcharts illustrating methods of controlling an air conditioner to discharge heat-exchanged air through a second outlet provided in a lower housing of the air conditioner according to an embodiment of the present disclosure.

The input unit 200 may receive a control command for the at least one lower blower fan 32*d* from a user, in operation 400. That is, the user may input a control command for rotating the lower blower fan 32*d* through the input unit 200 to move heat-exchanged air from the upper housing 11 to the lower housing 12 and to discharge the air to the outside through the second outlet hole 52 provided in the second area A2 of the front panel 10*a*.

The controller 300 may control the fourth driving motor 33*d* based on the received control command to rotate the at least one lower blower fan 32*d*, so that the at least one lower blower fan 32*d* operates, in operation 405.

If the lower blower fan 32*d* rotates, heat-exchanged air may move from the upper housing 11 to the lower housing 12, in operation 410, and the moved air may be discharged to the outside through the second outlet hole 52, in operation 415. Accordingly, the second mode cooling operation may be performed with respect to the lower area of the indoor space where the air conditioner 1 is located so that the indoor space can be maintained at pleasant temperature when the user is asleep.

Referring to FIG. 20B, in operation 401, the controller 300 may receive a control command for operating at least one lower blower fan, and operate at least one lower blower fan in operation 406. The temperature sensor 410 may sense room temperature of space where the air conditioner 1 is located, in operation 411, and the controller 300 may compare the room temperature sensed by the temperature sensor 410 to predetermined temperature set in advance and stored in the storage unit 500, in operation 416. Herein, the predetermined temperature set in advance and stored in the storage unit 500 may correspond to room temperature desired by the user. For example, the predetermined temperature may be temperature for the user's comfort sleep with respect to the lower area of indoor space where the air conditioner 1 is located.

If the controller 300 determines that the sensed room temperature is equal to or higher than the predetermined temperature in operation 421, the controller 300 may increase the RPM of the at least one lower blower fan 32*d*, in operation 431. If the controller 300 determines that the sensed room temperature is lower than the predetermined temperature, the controller 300 may decrease the RPM of the at least one lower blower fan 32*d*, in operation 426. If the RPM of the at least one lower blower fan 32*d* increases, the amount of air discharged through the second outlet hole 53 may increase so that the user can feel high velocity of wind. In contrast, if the RPM of the at least one lower blower fan 32*d* decreases, the amount of air discharged through the second outlet hole 53 may decrease so that the user can feel low velocity of cool air.

Details about the configurations and effects for the control methods of the air conditioner 1 as shown in FIGS. 20A and 20B have been described above with reference to FIGS. 17 to 19, and accordingly, further descriptions thereof will be omitted.

Figure 21:
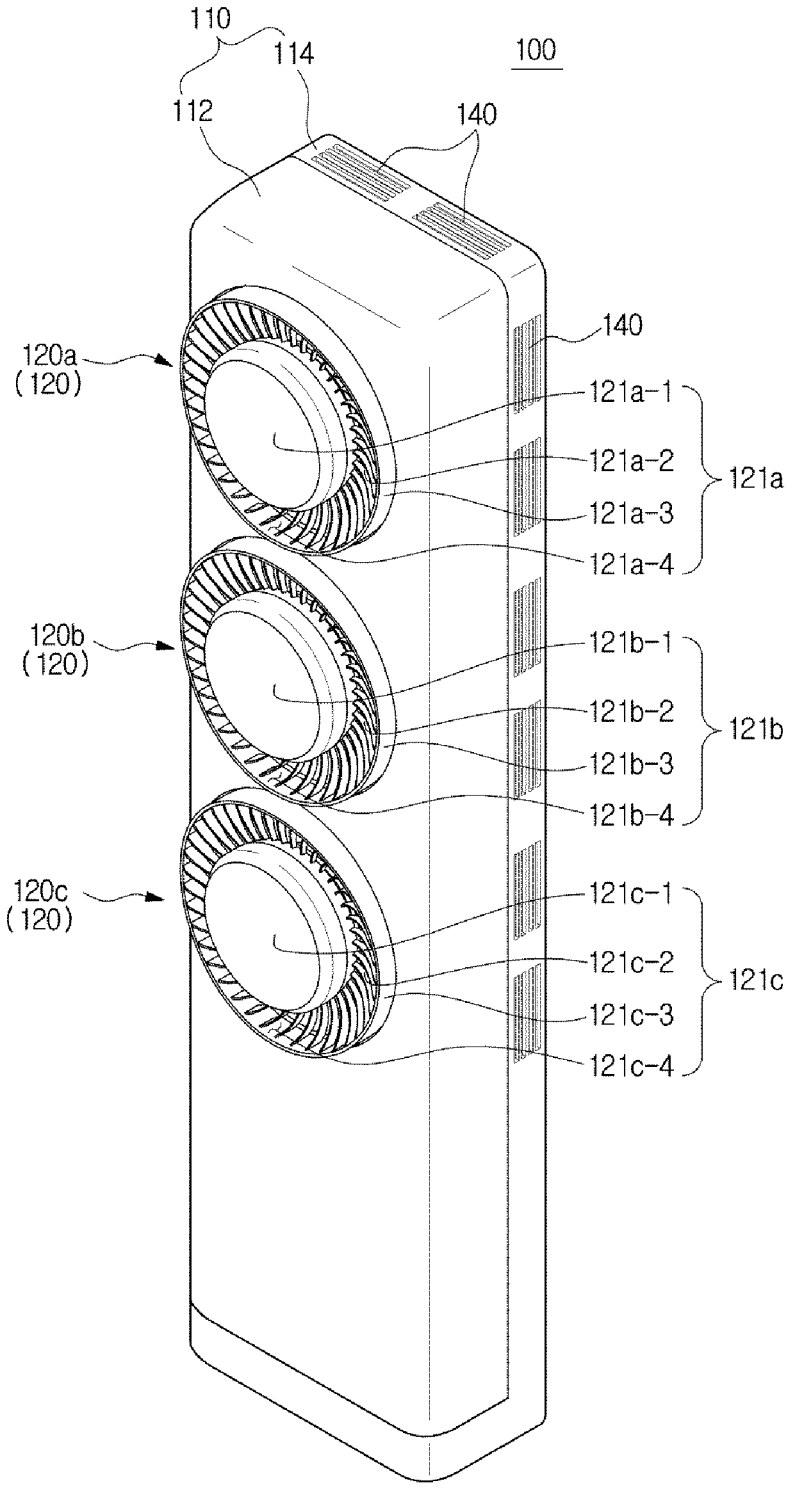
FIG. 21 shows an indoor unit of an air conditioner according to an embodiment of the present disclosure.
Figure 22:
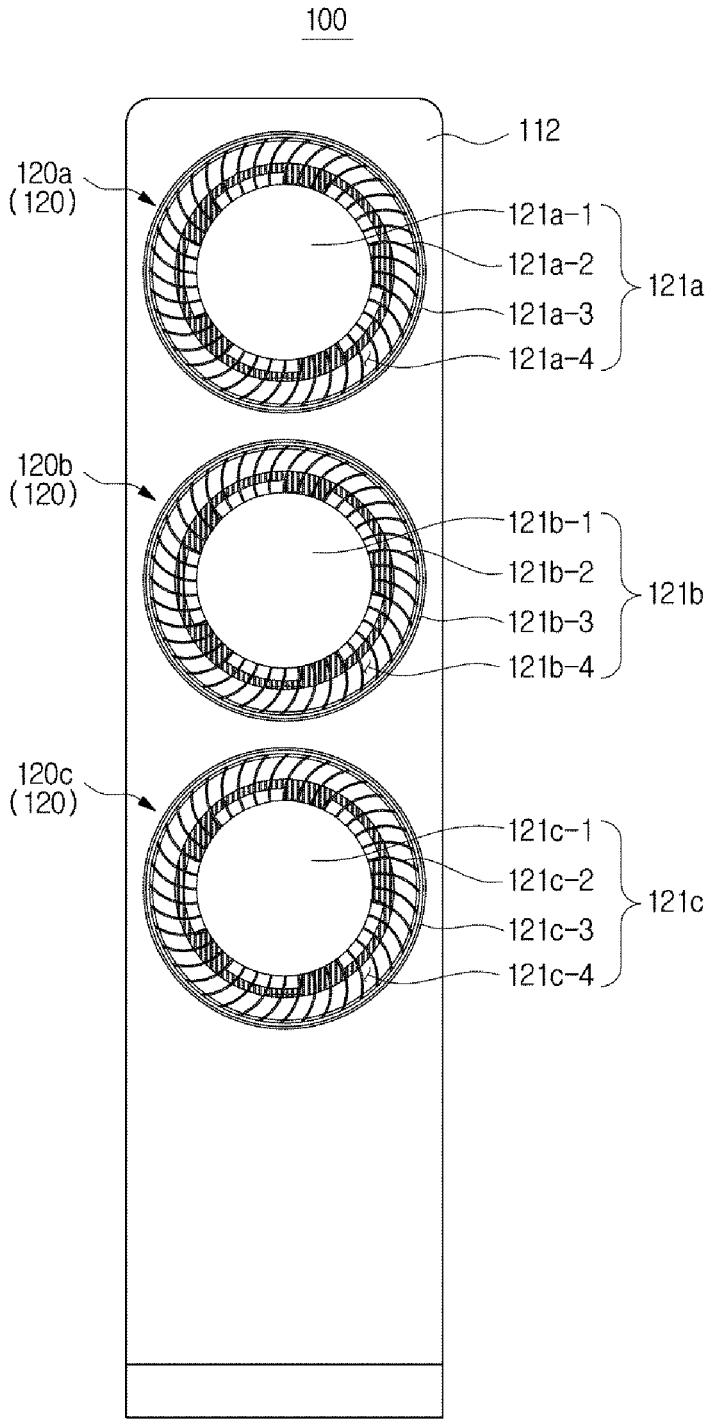
FIG. 22 shows a front side of the indoor unit shown in FIG. 21.
Figure 23:
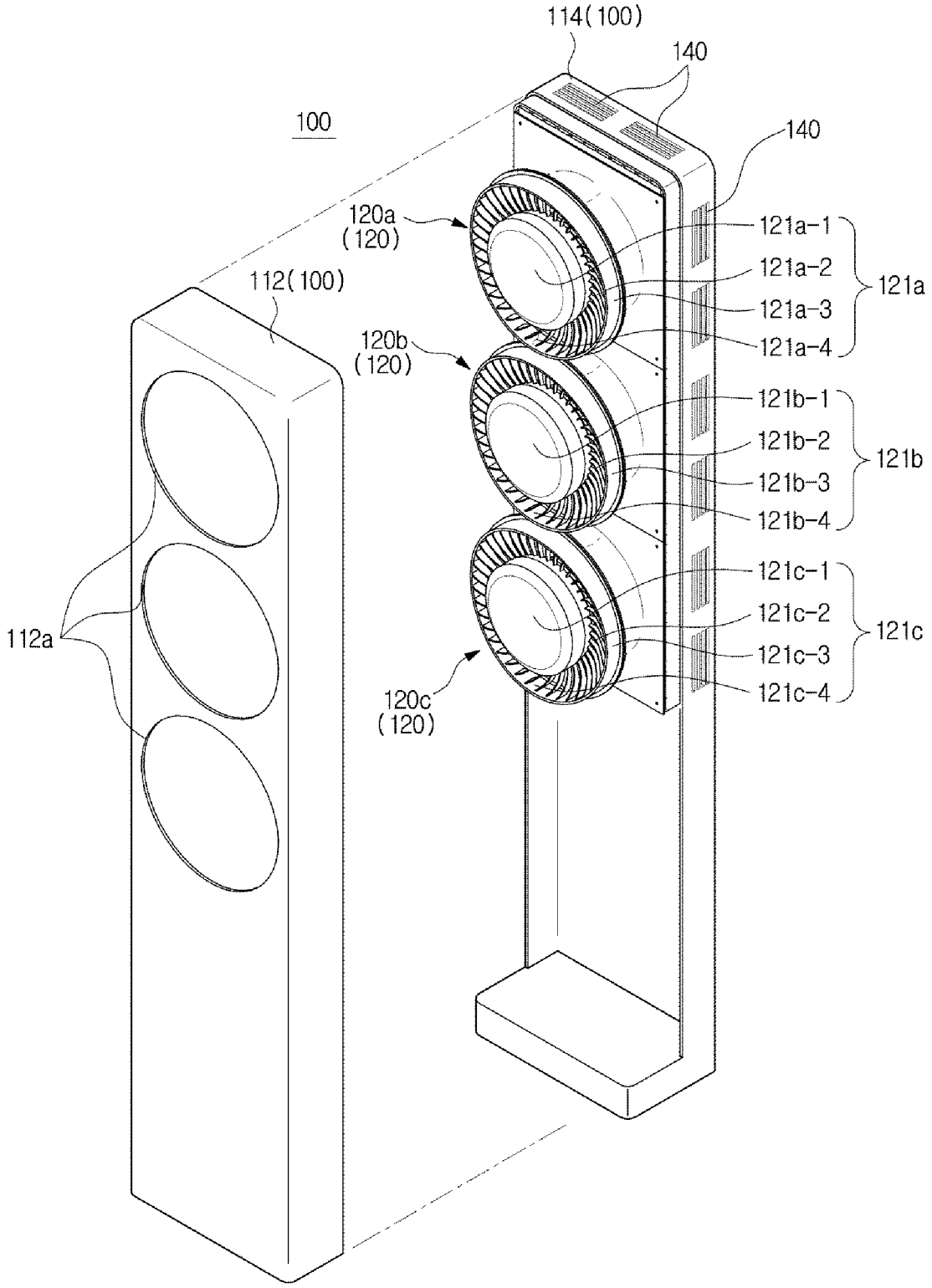
FIG. 23 shows a state of when a front panel of the indoor unit shown in FIG. 21 is separated.
Figure 24:
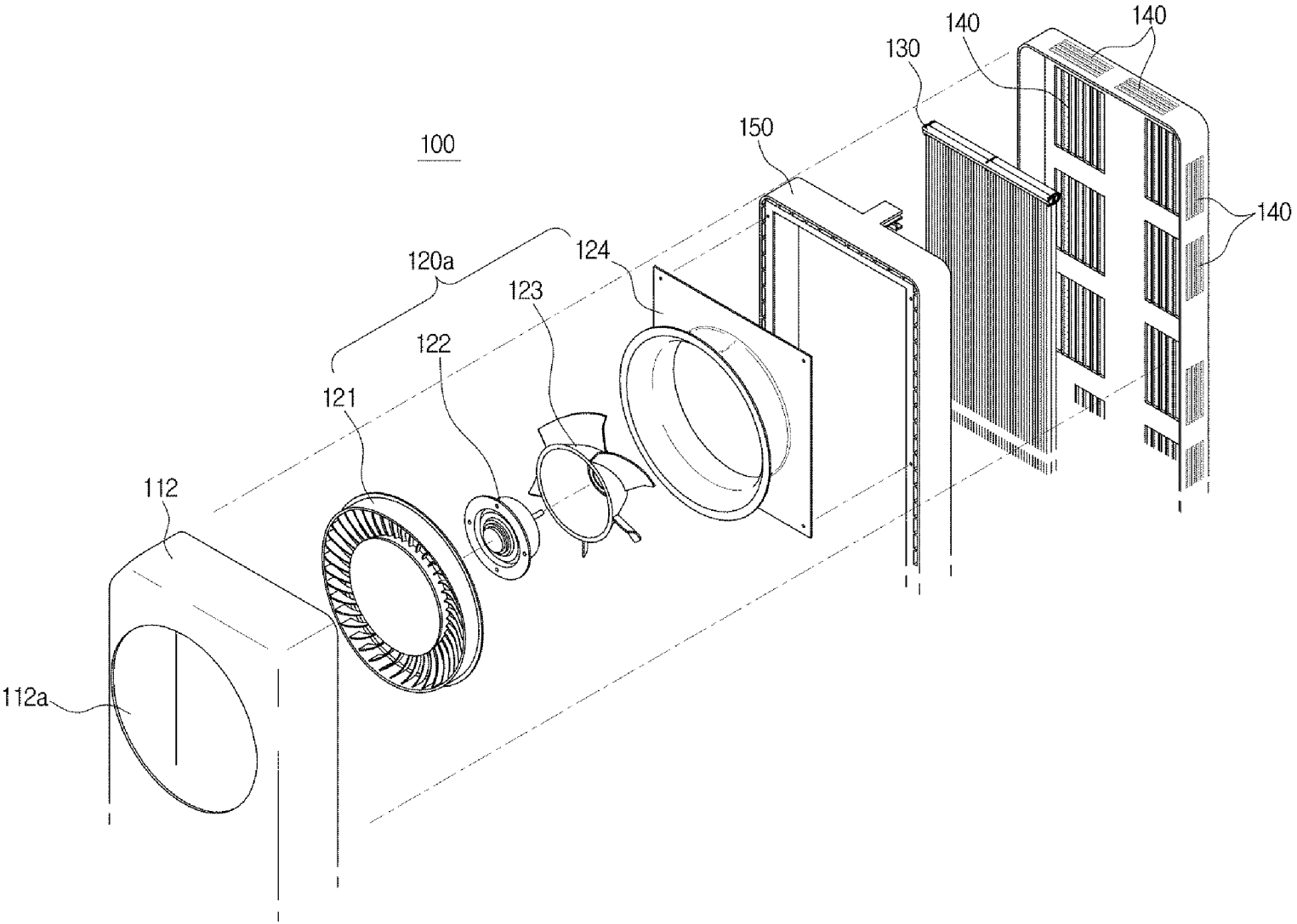
FIG. 24 is an exploded perspective view of a part of the indoor unit shown in FIG. 21.
Figure 25:
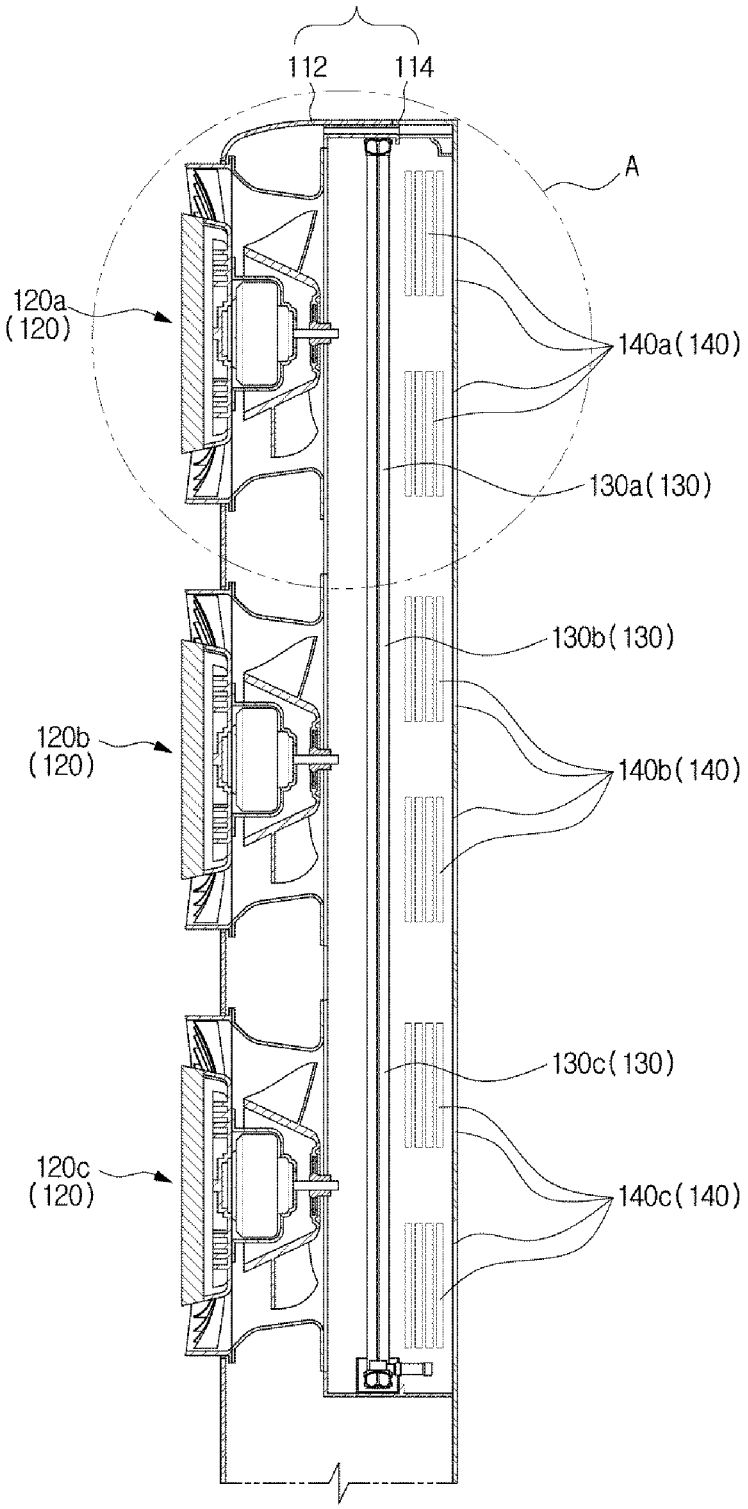
FIG. 25 is a cross-sectional view of the indoor unit shown in FIG. 21.
Figure 26:
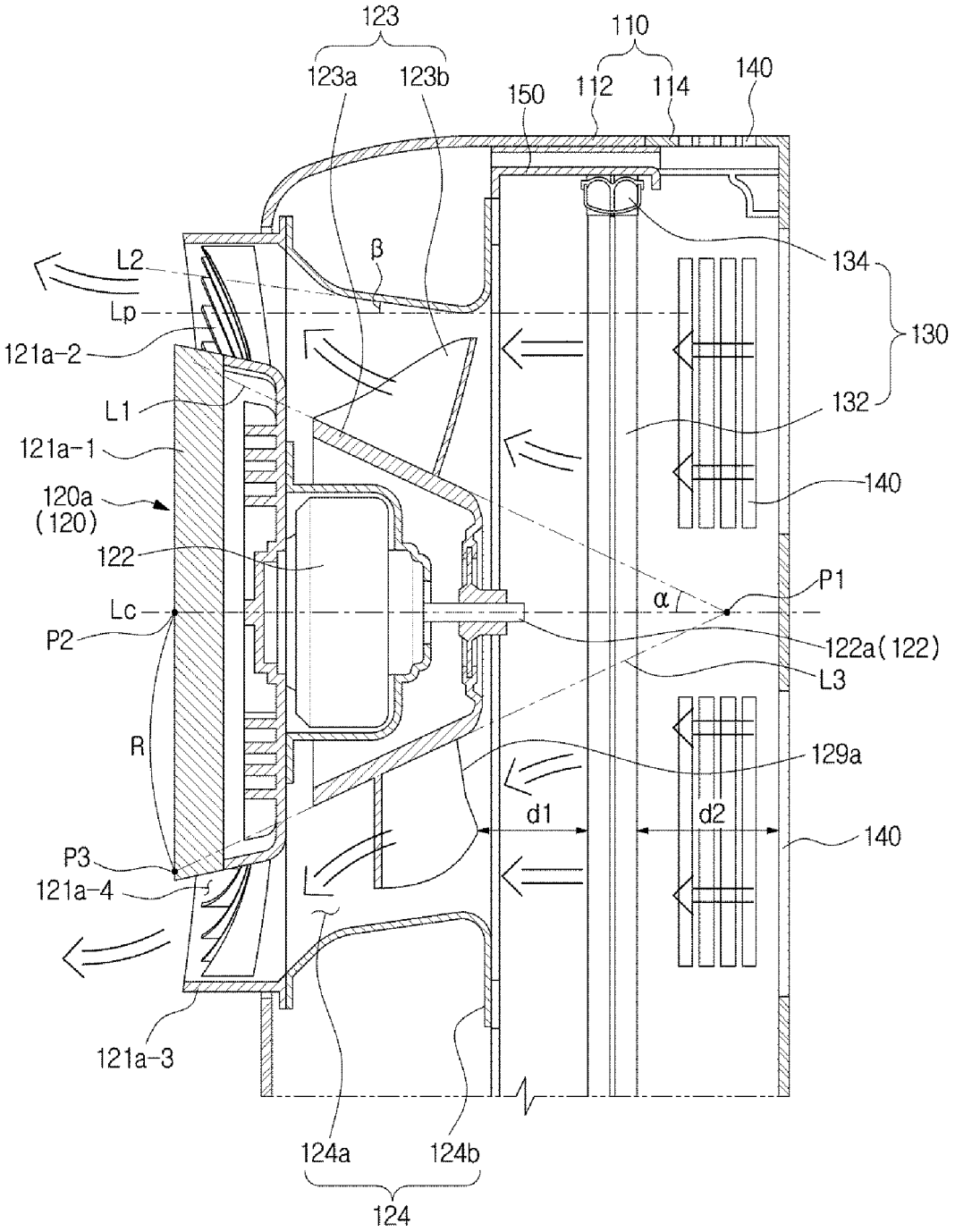
FIG. 26 is an enlarged view of an area "A" of FIG. 25.

FIG. 21 shows an indoor unit of an air conditioner according to an embodiment of the present disclosure, FIG. 22 shows a front side of the indoor unit shown in FIG. 21, FIG. 23 shows a state of when a front panel of the indoor unit shown in FIG. 21 is separated, FIG. 24 is an exploded perspective view of a part of the indoor unit shown in FIG. 21, FIG. 25 is a cross-sectional view of the indoor unit shown in FIG. 21, and FIG. 26 is an enlarged view of an area "A" of FIG. 25.

As shown in FIGS. 21 to 26, an indoor unit 100 of an air conditioner may include: a housing 110 forming an outer appearance of the indoor unit 100; a plurality of blower fan units 120 disposed in the inside of the housing 110; at least one heat exchanger 130 disposed behind the plurality of blower fan units 120 in the inside of the housing 110; and a plurality of inlets 140 formed in the rear surface of the housing 110.

The housing 110 may include a front panel 112 having a plurality of openings 112*a* to expose an outlet 121*a*-4 of each blower fan unit 120 in the front direction, and a rear panel 114 coupled with the rear portion of the front panel 112. Each of the plurality of openings 112*a* may be in the shape of a circle, and at least two or more openings 112*a* may be arranged at predetermined intervals in the up-down direction of the front panel 112. Although not shown in the drawings, in the front panel 112, a plurality of fine openings having a smaller size than the opening 112*a* may be further formed, in addition to the opening 112*a* corresponding to the outlet 121*a*-4. The fine openings may correspond to the outlet hole 50 mentioned in the above-described embodiments. The fine openings may be formed in the lower portion of the front panel 112 below the opening 112*a* corresponding to the outlet 121*a*-4, or in the entire area of the front panel 112. The sizes or shapes of the fine openings do not need to be the same.

The blower fan unit 120 may include a diffuser 121 forming the outlet 121*a*-4, a driving motor 122 coupled with the rear part of the diffuser 121, a blower fan 123 rotatably coupled with the driving motor 122, and a duct 124 coupled with the rear surface of the diffuser 121 and forming a flow path through which air moves when air drawn by the blower fan 123 is discharged through the outlet 121*a*-4.

The diffuser 121 may include a circular disk plate 121*a*-1, a circular grill 121*a*-2 coupled with the outer circumference of the disk plate 121*a*-1, and the outlet 121*a*-4 formed between the disk plate 121*a*-1 and the grill 121*a*-2, and having a ring shape. The diffuser 121 may be disposed in front of the blower fan 123 to discharge air passed through the blower fan 123 in the front direction of the front panel 112 through the outlet 112*a*. Also, the disk plate 121*a*-1 may include a door element (not shown) for opening or closing space between the disk plate 121*a*-1 and the grill 121*a*-2 through which air is discharged. The door element may extend in a radial direction from the disk plate 121*a*-1.

As shown in the drawings, the disk plate 121*a*-1 may be disposed in the center of the circular grill 121*a*-2. However, the location of the disk plate 121*a*-1 is not limited to the center of the circular grill 121*a*-2. The diameter of the disk plate 121*a*-1 may relate to noise generated when air is discharged from the indoor unit 100 of the air conditioner, and may be within the range of approximately 225 mm to 265 mm. Also, as not shown in the drawings, the disk plate 121*a*-1 and the grill 121*a*-2 may be movable forward or backward in a direction in which air is discharged from the indoor unit 100.

The grill 121*a*-2 may include a plurality of blade plates. By changing the number, shape, or arrangement of the blade plates, it is possible to adjust the wind direction and wind volume of air that is discharged through the outlet 121*a*-4.

Also, by adjusting the width of space between the disk plate 121*a*-1 and the grill 121*a*-2 through the door element to increase or decrease the width in radius direction of the outlet 121*a*-4, it is possible to adjust the wind direction and wind volume of air that is discharged through the outlet 121*a*-4, and by adjusting the diameter of the disk plate 121*a*-1, it is possible to adjust the wind direction and wind volume of air that is discharged through the outlet 121*a*-4.

The driving motor 122 may be coupled with the rear surface of the disk plate 121*a*-1 such that a rotation shaft 122*a* of the driving motor 122 is aligned towards the rear panel 114, to rotate the blower fan 123.

The blower fan 123 may be disposed between the diffuser 121 and the heat exchanger 130 to intake air heat-exchanged in the heat exchanger 130 and discharge the air through the outlet 121*a*-4. The blower fan 123 may include a hub 123*a* coupled with the rotation shaft 122*a* of the driving motor 122, and a plurality of blades 123*b* coupled with the outer circumference of the hub 123*a*.

The diameter of the hub 123*a* may be gradually reduced in a direction in which the rotation shaft 122*a* of the driving motor 122 extends, that is, in a direction towards the rear panel 114. Accordingly, the outer circumference surface of the hub 123*a* may be inclined. An angle $\alpha$ formed between a tangent line L1 or L3 meeting the inclined outer circumference surface of the hub 123*a* and an imaginary line Lc passing the center of the rotation shaft 122*a* of the driving motor 122 may be between approximately 10° and 40° so that the drawn air can be diagonally discharged towards the outlet 121*a*-4 by the blower fan 123.

If a point which the tangent line L1 or L3 meeting the inclined outer circumference surface of the hub 123*a* meets the imaginary line Lc is referred to as P1, a point at which a straight line extending from the point P1 meets the center of the disk plate 121*a*-1 is referred to as P2, a point at which the tangent line L1 or L3 meeting the inclined outer circumference surface of the hub 123*a* meets the disk plate 121*a*-1 or an extended area of the disk plate 121*a*-1 is referred to as P3, and a distance between the point P2 and the point P3 is referred to as R, the radius of the disk plate 121*a*-1 may be within a range of −20% to +20% of R. According to the Coanda effect, air may flow along the surface of the disk plate 121*a*-1. Accordingly, it is possible to suppress the generation of a swirl due to flow of air on the front surface of the outlet 121*a*-4. If the radius of the disk plate 121*a*-1 is within the range of −20% to +20% of R, the outer appearance of the indoor unit 100 can be improved, and the performance of the indoor unit 100 also can be improved by suppressing the generation of a swirl on the front surface of the outlet 121*a*-4.

At least three blades 123*b* may be arranged at equal intervals along the outer circumference surface of the hub 123*a*. The blades 123*b* may form pressure gradient in the front and back direction of the blower fan 123 when rotating together with the hub 123*a* to thus form constant flow of air.

Circular arcs connecting both edges of the blades 123*b* may be two circular arcs having different radiuses of curvatures. A border of a first circular arc and a second circular arc may be located on the rear surface of the corresponding blade 123*b* rather than the center of the blade 123*b*. Accordingly, a delamination area in which the flow of air flowing along the surfaces of the blades 123*b* is delaminated may be reduced rather than when the border of the first circular arc and the second circular arc is located on the center of the blade 123*b* or on the front surface of the blade 123*b*. Accordingly, it is possible to prevent the performance of the indoor unit 100 from deteriorating due to such delamination, resulting in reduction of noise.

If the shortest distance between one ends of the blades 123*b* and the heat exchanger 130 disposed behind the blower fan unit 120 is "d1", the shortest distance d1 may be between 20 mm and 50 mm. If the shortest distance d1 is shorter than 20 mm, the space between the blower fan 123 and the heat exchanger 130 may become narrow to generate inlet flow resistance and increase driving noise. In contrast, if the shortest distance d1 exceeds 50 mm, the space between the blower fan 123 and the heat exchanger 130 may become wide so that air heat-exchanged through the heat exchanger 130 may not be able to be smoothly drawn into the blower fan 123.

Also, if the shortest distance between the heat exchanger 130 and the inlet 140 is "d2", the shortest distance d2 may be between 40 mm and 60 mm.

The duct 124 may be in the shape of a circle surrounding the blower fan 123. The duct 124 may include a flow path forming pipe 124*a* forming a flow path of air to make air drawn by the blower fan 123 flow to the outlet 121*a*-4, and a fixing plate 124*b* connected to the flow path forming pipe 124*a* behind the flow path forming pipe 124*a* and fixing the duct 124 to the housing 110.

The lateral side of the flow path forming pipe 124*a* may be inclined so that drawn air can be diagonally discharged towards the outlet 121*a*-4 by the blower fan 123 together with the hub 123*a*, wherein an angle of a tangent line L2 meeting the lateral side of the flow path forming pipe 124*a* with respect to a line Lp parallel to an imaginary line passing the center of rotation of the blower fan 123 may be between 5° and 15°.

The diffuser 121 may be coupled with and fixed at the entrance of the flow path forming pipe 124*a*, and the duct 124 may be coupled with and fixed at the fixing frame 150 through the fixing plate 124*b* in the shape of a quadrangle.

The heat exchanger 130 may be disposed between the blower fan unit 120 and the inlet 140, and absorb heat from air drawn through the inlet 140 or transfer heat to air drawn through the inlet 140. The heat exchanger 130 may include a tube 132, and a header 134 coupled with the upper and lower portions of the tube 132.

In the inside of the indoor unit 100, one or more heat exchangers 130 may be installed. That is, a plurality of heat exchangers 130 corresponding to the number of the plurality of blower fan units 120 may be installed behind the respective blower fan units 120. Alternatively, a single heat exchanger 130 having a size corresponding to the plurality of blower fan units 120 may be disposed. Also, the plurality of heat exchangers 130 may have different heat-exchange capacities. That is, one having a relatively small heat-exchange capacity of the plurality of heat exchangers 130 may be disposed behind the corresponding blower fan unit 120, and another one having a relatively great heat-exchange capacity of the plurality of heat exchangers 130 may be disposed behind the corresponding two or more blower fan units 120.

The inlet 140 may be formed in the rear panel 114 disposed behind the heat exchanger 130 to guide outside air to enter the inside of the indoor unit 100. The inlet 140 may be formed in at least one of the upper, side, and rear portions of the rear panel 114.

Like the heat exchanger 130, one or more inlets 140 may be formed in the rear panel 114. That is, a plurality of inlets 140 corresponding to the number of the plurality of blower fan units 120 may be formed in the rear panel 114. Alternatively, a single inlet 140 having a size corresponding to the entire of the plurality of blower fan units 120 may be formed in the rear panel 114. Also, the plurality of inlets 140 may have different sizes. That is, one of the plurality of inlets 140 may be disposed behind the corresponding blower fan unit 120, and another one of the plurality of inlets 140 may be disposed behind the corresponding two or more blower fan units 120.

As shown in FIG. 26, air drawn into the inside of the housing 110 through the inlet 140 may pass through the heat exchanger 130 to absorb or lose heat. The air heat-exchanged through the heat exchanger 130 may be drawn by the blower fan 123 and then discharged to the outside of the housing 110 through the duct 124 and the outlet 121*a*-4. At this time, an angle of a direction of air drawn into the blower fan 123 with respect to a direction of air discharged through the outlet 121*a*-4 may be between approximately 15° and approximately 60°.

The indoor unit 100 according to an embodiment of the present disclosure may include the plurality of blower fan units 120, the heat exchanger 130, and the plurality of inlets 140. For convenience of description, as shown in FIG. 25, a structure in which the plurality of blower fan units 120 and the plurality of inlets 140 are arranged in the longitudinal direction of the indoor unit 100 will be described as an example.

The plurality of blower fan units 120 may include a first blower fan unit 120*a*, a second blower fan unit 120*b*, and a third blower fan unit 120*c* arranged at regular intervals in the longitudinal direction of the indoor unit 100. The plurality of inlets 140 may include a first inlet 140*a*, a second inlet 140*b*, and a third inlet 140*c* arranged at regular intervals in the longitudinal direction of the indoor unit 100 behind the heat exchanger 130.

As such, because the plurality of blower fan units 120*a*, 120*b*, and 120*c*, a plurality of heat exchangers 130*a*, 130*b*, and 130*c*, and the plurality of inlets 140*a*, 140*b*, and 140*c* respectively arranged in the longitudinal direction of the indoor unit 100 are arranged in a line in a front-rear direction, the indoor unit 100 can be slimmed, and a flow path between the inlets 140 and the outlet 121*a*-4 can be shortened, which leads to an improvement of the driving efficiency of the indoor unit 100 while reducing noise.

The first blower fan unit 120*a*, the second blower fan unit 120*b*, and the third blower fan unit 120*c* may be controlled to be turned on/off independently or to rotate at different velocities.

Hereinafter, a method of controlling an air conditioner having the above-described structure will be described in detail.

Figure 27:
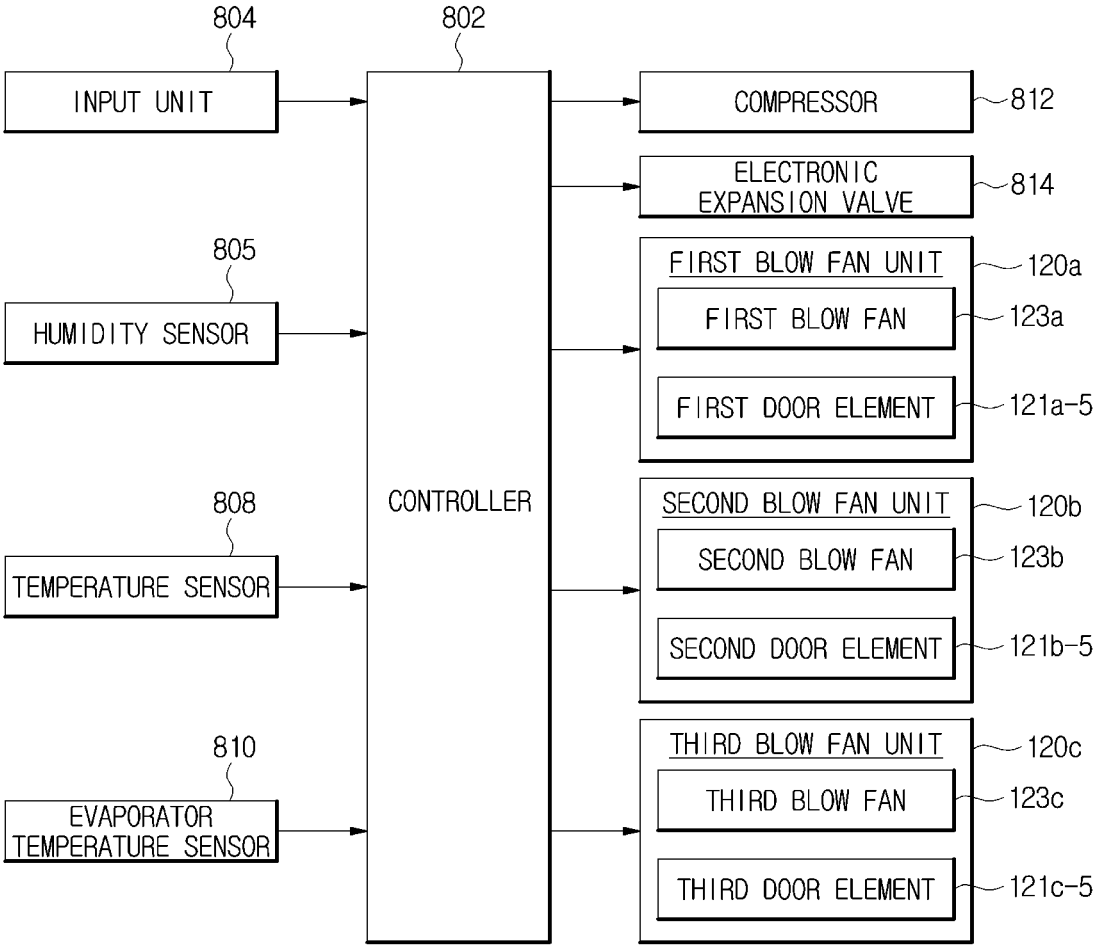
FIG. 27 is a control block diagram of an air conditioner according to an embodiment of the present disclosure.

FIG. 27 is a control block diagram of an air conditioner according to an embodiment of the present disclosure.

As shown in FIG. 27, an input unit 804 including a remote controller or a button(s) provided in the air conditioner, a humidity sensor 805 for sensing room humidity, a room temperature sensor 808 for sensing room temperature, and an evaporator temperature sensor 810 for sensing the temperature of a heat exchanger of an indoor unit may be electrically connected to an input side of a controller 802 of controlling overall operations of the air conditioner in such a way to communicate with each other, and a compressor 812, an electronic expansion valve 814, a first blower fan unit 120*a*, a second blower fan unit 120*b*, and a third blower fan unit 120*c* may be electrically connected to an output side of the controller 802 in such a way to communicate with each other.

The controller 802 may transfer a control command to the compressor 812 and the electronic expansion valve 814 according to an operation mode selected by a user through the input unit 804, and control turning-on/off and RPMs of the first blower fan unit 120*a*, the second blower fan unit 120*b*, and the third blower fan unit 120*c* according to the selected operation mode.

The input unit 804 may include a button to enable the user to input a dehumidification command. If a dehumidification command is input through the input unit 804, the controller 802 may drive the compressor 812 to lower the temperature of the heat exchanger to dew point temperature or lower in order to perform dehumidification. The controller 802 may determine whether the temperature of the heat exchanger becomes equal to or lower than the dew point temperature, based on temperature sensed by the evaporator temperature sensor 810. Air containing moisture drawn through the inlet of the indoor unit may pass through the heat exchanger cooled to the dew point temperature or lower so that the temperature of the air is lowered. If the temperature of the air becomes equal to or lower than the dew point temperature, the moisture in the air may change to water to be removed from the air, and the air containing no moisture may be discharged to indoor space by the blower fan 123. Through the process, room humidity may be lowered. The air conditioner may operate the compressor 812 to circulate refrigerants, and drive the blower fan 123 so that room humidity is included in a predetermined range of humidity in which a user can feel pleasant.

Unlike a typical dehumidifier, the dehumidification of the air conditioner may accompany cooling. If a user wants to perform only the dehumidification function without performing the cooling function, the dehumidification function accompanying cooling may cause the user's dissatisfaction. Accordingly, the air conditioner according to the current embodiment may provide a dehumidification function accompanying a cooling function lowered to a predetermined level. This will be described in detail, below.

If a dehumidification command is input through the input unit 804, the controller 802 may output control signals for controlling operations of the compressor 812, the electronic expansion valve 814, and the blower fan 123, so that room humidity sensed by the humidity sensor 805 and room temperature sensed by the room temperature sensor 808 can reach a target humidity range (for example, a range of 40% to 70%) and a target temperature range (for example, a range of 22° C. to 26° C.). Alternatively, the controller 802 may output control signals for controlling operations of the compressor 812, the electronic expansion valve 814, and the blower fan 123, so that the room humidity and the room temperature can reach a target humidity value or a target temperature value input by the user.

The air conditioner according to the current embodiment may provide various dehumidification modes. For example, the air conditioner may support a first dehumidification mode for enabling current room humidity to reach a target humidity range more quickly than in a normal dehumidification mode, a second dehumidification mode for reducing the cooling effect accompanied by dehumidification while reducing consumption power although taking a longer time than in the first dehumidification mode, and a third dehumidification mode for consuming larger power than in the second dehumidification mode and smaller power than in the first dehumidification mode while taking a longer time than in the first dehumidification mode and a shorter time than in the second dehumidification mode. In order to execute such various dehumidification modes, the input unit 804 may include buttons corresponding to the respective dehumidification modes. Also, the air conditioner according to the current embodiment may include a fourth dehumidification mode to automatically combine the above-described dehumidification modes in correspondence to a change in room temperature, room humidity, or consumption power, and the input unit 804 may include a button for executing the fourth dehumidification mode. However, the above-described dehumidification modes may be only examples, and more various dehumidification modes that can be created in consideration of a time taken for dehumidification, consumption power, reduction of the cooling effect, etc. can be included in the current embodiment.

The controller 802 may calculate an amount of circulating refrigerants according to a difference between current room humidity and the target humidity range, and a dehumidification mode input by a user, and output a control signal for controlling the compressor 812 according to the amount of circulating refrigerants. Also, the controller 802 may output a control signal for controlling a degree of opening of the electronic expansion valve 814 according to the calculated amount of circulating refrigerants and the dehumidification mode.

For example, if the fourth dehumidification mode is selected through the input unit 804, the controller 802 may control the compressor 812 and the electronic expansion valve 814, and drive all of the first blower fan 123*a*, the second blower fan 123*b*, and the third blower fan 123*c* so that room humidity and room temperature can reach the target humidity range and the target temperature range in a short time. That is, if the fourth dehumidification mode is selected, the air conditioner may perform dehumidification according to the first dehumidification mode during an initial period of dehumidification. At this time, an amount of circulating refrigerants may be controlled to be equal to or greater than a target value a1, a degree of opening of the electronic expansion valve 814 may also be controlled to be equal to or greater than a target value b1, and RPMs of the first to third blower fans 123*a*, 123*b*, and 123*c* may also be controlled to be equal to or greater than a target value c1.

The humidity sensor 805 may sense a change in room humidity in real time, and the controller 802 may also determine whether room humidity reaches the target humidity range, based on the result of the sensing by the humidity sensor 805. If the controller 802 determines that the room humidity reaches the target humidity range, the controller 802 may stop driving the compressor 812.

If the controller 802 determines that room humidity deviates from the target humidity range, the controller 802 may control the compressor 812 and the electronic expansion valve 814 so that room temperature can again reach the target humidity range. In this case, there is high probability that a difference between the room humidity and the target humidity range is smaller than when dehumidification is initially performed. Accordingly, when room humidity deviates from the target humidity range, dehumidification may be performed with higher priority to save power than to shorten a time taken for dehumidification, under the assumption that a difference between the room temperature and the target humidity range is not great. That is, the air conditioner may perform dehumidification according to the second dehumidification mode after room humidity reaches the target humidity range.

Upon dehumidification according to the second dehumidification mode, the controller 802 may control driving of the compressor 812 to circulate an amount a2 (a2=a1−q) of refrigerants (or less) reduced by a predetermined amount q from an amount a1 of refrigerants of the first dehumidification mode. In order to compensate the reduced amount of circulating refrigerants, the controller 802 may control the electronic expansion valve 814 so that a degree of opening of the electronic expansion valve 814 becomes a degree b2 (b2=b1−d) of opening (or less) reduced by a predetermined value d from a degree b1 of opening in the first dehumidification mode.

Until a dehumidification finish command is received, the controller 802 may repeat operations of stopping driving the compressor 812 if room humidity enters the target humidity range and of driving the compressor 812 if room humidity deviates from the target humidity range. Alternatively, until a command for finishing dehumidification is received, the controller 802 may continue to control the compressor 812 and the electronic expansion valve 814 such that room humidity does not deviate from the target humidity range.

Also, if room temperature enters the target temperature range, the controller 802 may stop driving a part of the first to third blower fans 123*a* to 123*c*, and if room temperature becomes equal to or lower than the lower limit of the target temperature range, the controller 802 may drive only any one of the first to third blower fans 123*a* to 123*c*, or stop driving all of the first to third blower fans 123*a* to 123*c*. For example, if room temperature enters the target temperature range, the controller 802 may stop driving the third blower fan 123*c* of the first to third blower fans 123*a* to 123*c*, and control a third door element 121*c*-5 to close the third outlet. If room temperature becomes equal to or lower than the lower limit of the target temperature range, the controller 802 may drive only the first blower fan 123*a*, and control a second door element 121*b*-5 and a third door element 121*c*-5 to close the second outlet and the third outlet. Or, as described above, the controller 802 may stop driving all of the first to third blower fans 123*a*, 123*b*, and 123*c*, and close all of the outlets.

Also, when the second dehumidification mode is performed, as described above, the controller 802 may select a blower fan 123 which it is to drive according to room temperature, and drive the selected blower fan 123 at RPM c2 (c2=c1−r) (or less) reduced by a predetermined value r from RPM c1 of the first dehumidification mode.

The RPM of the blower fan 123 may be decided as RPM at which a user can little feel cool air discharged from the air conditioner, through a test. That is, the air conditioner according to the current embodiment may lower the RPM of the blower fan 123 to a predetermined level in the second dehumidification mode so that the user can little feel cooling accompanied by the dehumidification function, because room temperature as well as room humidity reaches the target temperature range through dehumidification according to the first dehumidification mode. In this case, the controller 802 may control the door elements 121*a*-5, 121*b*-5, and 121*c*-5 of the blower fan units 120*a*, 120*b*, and 120*c* to close all of the outlets, so that air can be discharged only through the fine openings formed in the front panel. Although the wind volume or wind velocity of discharged air is already reduced because the RPM of the blower fan 123 is lowered, the controller 802 may adjust the door elements 121*a*-5, 121*b*-5, and 121*c*-5 to close the outlets, thereby further lowering a level of cool air that the user can feel.

According to an example, if the second dehumidification mode is selected through the input unit 804, the controller 802 may reduce an amount of circulating refrigerants rather than when executing the first dehumidification mode, because it gives higher priority to save power than to shorten a time taken for dehumidification. That is, if the second dehumidification mode is selected, the controller 802 may control driving of the compressor 812 to circulate the amount of refrigerants a2 (a2=a1−q) (or less) reduced by the predetermined amount q from the amount a1 of refrigerants of the first dehumidification mode. In order to compensate the reduced amount of circulating refrigerants, the controller 802 may control the electronic expansion valve 814 so that a degree of opening of the electronic expansion valve 814 becomes the degree b2 (b2=b1−d) of opening (or less) reduced by the predetermined value d from the degree b1 of opening in the first dehumidification mode.

The humidity sensor 805 may sense a change in room humidity in real time, and the controller 802 may determine whether room humidity reaches a target humidity range, based on the result of the sensing by the humidity sensor 805. If the controller 802 determines that room temperature reaches the target humidity range, the controller 802 may stop driving the compressor 812.

If the controller 802 determines that room humidity deviates from the target humidity range, the controller 802 may control the compressor 812 and the electric expansion valve 814 so that room temperature can again reach the target humidity range. In this case, the air conditioner may also perform dehumidification according to the second dehumidification mode.

Until a command for finishing dehumidification is received, the controller 802 may repeat operations of stopping driving the compressor 812 if room humidity enters the target humidity range and of driving the compressor 812 if room humidity deviates from the target humidity range. Alternatively, until a command for finishing dehumidification is received, the controller 802 may continue to control the compressor 812 and the electronic expansion valve 814 such that room humidity does not deviate from the target humidity range.

Also, if the second dehumidification mode is selected, the controller 802 may drive the blower fan 123 at the RPM c2

(c2=c1−r) (or less) reduced by the predetermined value r from the RPM c1 of the blower fan 123 in the first dehumidification mode.

The RPM of the blower fan 123 may be decided as RPM at which a user cannot feel cool air discharged from the air conditioner, through a test. That is, the air conditioner according to the current embodiment may lower the RPM of the blower fan 123 to a predetermined level in the second dehumidification mode so that the user cannot feel cooling accompanied by the dehumidification function. In this case, the controller 802 may control the door elements 121*a*-5, 121*b*-5, and 121*c*-5 of the blower fan units 120*a*, 120*b*, and 120*c* to close all of the outlets, so that air can be discharged only through the fine openings formed in the front panel. Although the wind volume or wind velocity of discharged air is already reduced because the RPM of the blower fan 123 is lowered, the controller 802 may adjust the door elements 121*a*-5, 121*b*-5, and 121*c*-5 to close the outlets, thereby further lowering a level of cool air that the user can feel. According to an example, if the fourth dehumidification mode is selected through the input unit 804, the controller 802 may control the compressor 812 and the electronic expansion valve 814 so that room humidity can reach the target humidity range. In this case, the controller 802 may control the compressor 812 and the electric expansion valve 814 like when dehumidification is performed according to the first dehumidification mode. At this time, an amount of circulating refrigerants may be controlled to be equal to or greater than the target value a1, and a degree of opening of the electronic expansion valve 814 may also be controlled to be equal to or greater than the target value b1.

However, the controller 802 may drive at least one blower fan of the first to third blower fans 123*a* to 123*c*, at RPM reduced to a predetermined level according to the second dehumidification mode, not the first dehumidification mode. That is, the controller 802 may drive at least one blower fan 123 of the first to third blower fans 123*a* to 123*c*, at RPM c2 (c2=c1−r) (or less) reduced by the predetermined value r from the RPM c1 of the first dehumidification mode.

According to the current embodiment, by driving the blower fan 123 at RPM reduced to a predetermined level at which a user can little feel cooling accompanied by dehumidification from when the dehumidification function starts to be executed, a wind volume discharged from the air conditioner can be reduced. Also, in this case, the controller 802 may control the door elements 121*a*-5, 121*b*-5, and 121*c*-5 of the blower fan units 120*a*, 120*b*, and 120*c* to close all outlets, so that air can be discharged only through the fine openings formed in the front panel. Although the wind volume or wind velocity of discharged air is already reduced because the RPM of the blower fan 123 is lowered, the controller 802 may adjust the door elements 121*a*-5, 121*b*-5, and 121*c*-5 to close the outlets, thereby further lowering a level of cool air that the user can feel.

Also, until room temperature reaches the target temperature range, the controller 802 may drive all of the first to third blower fans 123*a* to 123*c* at the RPM reduced to the predetermined level. If room temperature enters the target temperature range, the controller 802 may stop driving a part of the first to third blower fans 123*a* to 123*c*, and if room temperature becomes equal to or lower than the lower limit of the target temperature range, the controller 802 may drive only any one of the first to third blower fans 123*a* to 123*c* or stop driving all of the first to third blower fans 123*a* to 123*c*. For example, if room temperature enters the target temperature range, the controller 802 may stop driving the third blower fan 123*c* of the first to third blower fans 123*a* to 123*c*, and control the third door element 121*c*-5 to close the third outlet. If room temperature becomes equal to or lower than the lower limit of the target temperature range, the controller 802 may drive only the first blower fan 123*a*, and control the second door element 121*b*-5 and the third door element 121*c*-5 to close the second outlet and the third outlet. Or, as described above, the controller 802 may stop driving all of the first to third blower fans 123*a* to 123*c*, and close all of the outlets.

The humidity sensor 805 may sense a change in room humidity in real time, and the controller 802 may determine whether room humidity reaches the target humidity range, based on the result of the sensing by the humidity sensor 805. If the controller 802 determines that room temperature reaches the target humidity range, the controller 802 may stop driving the compressor 812.

If the controller 802 determines that room humidity deviates from the target humidity range, the controller 802 may control the compressor 812 and the electronic expansion valve 814 so that room humidity can again reach the target humidity range. In this case, there is high probability that a difference between the room humidity and the target humidity range is smaller than when dehumidification is initially performed. Accordingly, when the room humidity deviates from the target humidity range, dehumidification may be performed with higher priority to save power than to shorten a time taken for dehumidification, under the assumption that a difference between the room temperature and the target humidity range is not great. That is, the air conditioner may perform dehumidification according to the second dehumidification mode after room humidity reaches the target humidity range.

Upon dehumidification according to the second dehumidification mode, the controller 802 may control driving of the compressor 812 to circulate the amount a2 (a2=a1−q) of refrigerants (or less) reduced by the predetermined amount q from the amount a1 of refrigerants of the first dehumidification mode. In order to compensate the reduced amount of circulating refrigerants, the controller 802 may control the electronic expansion valve 814 so that a degree of opening of the electronic expansion valve 814 becomes the degree b2 (b2=b1−d) of opening (or less) reduced by the predetermined value d from the degree b1 of opening in the first dehumidification mode. Also, the controller 802 may select a blower fan 123 which it is to drive according to room temperature, and drive the selected blower fan 123 at the RPM c2 (c2=c1−r) (or less) reduced by the predetermined value r from the RPM c1 of the first dehumidification mode, as described above.

Until a command for finishing dehumidification is received, the controller 802 may repeat operations of stopping driving the compressor 812 if room humidity enters the target humidity range and of driving the compressor 812 if room humidity deviates from the target humidity range. Alternatively, until a command for finishing dehumidification is received, the controller 802 may continue to control the compressor 812 and the electronic expansion valve 814 such that room humidity does not deviate from the target humidity range.

Figure 28:
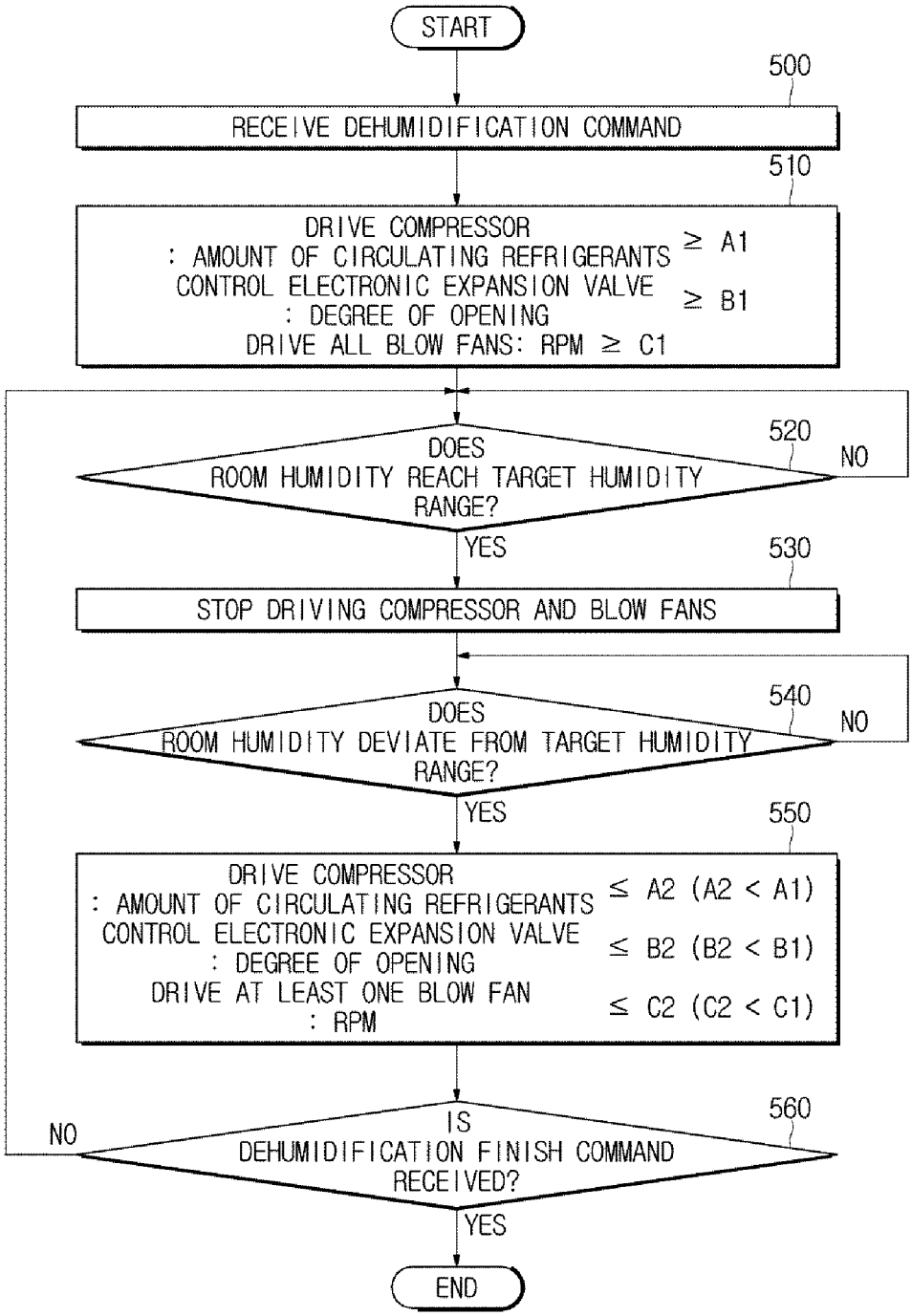
FIGS. 28, 29, and 30 are flowcharts illustrating methods of controlling an air conditioner, according to embodiments of the present disclosure.
Figure 29:
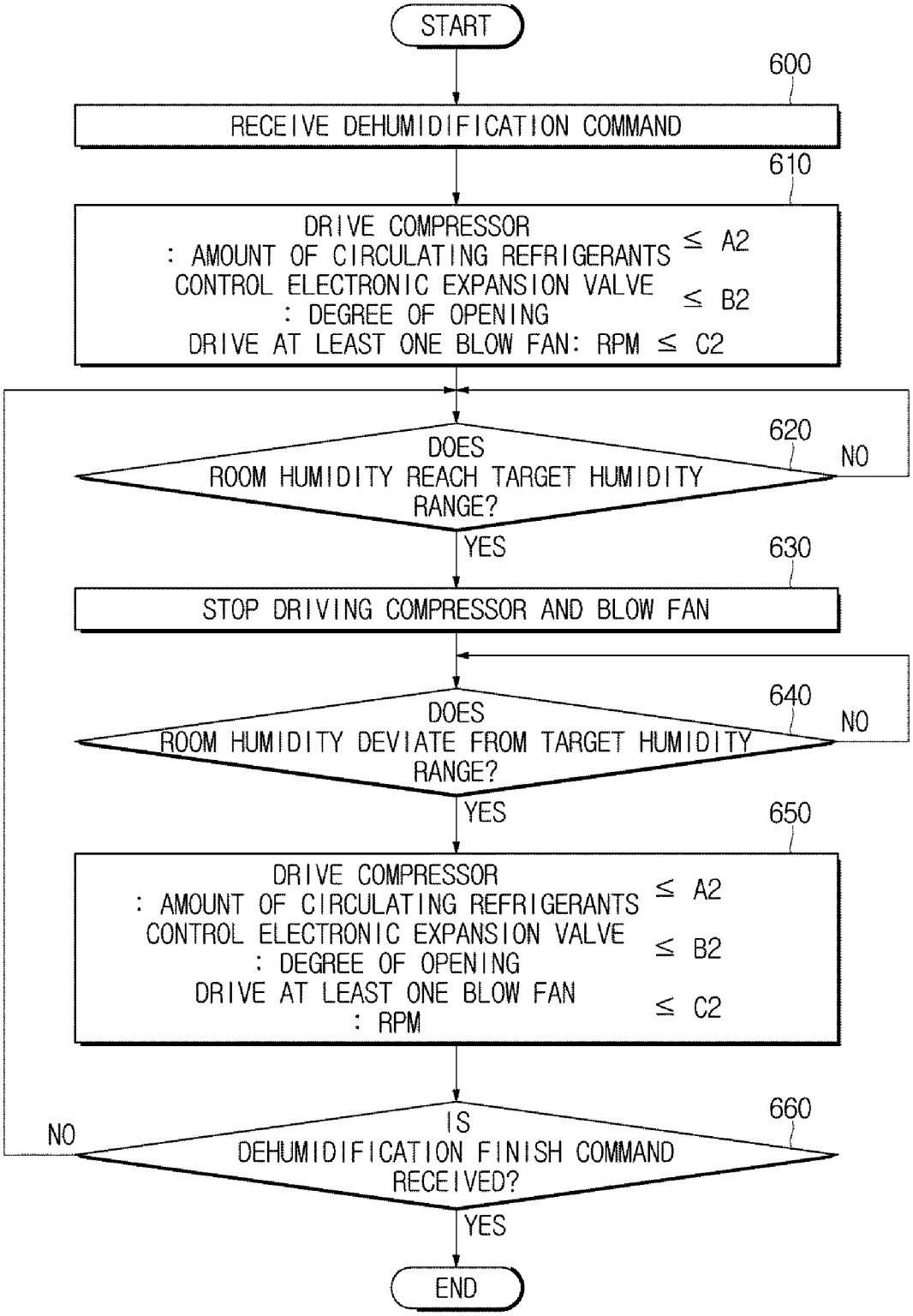
Figure 30:
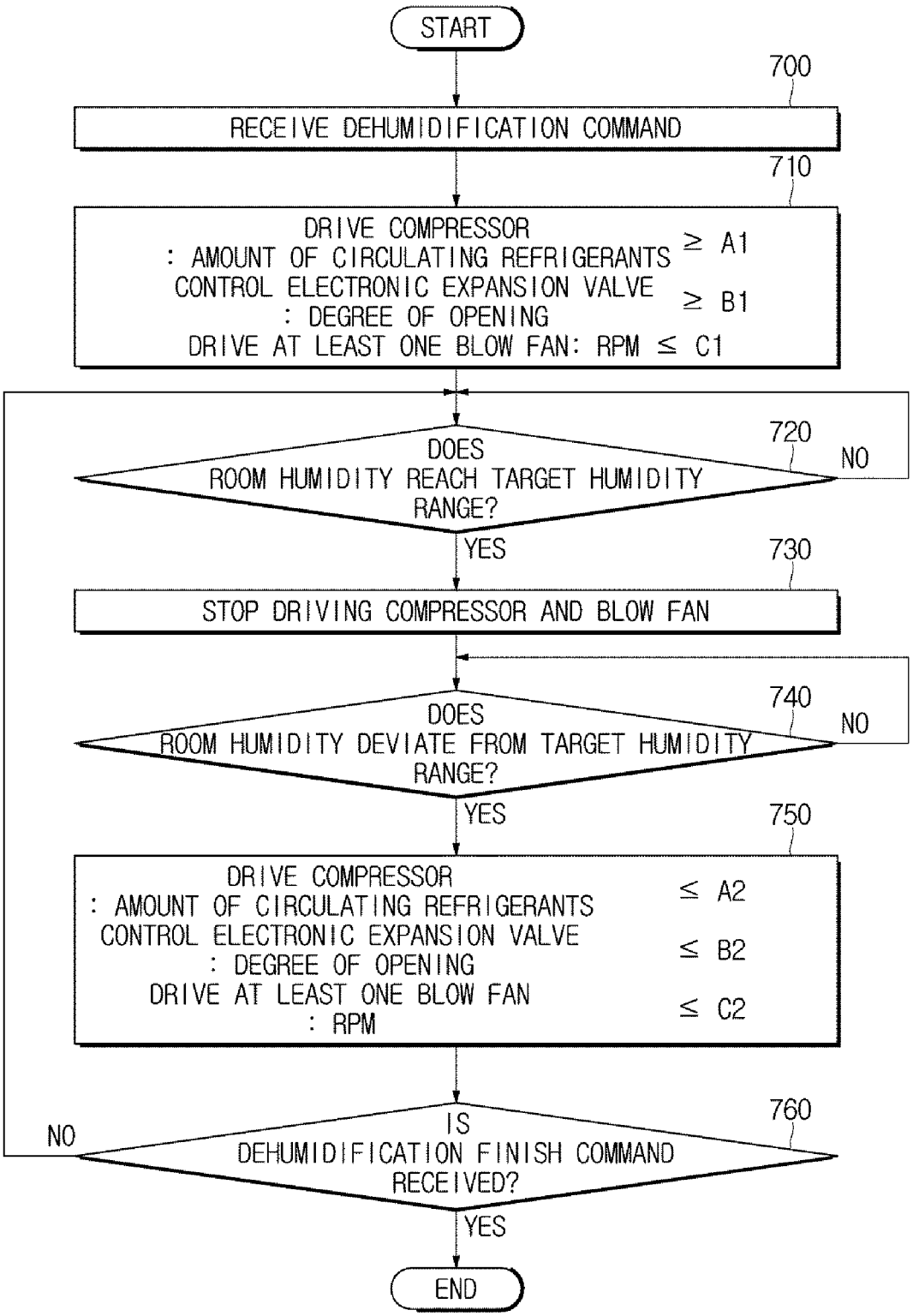

FIGS. 28, 29, and 30 are flowcharts illustrating methods of controlling an air conditioner, according to embodiments of the present disclosure.

Referring to FIGS. 27 and 28, if a dehumidification command is received through the input unit 804 in operation 500, the controller 802 of the air conditioner according to an embodiment of the present disclosure may control driving of the compressor 812 so that an amount of circulating refrigerants is equal to or greater than a1, may control the electronic expansion valve 814 so that a degree of opening of the electronic expansion valve 814 is equal to or greater than b1, and may control the first to third blower fans 123*a* to 123*c* so that RPMs of the first to third blower fans 123*a* to 123*c* are equal to or higher than c1 rpm, in operation 510.

According to the current embodiment, the dehumidification command input through the input unit 804 may be a command for setting the fourth dehumidification mode described above. If the dehumidification command is received, the controller 3802 may control the compressor 812 and the electronic expansion valve 814 so that room humidity and room temperature can reach a target temperature range and a target humidity range in a short time, and drive all of the first blower fan 123*a*, the second blower fan 123*b*, and the third blower fan 123*c*. That is, if the dehumidification command is received, the air conditioner may perform dehumidification according to the first dehumidification mode described above during an initial period of dehumidification. At this time, an amount of circulating refrigerants may be controlled to be equal to or greater than a target value a1, a degree of opening of the electronic expansion valve 814 may also be controlled to be equal to or greater than a target value b1, and RPM of the blower fan 123 may also be controlled to be equal to or greater than a target value c1.

If the controller 802 determines in operation 520 that room humidity reaches the target humidity range, the controller 802 may stop driving the compressor 812 and the blower fan 123, in operation 530. Thereafter, if the controller 802 determines in operation 540 that room humidity deviates from the target humidity range, the controller 802 may control driving of the compressor 812 so that an amount of circulating refrigerants is equal to or smaller than a2, may control the electronic expansion valve 814 so that a degree of opening of the electronic expansion valve 814 is equal to or smaller than b2, and may control the first to third blower fans 123*a* to 123*c* so that RPM of at least one blower fan 123 is equal to or lower than c2 rpm, in operation 550.

The humidity sensor 805 may sense a change in room humidity in real time, and the controller 802 may also determine whether room humidity reaches the target humidity range, based on the result of the sensing by the humidity sensor 805. If the controller 802 determines that the room humidity reaches the target humidity range, the controller 802 may stop driving the compressor 812 and the blower fan 123.

If the controller 802 determines that room humidity deviates from the target humidity range, the controller 802 may control the compressor 812 and the electronic expansion valve 814 so that room humidity can again reach the target humidity range. In this case, there is high probability that a difference between the room humidity and the target humidity range is smaller than when dehumidification is initially performed. Accordingly, when room humidity deviates from the target humidity range, dehumidification may be performed with higher priority to save power than to shorten a time taken for dehumidification, under the assumption that a difference between the room temperature and the target humidity range is not great. That is, the air conditioner may perform dehumidification according to the second dehumidification mode after room humidity reaches the target humidity range.

Upon dehumidification according to the second dehumidification mode, the controller 802 may control driving of the compressor 812 to circulate an amount a2 (a2=a1−q) of refrigerants (or less) reduced by a predetermined amount q from an amount a1 of refrigerants of the first dehumidification mode. In order to compensate the reduced amount of circulating refrigerants, the controller 802 may control the electronic expansion valve 814 so that a degree of opening of the electronic expansion valve 814 becomes a degree b2 (b2=b1−d) of opening (or less) reduced by a predetermined value d from a degree b1 of opening in the first dehumidification mode.

Until a command for finishing dehumidification is received, the controller 802 may repeat operations of stopping driving the compressor 812 if room humidity enters the target humidity range and of driving the compressor 812 if room humidity deviates from the target humidity range. Alternatively, until a command for finishing dehumidification is received, the controller 802 may continue to control the compressor 812 and the electronic expansion valve 814 such that room humidity does not deviate from the target humidity range.

Also, if room temperature enters the target temperature range, the controller 802 may stop driving a part of the first to third blower fans 123*a* to 123*c*, and if room temperature becomes equal to or lower than the lower limit of the target temperature range, the controller 802 may drive only any one of the first to third blower fans 123*a* to 123*c*, or stop driving all of the first to third blower fans 123*a* to 123*c*. For example, if room temperature enters the target temperature range, the controller 802 may stop driving the third blower fan 123*c* of the first to third blower fans 123*a* to 123*c*, and control a third door element 121*b*-5 to close the third outlet. If room temperature becomes equal to or lower than the lower limit of the target temperature range, the controller 802 may drive only the first blower fan 123*a*, and control the second door element 121*b*-5 and the third door element 121*c*-5 to close the second outlet and the third outlet. Or, as described above, the controller 802 may stop driving all of the first to third blower fans 123*a*, 123*b*, and 123*c*, and close all of the outlets.

Also, when the second dehumidification mode is performed, the controller 802 may select a blower fan 123 which it is to drive according to room temperature, and drive the selected blower fan 123 at RPM c2 (c2=c1−r) (or less) reduced by a predetermined value r from RPM c1 of the first dehumidification mode.

The RPM of the blower fan 123 may be decided as RPM at which a user can little feel cool air discharged from the air conditioner, through a test. That is, the air conditioner according to the current embodiment may lower the RPM of the blower fan 123 to a predetermined level in the second dehumidification mode so that the user can little feel cooling accompanied by the dehumidification function, because room temperature as well as room humidity reaches the target temperature range through dehumidification according to the first dehumidification mode. In this case, the controller 802 may control the door elements 121*a*-5, 121*b*-5, and 121*c*-5 of the blower fan units 120*a*, 120*b*, and 120*c* to close all of the outlets, so that air can be discharged only through the fine openings formed in the front panel. Although the wind volume or wind velocity of discharged air is already reduced because the RPM of the blower fan 123 is lowered, the controller 802 may adjust the door elements 121*a*-5, 121*b*-5, and 121*c*-5 to close the outlets, thereby further lowering a level of cool air that the user can feel.

If a command for finishing dehumidification is received through the input unit 804 in operation 560, the controller 802 may finish the execution of the dehumidification function.

As shown in FIGS. 27 and 29, if a dehumidification command is received through the input unit 804 in operation 600, the controller 802 of the air conditioner according to an embodiment of the present disclosure may control driving of the compressor 812 so that an amount of circulating refrigerants is equal to or smaller than a2, may control the electronic expansion valve 814 so that a degree of opening of the electronic expansion valve 814 is equal to or smaller than b2, and may control the first to third blower fans 123*a* to 123*c* so that RPM of at least one blower fan 123 is equal to or lower than c2 rpm, in operation 610.

According to the current embodiment, the dehumidification command input through the input unit 804 may be a command for setting the second dehumidification mode described above. In the second dehumidification mode, because the controller 802 gives higher priority to save power than to shorten a time taken for dehumidification, the controller 802 may reduce an amount of circulating refrigerants rather than when the first dehumidification mode is executed. That is, if the second dehumidification mode is selected, the controller 802 may control driving of the compressor 812 to circulate an amount a2 (a2=a1−q) of refrigerants (or less) reduced by a predetermined amount q from an amount a1 of refrigerants of the first dehumidification mode. In order to compensate the reduced amount of circulating refrigerants, the controller 802 may control the electronic expansion valve 814 so that a degree of opening of the electronic expansion valve 814 becomes a degree b2 (b2=b1−d) of opening (or less) reduced by a predetermined value d from a degree b1 of opening in the first dehumidification mode. Also, the controller 802 may drive the blower fan 123 at RPM c2 (c2=c1−r) (or less) reduced by a predetermined value r from RPM c1 of the blower fan 123 of the first dehumidification mode, as described above. The RPM of the blower fan 123 may be decided as RPM at which a user can little feel cool air discharged from the air conditioner, through a test. That is, the air conditioner according to the current embodiment may lower the RPM of the blower fan 123 to a predetermined level in the second dehumidification mode so that the user can little feel cooling accompanied by the dehumidification function. In this case, the controller 802 may control the door elements 121*a*-5, 121*b*-5, and 121*c*-5 of the blower fan units 120*a*, 120*b*, and 120*c* to close all of the outlets, so that air can be discharged only through the fine openings formed in the front panel. Although the wind volume or wind velocity of discharged air is already reduced because the RPM of the blower fan 123 is lowered, the controller 802 may adjust the door elements 121*a*-5, 121*b*-5, and 121*c*-5 to close the outlets, thereby further lowering a level of cool air that the user can feel.

Also, if the controller 802 determines in operation 620 that room humidity reaches the target humidity range, the controller 802 may stop driving the compressor 812 and the blower fan 123, in operation 630. Thereafter, if the controller 802 determines in operation 640 that room humidity deviates from the target humidity range, the controller 802 may control driving of the compressor 812 so that an amount of circulating refrigerants is equal to or smaller than a2, may control the electronic expansion valve 814 so that a degree of opening of the electronic expansion valve 814 is equal to or smaller than b2, and may control the first to third blower fans 123*a* to 123*c* so that the RPM of at least one blower fan 123 is equal to or lower than c2 rpm, in operation 650.

The humidity sensor 805 may sense a change in room humidity in real time, and the controller 802 may also determine whether room humidity reaches the target humidity range, based on the result of the sensing by the humidity sensor 805. If the controller 802 determines that the room humidity reaches the target humidity range, the controller 802 may stop driving the compressor 812 and the blower fan 123.

If the controller 802 determines that room humidity deviates from the target humidity range, the controller 802 may control the compressor 812, the electronic expansion valve 814, and the blower fan 123 according to the second dehumidification mode so that room humidity can again reach the target humidity range, as described above.

Until a command for finishing dehumidification is received, the controller 802 may repeat operations of stopping driving the compressor 812 if room humidity enters the target humidity range and of driving the compressor 812 if room humidity deviates from the target humidity range. Alternatively, until a command for finishing dehumidification is received, the controller 802 may continue to control the compressor 812 and the electronic expansion valve 814 such that room humidity does not deviate from the target humidity range.

If a command for finishing dehumidification is received through the input unit 804 in operation 660, the controller 802 may finish the execution of the dehumidification function.

Referring to FIGS. 27 and 30, if a dehumidification command is received through the input unit 804 in operation 700, the controller 802 of the air conditioner according to an embodiment of the present disclosure may control driving of the compressor 812 so that an amount of circulating refrigerants is equal to or greater than a1, may control the electronic expansion valve 814 so that a degree of opening of the electronic expansion valve 814 is equal to or greater than b1, and may control the first to third blower fans 123*a* to 123*c* so that the RPM of at least one blower fan 123 is equal to or lower than c2 rpm, in operation 710.

According to the current embodiment, the dehumidification command input through the input unit 804 may be a command for setting the fourth dehumidification mode described above. If the dehumidification command is received, the controller 802 may control the compressor 812 and the electronic expansion valve 814 so that room humidity can reach the target humidity range. In this case, the controller 802 may control the compressor 812 and the electronic expansion valve 814, like dehumidification according to the first dehumidification mode. At this time, an amount of circulating refrigerants may be controlled to be equal to or greater than a target value a1, and a degree of opening of the electronic expansion valve 814 may also be controlled to be equal to or greater than a target value b1.

However, the controller 802 of the air conditioner according to the current embodiment may drive at least one blower fan 123 of the first to third blower fans 123*a* to 123*c*, at RPM reduced to a predetermined level according to the second dehumidification mode, not the first dehumidification mode. That is, the controller 802 may drive at least one blower fan 123 of the first to third blower fans 123*a* to 123*c*, at RPM c2 (c2=c1−r) (or less) reduced by the predetermined value r from the RPM c1 of the first dehumidification mode.

According to the current embodiment, by driving the blower fan 123 at RPM reduced to a predetermined level at which a user can little feel cooling accompanied by dehumidification from when the dehumidification function starts to be executed, wind volume discharged from the air conditioner can be reduced. Also, in this case, the controller 802 may control the door elements 121*a*-5, 121*b*-5, and 121*c*-5 of the blower fan units 120*a*, 120*b*, and 120*c* to close all of the outlets, so that air can be discharged only through the fine openings formed in the front panel. Although the wind volume or wind velocity of discharged air is already reduced because the RPM of the blower fan 123 is lowered, the controller 802 may adjust the door elements 121*a*-5, 121*b*-5, and 121*c*-5 to close the outlets, thereby further lowering a level of cool air that the user can feel.

Also, until room temperature reaches the target temperature range, the controller 802 may drive all of the first to third blower fans 123*a* to 123*c* at the RPM reduced to the predetermined level. If room temperature enters the target temperature range, the controller 802 may stop driving a part of the first to third blower fans 123*a* to 123*c*, and if room temperature becomes equal to or lower than the lower limit of the target temperature range, the controller 802 may drive only any one of the first to third blower fans 123*a* to 123*c* or stop driving all of the first to third blower fans 123*a* to 123*c*. For example, if room temperature enters the target temperature range, the controller 802 may stop driving the third blower fan 123*c* of the first to third blower fans 123*a* to 123*c*, and control the third door element 121*c*-5 to close the third outlet. If room temperature becomes equal to or lower than the lower limit of the target temperature range, the controller 802 may drive only the first blower fan 123*a*, and control the second door element 121*b*-5 and the third door element 121*c*-5 to close the second outlet and the third outlet. Or, as described above, the controller 802 may stop driving all of the first to third blower fans 123*a* to 123*c*, and close all of the outlets.

If room humidity reaches the target humidity range in operation 720, the controller 802 may stop driving the compressor 812 and the blower fan 123, in operation 730. Thereafter, if room humidity deviates from the target humidity range in operation 740, the controller 802 may control driving of the compressor 812 so that an amount of circulating refrigerants is equal to or smaller than a2, may control the electronic expansion valve 814 so that a degree of opening of the electronic expansion valve 814 is equal to or smaller than b2, and may control the first to third blower fans 123*a* to 123*c* so that RPM of at least one blower fan is equal to or lower than c2 rpm, in operation 750.

The humidity sensor 805 may sense a change in room humidity in real time, and the controller 802 may also determine whether room humidity reaches the target humidity range, based on the result of the sensing by the humidity sensor 805. If the controller 802 determines that room humidity reaches the target humidity range, the controller 802 may stop driving the compressor 812.

If the controller 802 determines that room humidity deviates from the target humidity range, the controller 802 may control the compressor 812 and the electronic expansion valve 814 so that the room temperature can again reach the target humidity range. In this case, there is high probability that a difference between the room humidity and the target humidity range is smaller than when dehumidification is initially performed. Accordingly, when the room humidity deviates from the target humidity range, dehumidification may be performed with higher priority to save power than to shorten a time taken for dehumidification, under the assumption that a difference between the room temperature and the target humidity range is not great. That is, the air conditioner may perform dehumidification according to the second dehumidification mode after the room humidity reaches the target humidity range.

Upon dehumidification according to the second dehumidification mode, the controller 802 may control driving of the compressor 812 to circulate an amount a2 (a2=a1−q) of refrigerants (or less) reduced by a predetermined amount q from an amount a1 of refrigerants of the first dehumidification mode. In order to compensate the reduced amount of circulating refrigerants, the controller 802 may control the electronic expansion valve 814 so that a degree of opening of the electronic expansion valve 814 becomes a degree b2 (b2=b1−d) of opening (or less) reduced by a predetermined value d from a degree b1 of opening in the first dehumidification mode. Also, the controller 802 may select a blower fan 123 which it is to drive according to room temperature, and drive the selected blower fan 123 at RPM c2 (c2=c1−r) (or less) reduced by a predetermined value r from RPM c1 of the first dehumidification mode.

Until a command for finishing dehumidification is received, the controller 802 may repeat operations of stopping driving the compressor 812 if room humidity enters the target humidity range and of driving the compressor 812 if room humidity deviates from the target humidity range. Alternatively, until a command for finishing dehumidification is received, the controller 802 may continue to control the compressor 812 and the electronic expansion valve 814 such that room humidity does not deviate from the target humidity range.

If a command for finishing dehumidification is received through the input unit 804 in operation 760, the controller 802 may finish the execution of the dehumidification function.

According to the embodiments of the present disclosure, the air conditioner can sense room temperature or room humidity to select operation of maintaining the temperature or humidity of indoor space within a pleasant temperature or humidity range.

Also, when the temperature or humidity of indoor space is within the pleasant temperature or humidity range, low-velocity cooling may be performed through the outlet hole, instead of the outlet, to maintain the indoor space at pleasant temperature or humidity while preventing cool air discharged from the air conditioner from arriving at a user. Furthermore, by performing low-velocity cooling through the outlet hole formed in the lower portion of the air conditioner, it is possible to cool the lower area of indoor space at pleasant temperature when a user is asleep.

Also, by operating the blower fan of the air conditioner based on time and temperature when the blower fan stops, it is possible to prevent condensation which may occur in the air conditioner, and to implement a dehumidification function with a low cooling effect.

The air conditioner and the control method thereof have been described based on the embodiments with reference to the accompanying drawings. However, the air conditioner and the control method thereof are not limited to the above-described embodiments, and the above-described embodiments are only exemplary in all aspects. Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

a housing;

a heat exchanger configured to exchange heat with air inside of the housing;

a fan configured to move the heat exchanged air to be discharged to an outside of the housing;

an outlet configured to discharge the heat exchanged air to the outside of the housing;

a door configured to open or close the outlet;

a guide body having one side facing the outlet, forming a discharge path between the fan and the outlet, and having a cylindrical shape;

a guide groove provided along a circumference of the guide body and configured to guide the heat exchanged air to be discharged to the outside of the housing; and a controller configured to:

control the door to close the outlet when a temperature of an area reaches a predetermined value, and control the fan, while the outlet is closed by the door, to reduce Revolutions Per Minute (RPM) of the fan so that the heat exchanged air is discharged through the guide groove at a predetermined wind velocity.

2. The air conditioner according to claim 1, wherein while the temperature of the area is lower than the predetermined value, the controller reduces Revolutions Per Minute (RPM) of the fan to reduce the predetermined wind velocity of the heat exchanged air discharged through the guide groove.

3. The air conditioner according to claim 1, wherein the controller adjusts Revolutions Per Minute (RPM) of the fan such that a velocity of the heat exchanged air discharged through the guide groove while the outlet is closed is lower than a velocity at which the heat exchanged air is discharged through the outlet while the outlet is open.

4. An air conditioner comprising:

a housing;

a heat exchanger configured to exchange heat with air in the housing;

a fan configured to move the heat exchanged air to discharge the heat exchanged air to an outside of the housing;

an outlet configured to discharge the heat exchanged air to the outside of the housing;

a door configured to open or close the outlet;

a guide body having one side facing the outlet, forming a discharge path between the fan and the outlet, and having a cylindrical shape;

a guide groove provided along a circumference of the guide body and configured to guide the air to be discharged to the outside of the housing; and a controller configured to:

control the door to close the outlet when a humidity of a room reaches a predetermined value, and control the fan, while the outlet is closed by the door, to reduce a rotation velocity of the fan so that the heat exchanged air discharged through the guide groove at a predetermined wind velocity.

5. The air conditioner according to claim 4, wherein while the humidity of the room is lower than the predetermined value, the controller reduces Revolutions Per Minute (RPM) of the fan to reduce the predetermined wind velocity of the heat exchanged air discharged through to the guide groove.

6. The air conditioner according to claim 4, wherein the controller adjusts Revolutions Per Minute (RPM) of the fan such that a velocity of the heat exchanged air discharged through the guide groove while the outlet is closed is lower than a velocity at which the heat exchanged air is discharged through the outlet while the outlet is open.

* * * * *